US007557761B2

(12) United States Patent
Iwai et al.

(10) Patent No.: US 7,557,761 B2
(45) Date of Patent: Jul. 7, 2009

(54) ARRAY ANTENNA APPARATUS HAVING AT LEAST TWO FEEDING ELEMENTS AND OPERABLE IN MULTIPLE FREQUENCY BANDS

(75) Inventors: Hiroshi Iwai, Osaka (JP); Atsushi Yamamoto, Kyoto (JP); Tsutomu Sakata, Osaka (JP); Toshiteru Hayashi, Kanagawa (JP); Kenichi Yamada, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/015,005

(22) Filed: Jan. 16, 2008

(65) Prior Publication Data

US 2008/0174508 A1 Jul. 24, 2008

(30) Foreign Application Priority Data

Jan. 19, 2007 (JP) ..... 2007-010162

(51) Int. Cl.
*H01Q 1/24* (2006.01)

(52) U.S. Cl. ..... 343/702; 343/853

(58) Field of Classification Search ..... 343/702, 343/850, 853, 855, 860, 893, 700 MS
See application file for complete search history.

(56) References Cited

U.S. PATENT DOCUMENTS 6,624,790 B1 * 9/2003 Wong et al. ..... 343/702
6,771,223 B1 8/2004 Shoji et al.
6,958,730 B2 * 10/2005 Nagumo et al. ..... 343/702
7,084,831 B2 * 8/2006 Takagi et al. ..... 343/860
7,129,893 B2 * 10/2006 Otaka et al. ..... 343/700 MS
2005/0128162 A1 * 6/2005 Takagi et al. ..... 343/895
2007/0080872 A1 4/2007 Nishikido et al.
2008/0266190 A1 * 10/2008 Ohba et al. ..... 343/702

FOREIGN PATENT DOCUMENTS

| | | |
|---|---|---|
| EP | 1 296 407 | 3/2003 |
| JP | 2005-130216 | 5/2005 |
| WO | 01/97325 | 12/2001 |
| WO | 02/39544 | 5/2002 |

* cited by examiner

*Primary Examiner*—HoangAnh T Le
(74) *Attorney, Agent, or Firm*—Wenderoth, Lind & Ponack, L.L.P.

(57) ABSTRACT

An array antenna apparatus includes a first feeding element having a first feed point, a second feeding element having a second feed point, and a first parasitic element electrically connected to the respective first and second feeding elements. In a first frequency band, respective resonances in the feeding elements occur independent of each other, by eliminating electromagnetic mutual coupling between the feeding elements, and exciting the first feeding element through the first feed point as well as exciting the second feeding element through the second feed point. In a second frequency band lower than the first frequency band, a loop antenna having a certain electrical length is formed by the first and second feeding elements and the first parasitic element, and a resonance of the loop antenna substantially occurs by exciting the first feeding element through the first feed point.

13 Claims, 33 Drawing Sheets

ARRAY ANTENNA APPARATUS HAVING AT LEAST TWO FEEDING ELEMENTS AND OPERABLE IN MULTIPLE FREQUENCY BANDS

BACKGROUND OF THE INVENTION

1. Field of the Invention

The present invention relates to an array antenna apparatus, mainly for mobile communication, having at least two feeding elements and operable in multiple frequency bands, and relates to a wireless communication apparatus provided with this array antenna apparatus.

2. Description of the Related Art

The size and thickness of portable wireless communication apparatuses, such as mobile phones, have been rapidly reduced. Portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In such circumstances, an array antenna apparatus provided with multiple antenna elements, and an antenna apparatus capable of switching among directivities have been proposed.

PCT International Publication WO02/39544 discloses an antenna device including a rectangular conductive board, and a flat plate antenna mounted on the board with a dielectric interposing therebetween. The antenna device is characterized by exciting the antenna in a certain direction so as to flow a current through the board in one diagonal direction, and exciting the antenna in a different direction so as to flow a current through the board in the other diagonal direction. As such, in the antenna device disclosed in PCT International Publication WO02/39544, the directivity and polarization direction of the antenna device can be changed by varying the direction of a current flowing through the board.

Japanese Patent Laid-Open Publication No. 2005-130216 discloses a mobile radio apparatus that is foldable and that has a mechanism joining a first case and second case at a hinge part allowing said mobile radio apparatus to open and close. The mobile radio apparatus includes: a first flat conductor placed on a first plane inside the first case along a longitudinal direction of the first case, and second and third flat conductors placed on a second plane opposing a first plane inside the first case along the longitudinal direction of the first case, and feeding means for feeding the first flat conductor and feeding selectively the second or the third flat conductor at a phase different from a phase with which the first flat conductor is fed. The mobile wireless apparatus disclosed in Japanese Patent Laid-Open Publication No. 2005-130216 can improve communication performance by switching between the second and third flat conductors in response to a reduction in reception level.

PCT International Publication WO01/97325 discloses a portable radio unit including a dipole antenna, and two feeding means each connected to one of two antenna elements that compose the dipole antenna.

Recently, an antenna apparatus has appeared that adopts MIMO (Multi-Input Multi-Output) technology for simultaneously transmitting and/or receiving radio signals of a plurality of channels by space division multiplexing, in order to increasing communication capacity and achieve high-speed communication. The antenna apparatus that performs MIMO communication needs to simultaneously transmit and/or receive a plurality of radio signals with low correlation to each other, each having a different directivity, polarization characteristics, or the like, in order to achieve the space division multiplexing. The antenna device disclosed in PCT International Publication WO02/39544 can switch over to a different directivity, however, this antenna device cannot simultaneously implement a plurality of states, each having a different directivity. The mobile radio apparatus disclosed in Japanese Patent Laid-Open Publication No. 2005-130216 requires a plurality of antenna elements (flat conductors), and results in a complicated structure. Furthermore, in a similar manner to that of the antenna device disclosed in PCT International Publication WO02/39544, although this mobile radio apparatus can switch over to a different directivity, this mobile radio apparatus cannot simultaneously implement a plurality of states, each having a different directivity. The portable radio unit disclosed in PCT International Publication WO01/97325 cannot switch between directivities, and also cannot simultaneously implement a plurality of states, each having a different directivity.

Moreover, in the case that an array antenna is mounted in a small-sized wireless communication apparatus such as a mobile phone, a distance between feeding elements is inevitably reduced, thus resulting in a problem that isolation between the feeding elements becomes insufficient.

Additionally, it is desirable to provide an antenna apparatus operable in multiple frequency bands, as well as capable of the MIMO communication, in order to perform, e.g., communications for a plurality of applications. Such an antenna apparatus has not been disclosed in any of PCT International Publication WO02/39544, Japanese Patent Laid-Open Publication No. 2005-130216, and PCT International Publication WO01/97325.

SUMMARY OF THE INVENTION

An object of the present invention is therefore to solve the above-described problems, and to provide an array antenna apparatus available for MIMO communication etc., capable of ensuring sufficient isolation between feeding elements and operable in multiple frequency bands while having a simple configuration, and to provide a wireless communication apparatus that includes such an array antenna apparatus.

According to a first aspect of the present invention, an array antenna apparatus is provided, and the array antenna apparatus includes a first feeding element having a first feed point, a second feeding element having a second feed point, and a first parasitic element electrically connected to the respective first and second feeding elements. The array antenna apparatus is characterized in that in a first frequency band, respective resonances in the first and second feeding elements substantially occur independent of each other, by eliminating electromagnetic mutual coupling between the first and second feeding elements, and exciting the first feeding element through the first feed point as well as exciting the second feeding element through the second feed point. The array antenna apparatus is further characterized in that in a second frequency band lower than the first frequency band, a loop antenna having a certain electrical length is formed by the first and second feeding elements and the first parasitic element, and a resonance of the loop antenna substantially occurs by exciting the first feeding element through the first feed point.

The array antenna apparatus is configured such that in the first frequency band, an imaginary part of a mutual impedance between the first and second feeding elements upon assuming that the first parasitic element is not present, and an imaginary part of an impedance appearing by capacitively coupling the first parasitic element to the respective first and second feeding elements are cancelled by each other, whereby the electromagnetic mutual coupling between the first and second feeding elements is eliminated. The array antenna apparatus is further configured such that in the second frequency band, an imaginary part of a mutual impedance between the first and second feeding elements upon assuming that the first parasitic element is not present, and an imaginary part of an impedance appearing by capacitively coupling the parasitic element to the respective first and second feeding elements are not cancelled, whereby the loop antenna is formed by the first and second feeding elements and the first parasitic element.

Moreover, in the array antenna apparatus, each of the first and second feeding elements is electrically connected to the first parasitic element through a capacitive coupling.

Further, in the array antenna apparatus, each of the first and second feeding elements is electrically connected to the first parasitic element through an LC resonant circuit.

Furthermore, in the array antenna apparatus, the first parasitic element is grounded.

Moreover, in the array antenna apparatus, the first parasitic element is grounded through a capacitance.

Further, in the array antenna apparatus, the first and second feeding elements are of equal element length to each other.

Furthermore, in the array antenna apparatus, the first and second feeding elements are of different element lengths from each other.

Moreover, the array antenna apparatus further includes a second parasitic element capacitively coupled to the respective first and second feeding elements. The array antenna apparatus is characterized in that in the first frequency band, an imaginary part of a mutual impedance between the first and second feeding elements upon assuming that the first and second parasitic elements are not present, and an imaginary part of an impedance appearing by capacitively coupling the first and second parasitic elements to the respective first and second feeding elements are cancelled by each other, whereby the electromagnetic mutual coupling between the first and second feeding elements is eliminated. The array antenna apparatus is further characterized in that in the second frequency band, an imaginary part of a mutual impedance between the first and second feeding elements upon assuming that the first and second parasitic elements are not present, and an imaginary part of an impedance appearing by capacitively coupling the first and second parasitic elements to the respective first and second feeding elements are not cancelled, whereby the loop antenna is formed by the first and second feeding elements and the first parasitic element.

An array antenna apparatus according to a second aspect of the present invention includes a first feeding element having a first feed point, a second feeding element having a second feed point, a third feeding element having a third feed point, and a parasitic element electrically connected to the respective first, second and third feeding elements. The array antenna apparatus is characterized in that in a first frequency band, respective resonances in at least two feeding elements of the first, second and third feeding elements substantially occur independent of each other, by eliminating electromagnetic mutual coupling between the at least two feeding elements, and exciting one of the at least two feeding elements through the feed point thereof as well as exciting another of the at least two feeding elements through the feed point thereof. The array antenna apparatus is further characterized in that in a second frequency band lower than the first frequency band, a loop antenna having a certain electrical length is formed by the first feeding element, the parasitic element, and one of the second and third feeding elements, and a resonance of the loop antenna substantially occurs by exciting the first feeding element through the first feed point.

Moreover, an array antenna apparatus according to a third aspect of the present invention includes a first feeding element having a first feed point, a second feeding element having a second feed point, a third feeding element having a third feed point, a first parasitic element electrically connected to the respective first and second feeding elements, and a second parasitic element electrically connected to the respective second and third feeding elements. The array antenna apparatus is characterized in that in a first frequency band, respective resonances in at least two feeding elements of the first, second and third feeding elements substantially occur independent of each other, by eliminating electromagnetic mutual coupling between the at least two feeding elements, and exciting one of the at least two feeding elements through the feed point thereof as well as exciting another of the at least two feeding elements through the feed point thereof. The array antenna apparatus is further characterized in that at a first frequency in a second frequency band lower than the first frequency band, a first loop antenna having a first electrical length is formed by the first and second feeding elements and the first parasitic element, and a resonance of the first loop antenna substantially occurs by exciting the first feeding element through the first feed point. The array antenna apparatus is further characterized in that at a second frequency different from the first frequency in the second frequency band, a second loop antenna having a second electrical length different from the first electrical length is formed by the second and third feeding elements and the second parasitic element, and a resonance of the second loop antenna substantially occurs by exciting the third feeding element through the third feed point.

Moreover, in the array antenna apparatus, in the first frequency band, the feeding elements in which the respective resonances substantially occur independent of each other receive a plurality of channel signals according to a MIMO communication scheme, respectively.

A wireless communication apparatus according to a fourth aspect of the present invention is provided with an array antenna apparatus, and the array antenna apparatus includes a first feeding element having a first feed point, a second feeding element having a second feed point, and a first parasitic element electrically connected to the respective first and second feeding elements. The array antenna apparatus is characterized in that in a first frequency band, respective resonances in the first and second feeding elements substantially occur independent of each other, by eliminating electromagnetic mutual coupling between the first and second feeding elements, and exciting the first feeding element through the first feed point as well as exciting the second feeding element through the second feed point. The array antenna apparatus is further characterized in that in a second frequency band lower than the first frequency band, a loop antenna having a certain electrical length is formed by the first and second feeding elements and the first parasitic element, and a resonance of the loop antenna substantially occurs by exciting the first feeding element through the first feed point.

As described above, according to the array antenna apparatus and the wireless communication apparatus of the present invention, an array antenna apparatus can be provided, available for MIMO communication etc., capable of ensuring sufficient isolation between feeding elements and operable in multiple frequency bands while having a simple configuration, and a wireless communication apparatus provided with such an array antenna apparatus can be provided.

Thus, according to the present invention, when performing MIMO communication in a higher frequency band, sufficient isolation between feeding elements can be ensured. Furthermore, it is possible to perform a communication for other applications in a lower frequency band without increasing the number of feeding elements.

The most important effect provided by the present invention is to achieve that an array antenna apparatus is provided with a capability of operating in multiple bands, by capacitively coupling respective feeding elements with a parasitic element having a certain electrical length. By providing the parasitic element close to two respective feeding elements, the array antenna apparatus can operate in a lower frequency band due to a resonance of a loop antenna formed from the two feeding elements and the parasitic element, as well as operate in operating frequencies inherent to the respective feeding elements themselves (a higher frequency band), and thus can have resonances in multiple frequency bands. When the array antenna apparatus operates in the higher frequency band, isolation between the feeding elements can be improved by adjusting the electrical length of the parasitic element so as to cancel an imaginary part of a mutual impedance between the feeding elements (an impedance between a feed point on a first feeding element and a feed point on a second feeding element), and thus, in MIMO communication, a correlation coefficient between the feeding elements can be reduced.

BRIEF DESCRIPTION OF THE DRAWINGS

Various objects, features and advantages of the present invention will be disclosed as preferred embodiments which are described below with reference to the accompanying drawings.

DETAILED DESCRIPTION OF THE PREFERRED EMBODIMENTS

Figure 1A:
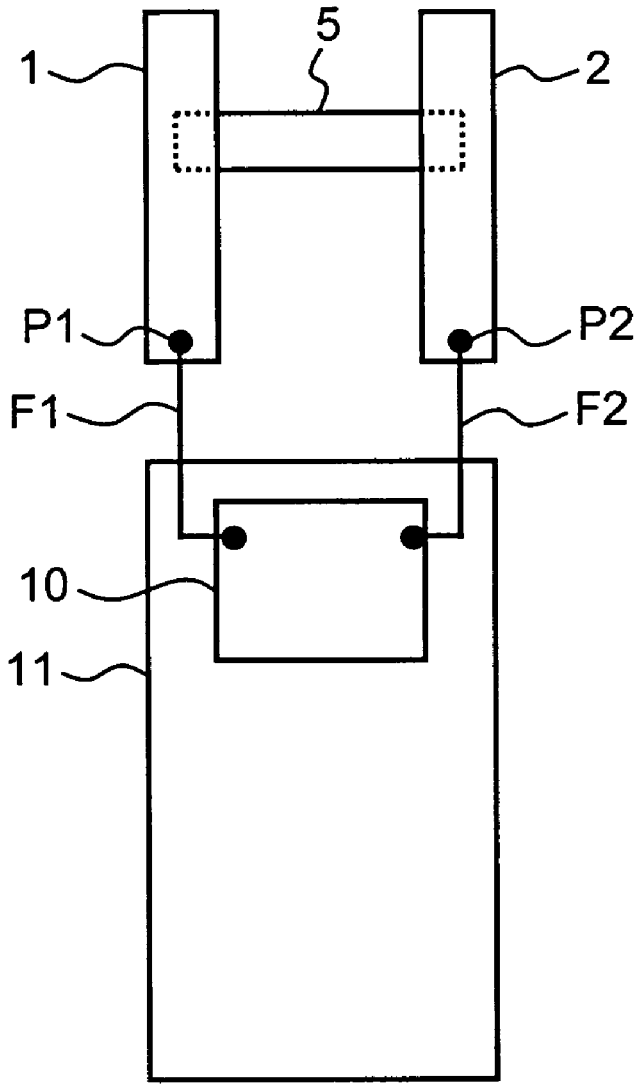
FIG. 1A is a front view showing a schematic configuration of an array antenna apparatus according to a first preferred embodiment of the present invention.

Preferred embodiments according to the present invention will be described below with reference to the drawings. Note that in the drawings the same reference numerals denote like components.

First Preferred Embodiment

Figure 1B:
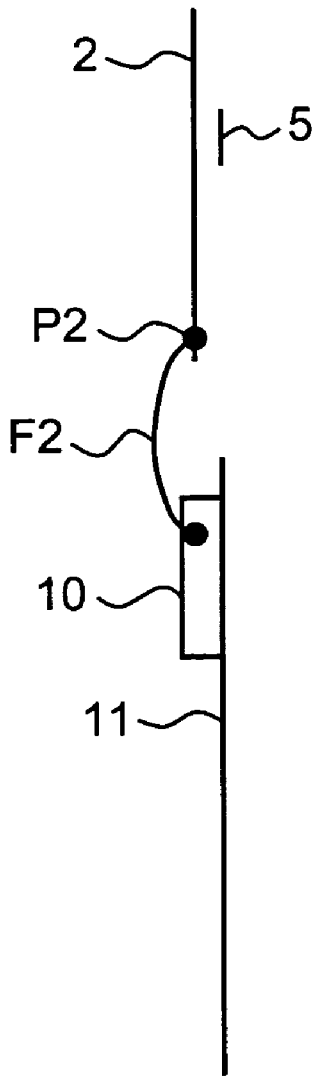
FIG. 1B is a side view of the array antenna apparatus in FIG. 1A.

FIG. 1A is a front view showing a schematic configuration of an array antenna apparatus according to a first preferred embodiment of the present invention, and FIG. 1B is a side view thereof. The array antenna apparatus of the present preferred embodiment is characterized in that the array antenna apparatus includes two feeding elements 1 and 2, and a parasitic element 5 capacitively coupled to the respective feeding elements 1 and 2, and that when operating in a higher frequency band, the apparatus performs MIMO communication by independently exciting the feeding elements 1 and 2; on the other hand, when operating in a lower frequency band, the apparatus performs communication by exciting the feeding element 1, the parasitic element 5 and the feeding element 2, which are capacitively coupled to each other, as a loop antenna.

In FIGS. 1A and 1B, the array antenna apparatus includes the feeding elements 1 and 2 each made of a rectangular conductive plate, and the feeding elements 1 and 2 are provided so as to be in the same plane and spaced apart by a certain distance from each other. Furthermore, the parasitic element 5 made of a rectangular conductive plate is provided in a plane spaced apart by a certain distance from the plane where the feeding elements 1 and 2 are provided, so as to be close to the feeding elements 1 and 2, respectively. One end of the parasitic element 5 is positioned close to a part of the feeding element 1 so as to capacitively couple to the feeding element 1, and the other end of the parasitic element 5 is positioned close to a part of the feeding element 2 so as to capacitively couple to the feeding element 2. These capacitive coupling portions correspond to an overlapping portion of the feeding element 1 and the parasitic element 5, and an overlapping portion of the feeding element 2 and the parasitic element 5, which are shown by dotted lines in FIG. 1A. Furthermore, a rectangular ground conductor 11 is provided so as to be spaced apart by a certain distance from each of the feeding elements 1 and 2. A feed point P1 is provided at an end of the feeding element 1, and the feed point P1 is connected to a radio signal processor circuit 10 through a feed line F1. Similarly, a feed point P2 is provided at an end of the feeding element 2, and the feed point P2 is connected to the radio signal processor circuit 10 through a feed line F2. Each of the feed lines F1 and F2 can be made of, e.g., a coaxial cable with an impedance of 50Ω; in this case, inner conductors of the coaxial cables connect the feed points P1 and P2 to the radio signal processor circuit 10, respectively, and on the other hand, outer conductors of the coaxial cables are respectively connected to the ground conductor 11.

In the present preferred embodiment, each of the feeding elements 1, 2 and the parasitic element 5 is configured as a conductive strip with a certain longitudinal element length. Each of the feeding elements 1, 2 has an element length resonant in a higher frequency band; for example, the feeding elements 1 and 2 may be configured to have an element length of about λ/4 with reference to a wavelength λ of a higher frequency band. The feeding elements 1 and 2 are arranged in parallel to each other in their longitudinal direction, and arranged such that one end of each feeding element 1, 2 in the longitudinal direction (in case of FIGS. 1A and 1B, each bottom end) is positioned close to the ground conductor 11. The feed points P1 and P2 are respectively provided on the feeding elements 1 and 2, at ends close to the ground conductor 11 in the longitudinal direction. One end in the longitudinal direction of the parasitic element 5 is capacitively coupled to a substantially central portion in the longitudinal direction of the feeding element 1, and the other end in the longitudinal direction of the parasitic element 5 is capacitively coupled to a substantially central portion in the longitudinal direction of the feeding element 2.

Figure 2A:
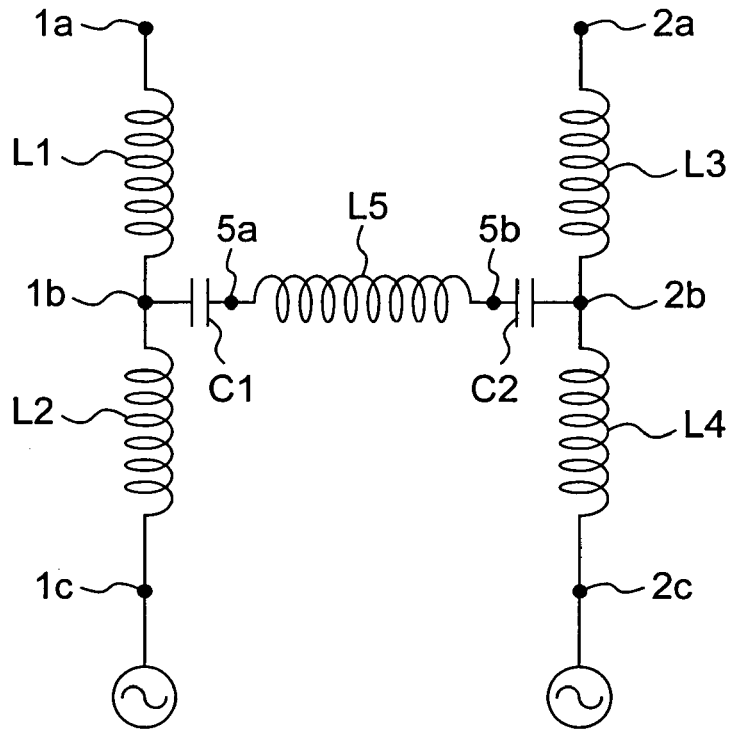
FIG. 2A is a diagram showing an equivalent circuit of feeding elements 1, 2 and a parasitic element 5 in FIGS. 1A and 1B.

FIG. 2A is a diagram showing an equivalent circuit of the feeding elements 1, 2 and the parasitic element 5 in FIGS. 1A and 1B. "1*a*", "1*b*" and "1*c*" denote a top end point, a point close to the parasitic element 5, and a bottom end point of the feeding element 1 in FIG. 1A, respectively. Similarly, "2*a*", "2*b*" and "2*c*" denote a top end point, a point close to the parasitic element 5, and a bottom end point of the feeding element 2 in FIGS. 1A and 1B, respectively. "5*a*" and "5*b*" denote a left end point (point close to the feeding element 1) and a right end point (point close to the feeding element 2) of the parasitic element 5 in FIGS. 1A and 1B, respectively. The point 1*c* corresponds to the feed point P1, and the point 2*c* corresponds to the feed point P2. As described above, the feeding element 1 and the parasitic element 5 are positioned close to each other so as to capacitively couple to each other, which is represented by a capacitance C1 between the points 1*b* and 5*a*. Similarly, the feeding element 2 and the parasitic element 5 are positioned close to each other so as to capacitively couple to each other, which is represented by a capacitance C2 between the points 2*b* and 5*b*. Further, the conductive plates, of which the feeding elements 1, 2 and the parasitic element 5 are made, have certain inductances. Inductances of the feeding element 1 are represented by an inductance L1 between the points 1*a* and 1*b*, and an inductance L2 between the points 1*b* and 1*c*. Inductances of the feeding element 2 are represented by an inductance L3 between the points 2*a* and 2*b*, and an inductance L4 between the points 2*b* and 2*c*. An inductance of the parasitic element 5 is represented by an inductance L5 between the points 5*a* and 5*b*.

The array antenna apparatus of the present preferred embodiment is configured such that when the array antenna apparatus operates in a higher frequency band (e.g., a frequency band near 2 GHz), an input impedance seen from the point 1*b* on the feeding element 1 to the parasitic element 5 and the feeding element 2, and an input impedance seen from the point 2*b* on the feeding element 2 to the parasitic element 5 and the feeding element 1 become certain high values (substantially infinite values). Hence, in the higher frequency band, it is possible to operate the feeding elements 1 and 2 independent of each other (i.e., respective resonances in the feeding elements 1 and 2 can substantially occur independent of each other) by independently exciting the feeding elements 1 and 2 through the respective feed points P1 and P2, and thus, the feeding elements 1 and 2 can be used for MIMO communication, etc. In this case, the feeding elements 1 and 2 are substantially in a state in which they are not electromagnetically coupled. On the other hand, the array antenna apparatus of the present preferred embodiment is configured such that when the array antenna apparatus operates in a lower frequency band (e.g., a frequency band near 1 GHz), an input impedance seen from the point 1*b* on the feeding element 1 to the parasitic element 5 and the feeding element 2, and an input impedance seen from the point 2*b* on the feeding element 2 to the parasitic element 5 and the feeding element 1 become smaller values than the aforementioned high values. Hence, in the lower frequency band, the feeding element 1, the parasitic element 5, and the feeding element 2 can operate resonantly as one loop antenna by exciting them through one of the feed points P1 and P2; the loop antenna extends from the point 1*c* of the feeding element 1, through the point 1*b* of the feeding element 1, the capacitance C1, the points 5*a* and 5*b* of the parasitic element 5, the capacitance C2, and the point 2*b* of the feeding element 2, to the point 2*c* of the feeding element 2 (or vice versa). The operational principles of the above-described operation will be described in detail below.

Figure 2B:
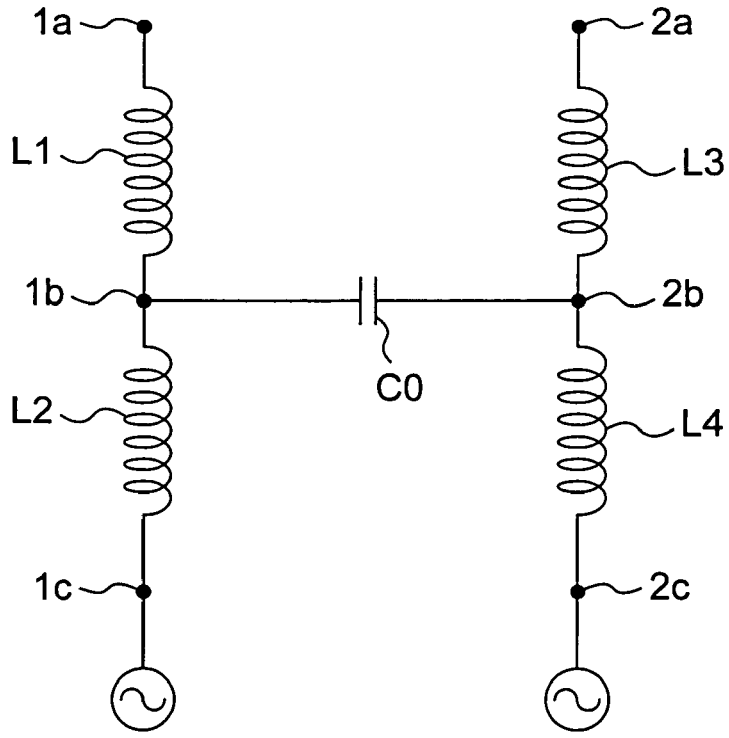
FIG. 2B is a diagram showing an equivalent circuit of only the feeding elements 1 and 2 in FIGS. 1A and 1B.

Let Zm be a mutual impedance between the feed points P1 and P2 upon assuming that the parasitic element 5 is not present in the configuration of the array antenna apparatus in FIGS. 1A and 1B. The impedance Zm represents a mutual coupling between the feeding elements 1 and 2, and in this case, the coupling between the feeding elements 1 and 2 is made at a gap portion between the conductive plates, and thus is substantially capacitive. This capacitance is represented by a capacitance C0 in FIG. 2B. In order to eliminate the mutual coupling between the feeding elements 1 and 2, it is necessary to provide an impedance Zm* being complex conjugate to the impedance Zm, and since the impedance Zm is capacitive, a circuit element having an inductive property should be added. Therefore, the parasitic element 5 with the inductance L5 is capacitively coupled to the feeding elements 1 and 2 through the capacitances C1 and C2, respectively, so as to cancel an imaginary part Im(Zm) of the impedance Zm. In this case, the values of the inductance L5 and the capacitances C1 and C2 are configured such that the imaginary part Im(Zm) of the impedance Zm, and an imaginary part of an impedance, appearing by capacitively coupling the parasitic element 5 to the respective feeding elements 1 and 2, are cancelled by each other. As a result, the mutual coupling between the feeding elements 1 and 2 is eliminated, and accordingly, isolation between the feeding elements 1 and 2 (i.e., the above-described input impedances) is improved to be sufficiently large for the feeding elements 1 and 2 to operate independently. Specifically, when the array antenna apparatus is operating in a higher frequency band, the imaginary part of the impedance Zm between the feeding elements 1, 2 and an imaginary part of its conjugate impedance Zm* are cancelled by each other, and accordingly, the mutual coupling between the feeding elements 1 and 2 is eliminated (isolation is large). On the other hand, when the array antenna apparatus is operating in a lower frequency band, since the impedance Zm and the conjugate impedance Zm* vary, the imaginary parts thereof are not cancelled and the mutual coupling is maintained, and thus, a resonance occurs in a whole set of elements including the feeding elements 1, 2 and the parasitic element 5 capacitively coupled to each other. In this case, a loop antenna is formed extending from the point 1*c* of the feeding element 1, through the point 1*b* of the feeding element 1, the capacitance C1, the points 5*a* and 5*b* of the parasitic element 5, the capacitance C2, and the point 2*b* of the feeding element 2, to the point 2*c* of the feeding element 2 (or vice versa). Since an electrical length of this loop antenna is longer than electrical lengths of the feeding elements 1 and 2, this loop antenna can operate resonantly in the lower frequency band.

In this case, an electrical length from the point 1*b* on the feeding element 1, through the parasitic element 5 and the point 2*b* on the feeding element 2, to the point 2*c* on the feeding element 2 (i.e., an electrical length from the point 1*b* of the capacitive coupling portion on the feeding element 1 to the feed point P2) satisfies an expression "λ/4+n1λ", where "λ" denotes a wavelength of the higher frequency band, and "n1" denotes an integer greater than or equal to 0. Similarly, an electrical length from the point 2*b* on the feeding element 2, through the parasitic element 5 and the point 1*b* on the feeding element 1, to the point 1*c* on the feeding element 1 (i.e., an electrical length from the point 2*b* of the capacitive coupling portion on the feeding element 2 to the feed point P1) satisfies an expression "λ/4+n2λ", ("n2" denotes an integer greater than or equal to 0). As can be seen from these expressions, sufficient isolation between the feeding elements 1 and 2 can be obtained in a periodic manner (i.e., every integral multiple of the wavelength λ) by appropriately adjusting an electrical length from the capacitive coupling portion on one feeding element to the feed point of the other feeding element. Note that the term "λ/4" of the above expressions varies depending on the strength of the mutual coupling between the feeding elements 1 and 2, and thus the value of "λ/4" is merely an example in a preferred exemplary implementation. Therefore, when operating in the higher frequency band, the isolation between the feeding elements 1 and 2 can be improved by adjusting the electrical length of the parasitic element 5 so as to cancel an imaginary part of the mutual impedance between the feeding elements 1 and 2, and thus, in MIMO communication, a correlation coefficient between the feeding elements 1 and 2 can be reduced.

Figure 3A:
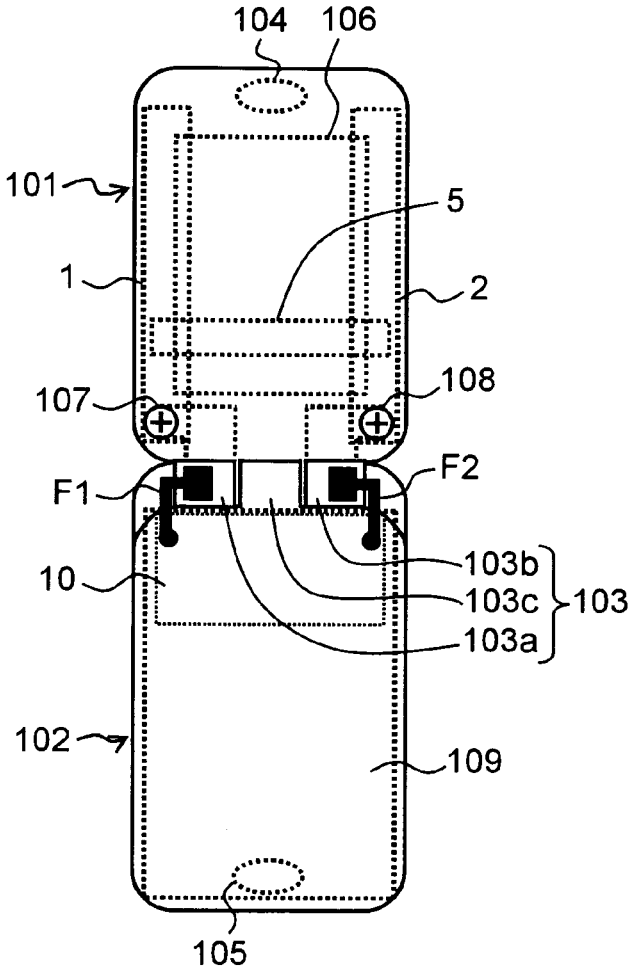
FIG. 3A is a front view of a mobile phone showing an exemplary implementation of the array antenna apparatus in FIGS. 1A and 1B.
Figure 3B:
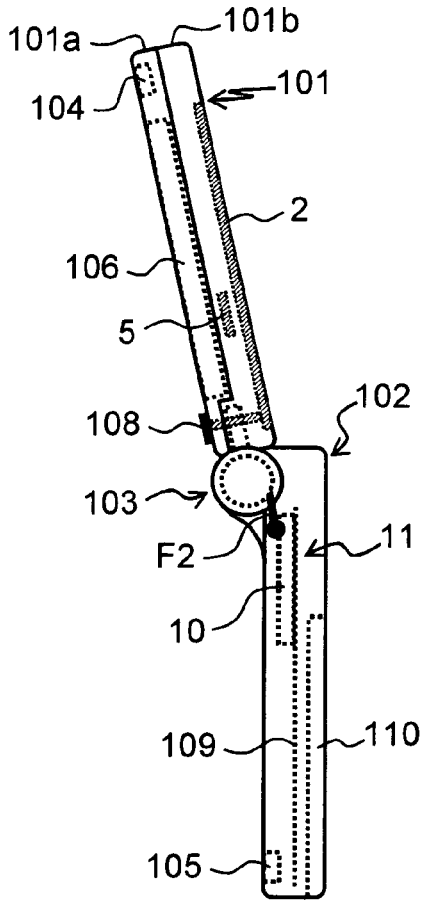
FIG. 3B is a side view of the array antenna apparatus in FIG. 3A.
Figure 3C:
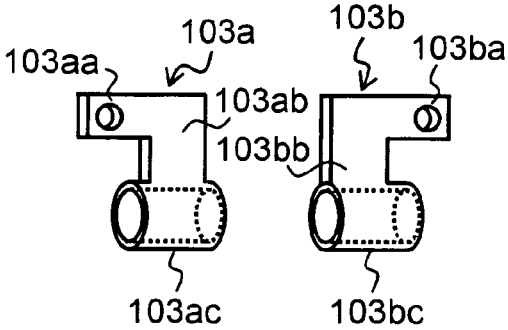
FIG. 3C is a perspective view showing a left hinge portion 103*a* and a right hinge portion 103*b* in FIG. 3A.
Figure 3D:
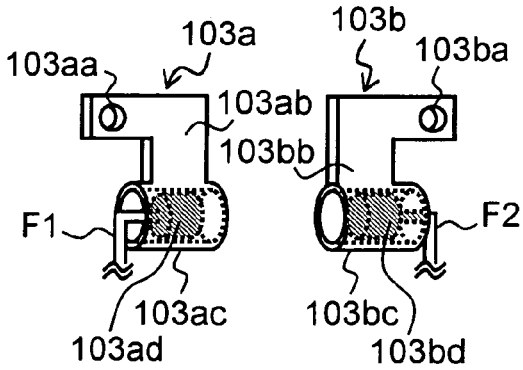
FIG. 3D is a perspective view showing a position in which inner conductors 103*ad* and 103*bd* are respectively inserted into the left hinge portion 103*a* and the right hinge portion 103*b* in FIG. 3C.

FIGS. 3A, 3B, 3C, and 3D show the configuration of a mobile phone which is an exemplary implementation of the array antenna apparatus in FIGS. 1A and 1B. FIG. 3A is a front view of the mobile phone of the exemplary implementation, FIG. 3B is a side view thereof, FIG. 3C is a perspective view showing a left hinge portion 103*a* and a right hinge portion 103*b* in FIG. 3A, and FIG. 3D is a perspective view showing a position in which inner conductors 103*ad* and 103*bd* are respectively inserted into the left hinge portion 103*a* and the right hinge portion 103*b* in FIG. 3C. In FIGS. 3A and 3B, the mobile phone of the present exemplary implementation includes an upper housing 101 and a lower housing 102, each being shaped in a substantially rectangular parallelepiped. The upper housing 101 and the lower housing 102 are connected to each other in a foldable manner through a cylindrical hinge portion 103. The upper housing 101 includes a first upper housing portion 101*a* located on a side close to a user during a telephone call using the mobile phone (in the following description, referred to as the "inner side" of the mobile phone), and a second upper housing portion 101*b* located on a side away from the user (hereinafter, referred to as the "outer side" of the mobile phone). The first upper housing portion 101*a* and the second upper housing portion 101*b* are secured by a screw 107 at a left bottom portion of the inner side of the upper housing 101, and secured by a screw 108 at a right bottom portion of the inner side of the upper housing 101. Each of the first upper housing portion 101*a*, the second upper housing portion 101*b*, and the lower housing 102 is made of dielectric (e.g., plastic). The hinge portion 103 includes a left hinge portion 103*a* and a right hinge portion 103*b* which are mechanically connected to the first upper housing portion 101*a*, and includes a central hinge portion 103*c* which is integrally formed with the lower housing 102 and fits between the left hinge portion 103*a* and the right hinge portion 103*b*. The upper housing 101 and the lower housing 102 can be rotated about the hinge portion 103 by a rotating shaft (not shown) extending through the left hinge portion 103*a*, the central hinge portion 103*c* and the right hinge portion 103*b*, and thus can be folded. In addition, a display 106 is disposed at substantially the center of the first upper housing portion 101*a*, and a speaker 104 is disposed above the display 106. Furthermore, a microphone 105 is disposed on the inner side of the mobile phone and in the vicinity of a bottom end of the lower housing 102, and a rechargeable battery 110 is disposed on the opposite side of the microphone 105 (i.e., the outer side of the mobile phone) in the lower housing 102. A rectangular printed wiring board 109 is disposed within the lower housing 102 and at substantially the center in a thickness direction of the lower housing 102 (for ease of illustration, the representation of the thickness of the printed wiring board 109 is omitted). On the entire outer side surface of the printed wiring board 109 is formed a conductive pattern which acts as the ground conductor 11 in FIGS. 1A and 1B, on the other hand, on an inner side surface of the printed wiring board 109 is provided a radio signal processor circuit 10. The lower housing 102 may be made of conductor, and in this case, the lower housing 102 instead of the printed wiring board 109 acts as the ground conductor 10.

Feeding elements 1, 2 and a parasitic element 5 are provided inside the upper housing 101. The feeding elements 1 and 2 are provided so as to extend along a longitudinal direction (up-down direction) of the upper housing 101, and close to a left side end and a right side end of the upper housing 101, respectively, and in contact with a surface facing the outer side of the upper housing 101. The parasitic element 5 is positioned towards the inner side of the mobile phone with respect to the feeding elements 1 and 2, so as to be spaced apart by a certain distance from each feeding element 1, 2. In the present exemplary implementation, the feeding elements 1 and 2 are connected to the radio signal processor circuit 10 through the left hinge portion 103*a* and the right hinge portion 103*b*, respectively, which are made of conductor, and in this case, preferably, the feeding elements 1 and 2 are capacitively fed by means of capacitances formed within the left hinge portion 103*a* and the right hinge portion 103*b*. The left hinge portion 103*a* and the right hinge portion 103*b* are made of conductive material such as aluminum or zinc. As shown in FIG. 3C, the left hinge portion 103*a* has an integral structure including a blade portion 103*ab* and a cylindrical portion 103*ac*, and the right hinge portion 103*b* has an integral structure including a blade portion 103*bb* and a cylindrical portion 103*bc*. The blade portion 103*ab* has a screw hole 103*aa* for receiving the screw 107, in which a bottom end of the feeding element 1 (in case of FIG. 2A, point 1*c*) is electrically connected to the left hinge portion 103*a* by the screw 107 made of conductor. Similarly, the blade portion 103*bb* has a screw hole 103*ba* for receiving the screw 108, in which a bottom end of the feeding element 2 (in case of FIG. 2A, point 2*c*) is electrically connected to the right hinge portion 103*b* by the screw 108 made of conductor. As shown in FIG. 3D, a cylindrical inner conductor 103*ad* made of conductive material is inserted into the cylindrical portion 103*ac* of the left hinge portion 103*a* in a rotatable manner. At least one of an inner side of the cylindrical portion 103*ac* and an outer side of the inner conductor 103*ad* is coated by dielectric, and thus, when the inner conductor 103*ad* is inserted into the cylindrical portion 103*ac*, a certain capacitance is formed between the inner side surface of the cylindrical portion 103*ac* and the outer side surface of the inner conductor 103*ad*. Similarly, a cylindrical inner conductor 103*bd* made of conductive material is inserted into the cylindrical portion 103*bc* of the right hinge portion 103*b* in a rotatable manner, and a certain capacitance is formed between an inner side surface of the cylindrical portion 103*bc* and an outer side surface of the inner conductor 103*bd*. The inner conductors 103*ad* and 103*bd* are connected to the radio signal processor circuit 10 through feed lines F1 and F2, respectively, each being a coaxial cable or the like. In the present exemplary implementation, a point at which the feed line F1 is connected to the inner conductor 103*ad* is regarded as the feed point P1, and a point at which the feed line F2 is connected to the inner conductor 103*bd* is regarded as the feed point P2. In the present exemplary implementation, the feeding elements 1 and 2 can be capacitively fed in this manner.

Figure 4:
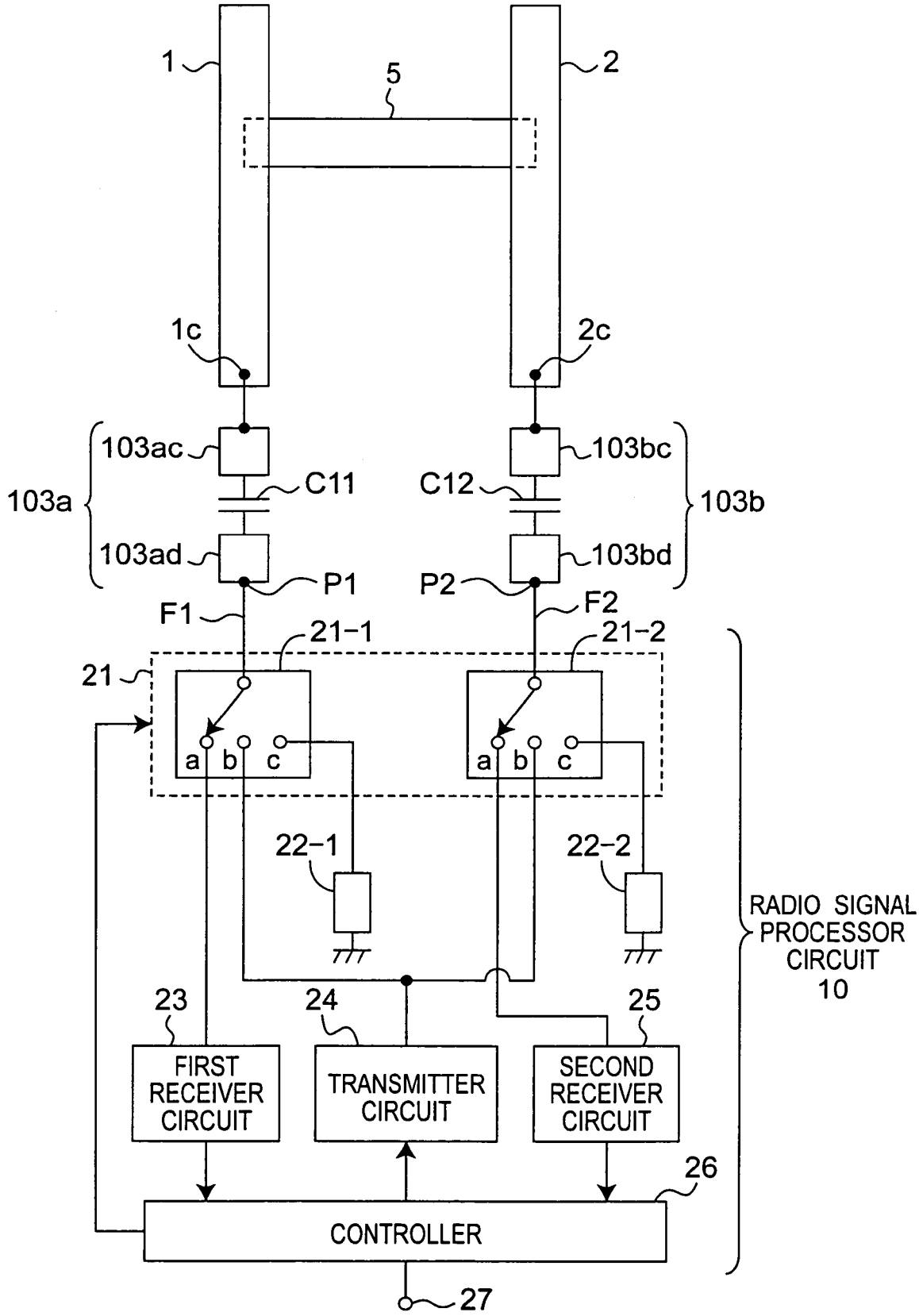
FIG. 4 is a block diagram showing a detailed configuration of a circuit of the array antenna apparatus in the exemplary implementation of FIGS. 3A, 3B, 3C, and 3D.

FIG. 4 is a block diagram showing a detailed configuration of a circuit of the array antenna apparatus in the exemplary implementation of FIGS. 3A, 3B, 3C, and 3D. The point 1*c* at the bottom end of the feeding element 1 is connected to a switch 21-1 of a switch circuit 21 in the radio signal processor circuit 10 through the left hinge portion 103*a* and the feed line F1, and the point 2*c* at the bottom end of the feeding element 2 is connected to a switch 21-2 of the switch circuit 11 through the right hinge portion 103*b* and the feed line F2. As described above with reference to FIGS. 3, 3B, 3C, and 3D, for capacitive feeding, a capacitance is formed between the cylindrical portion 103*ac* and the inner conductor 103*ad* of the left hinge portion 103*a*, and a capacitance is formed between the cylindrical portion 103*bc* and the inner conductor 103*bd* of the right hinge portion 103*b*. In FIG. 4, these capacitances are represented by C11 and C12, respectively. As will be described in detail later, the switch circuit 21 connects the feeding element 1 to one of a first receiver circuit 23, a transmitter circuit 24 and a load 22-1, and connects the feeding element 2 to one of a second receiver circuit 25, the transmitter circuit 24 and a load 22-2, according to control of a controller 26. When the array antenna apparatus is operating in the higher frequency band, both of the first receiver circuit 23 and the second receiver circuit 25 perform demodulation processes on received signals of a MIMO communication scheme in the higher frequency band, and output demodulated signals to the controller 26. Furthermore, when the array antenna apparatus is operating in the lower frequency band, at least one of the first receiver circuit 23 and the second receiver circuit 25 (e.g., the first receiver circuit 23) performs a demodulation process on a received signal in the lower frequency band, and outputs a demodulated signal to the controller 26. The transmitter circuit 24 performs a modulation process on a signal inputted from the controller 26 in both cases that the array antenna apparatus is operating in the higher frequency band and that the array antenna apparatus is operating in the lower frequency band. The loads 22-1 and 22-2 are grounded by being connected to the ground conductor 11 or the like. Each of the loads 22-1, 22-2 is configured as any of an open, a short-circuit, a capacitance and an inductance, for impedance matching of the feeding element 1 or 2 in a desired frequency band. The controller 26 is connected, through an input/output terminal 27 of the radio signal processor circuit 10, to the other circuits (not shown) in a wireless communication apparatus, such as a mobile phone, to which an array antenna apparatus of the present preferred embodiment is provided.

The control of the switch circuit 21 by the controller 26 and the operation of the array antenna apparatus are as follows. When the array antenna apparatus is operating for reception in the higher frequency band, the switch 21-1 is turned to the first receiver circuit 23 and the switch 21-2 is turned to the second receiver circuit 25. As described above, when the array antenna apparatus is operating in the higher frequency band, the isolation between the feeding elements 1 and 2 is sufficiently large, and thus the array antenna apparatus can simultaneously receive radio signals of a plurality of channels (in the present preferred embodiment, two channels) according to a MIMO communication scheme, through the feeding elements 1 and 2. When the array antenna apparatus is operating for transmission in the higher frequency band, one of the switches 21-1 and 21-2 is turned to the transmitter circuit 24, and the other is connected to the load 22-1 or 22-2. In this case, a signal modulated by the transmitter circuit 24 is transmitted through either the feeding element 1 or 2. When the array antenna apparatus is operating for reception in the lower frequency band, the switch 21-1 is turned to the first receiver circuit 23 and the switch 21-2 is turned to the load 22-2. In this case, if the second receiver circuit 25 has a demodulation processing function for a received signal in the lower frequency band, the switch 21-2 may be turned to the second receiver circuit 24 and the switch 21-1 may be turned to the load 22-1. As described above, when the array antenna apparatus is operating in the lower frequency band, the resonance as a loop antenna occurs in the feeding elements 1, 2 and the parasitic element 5. In the case of FIG. 4, a loop antenna is formed extending from the feed point P1, through the left hinge portion 103*a*, the feeding element 1, the parasitic element 5, the feeding element 2, and the right hinge portion 103*b*, to the feed point P2 (the feed point P2 is connected to the load 22-2). The first receiver circuit 23 performs a demodulation process on a signal received through this loop antenna. When the array antenna apparatus is operating for transmission in the lower frequency band, one of the switches 21-1 and 21-2 is turned to the transmitter circuit 24, and the other is turned to the load 22-1 or 22-2. In this case, a signal modulated by the transmitter circuit 24 is transmitted through the same loop antenna as that used upon reception.

As described above, the antenna apparatus of the present preferred embodiment can ensure sufficient isolation between the feeding elements 1 and 2, and can operate in multiple frequency bands, while having a simple configuration. Accordingly, it is possible to run in the higher frequency band an application using, e.g., MIMO communication, and run in the lower frequency band an additional application other than the application using MIMO communication.

Next, array antenna apparatuses according to modified preferred embodiments of the first preferred embodiment of the present invention will be described with reference to FIGS. 5A to 15.

Figure 5A:
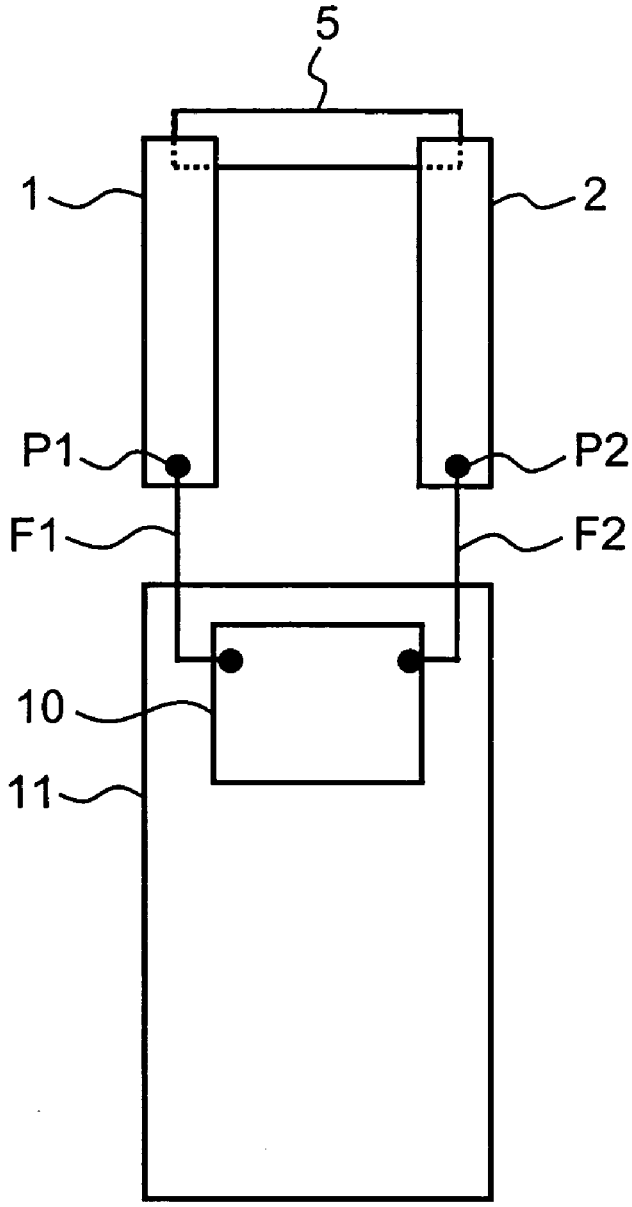
FIG. 5A is a front view showing a schematic configuration of an array antenna apparatus according to a first modified preferred embodiment of the first preferred embodiment of the present invention.
Figure 5B:
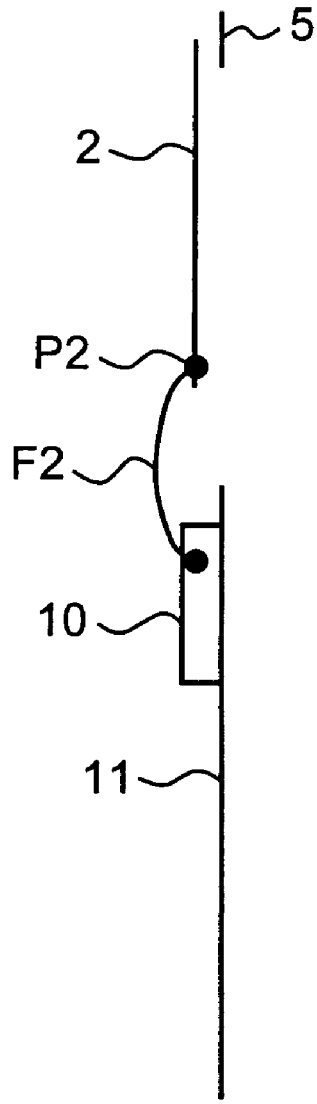
FIG. 5B is a side view of the array antenna apparatus in FIG. 5A.
Figure 7A:
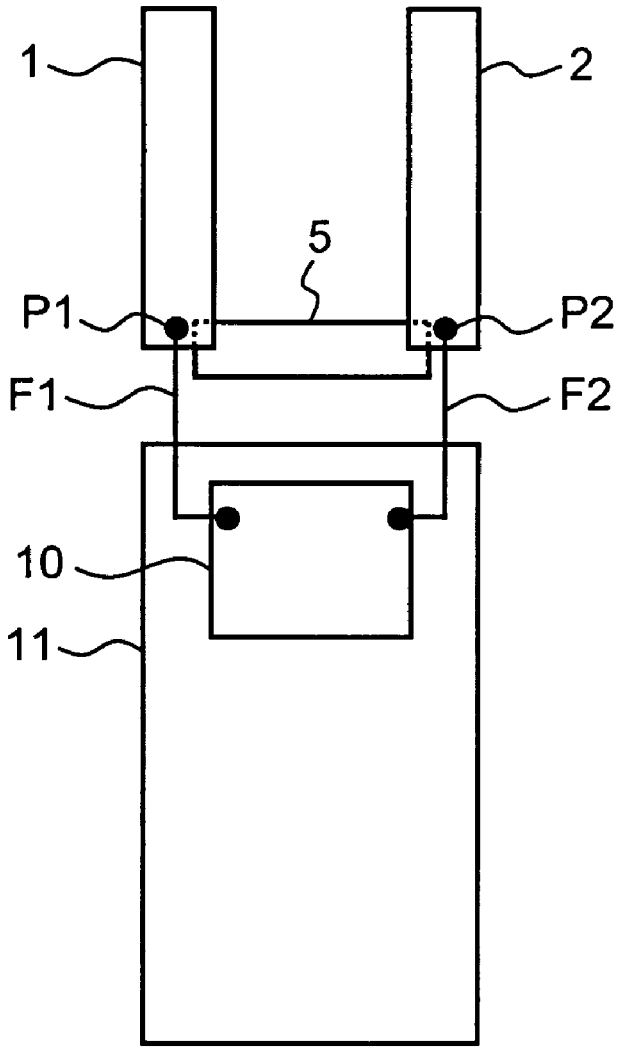
FIG. 7A is a front view showing a schematic configuration of an array antenna apparatus according to a second modified preferred embodiment of the first preferred embodiment of the present invention.
Figure 7B:
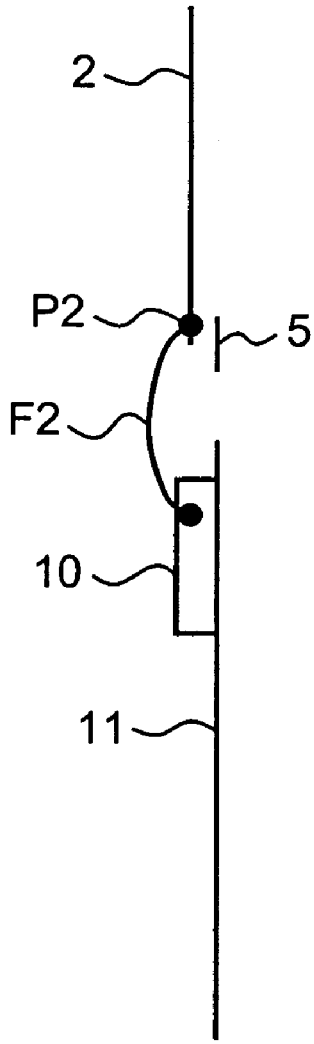
FIG. 7B is a side view of the array antenna apparatus in FIG. 7A.

FIG. 5A is a front view showing a schematic configuration of an array antenna apparatus according to a first modified preferred embodiment of the first preferred embodiment of the present invention, and FIG. 5B is a side view thereof. FIG. 7A is a front view showing a schematic configuration of an array antenna apparatus according to a second modified preferred embodiment of the first preferred embodiment of the present invention, and FIG. 7B is a side view thereof. Although in the configuration in FIGS. 1A and 1B one end of the parasitic element 5 is capacitively coupled to the substantially central portion in the longitudinal direction of the feeding element 1, and the other end of the parasitic element 5 is capacitively coupled to the substantially central portion in the longitudinal direction of the feeding element 2, the feeding elements 1, 2 and the parasitic element 5 may be capacitively coupled to each other at different positions. In the modified preferred embodiment of FIGS. 5A and 5B, one end of a parasitic element 5 is capacitively coupled to an end of a feeding element 1 (in case of FIG. 5A, top end) opposite to another end where a feed point P1 is provided, and the other end of the parasitic element 5 is capacitively coupled to an end of a feeding element 2 (in case of FIG. 5A, top end) opposite to another end where a feed point P2 is provided. On the other hand, in the modified preferred embodiment of FIGS. 7A and 7B, one end of a parasitic element 5 is capacitively coupled to a position close to a feed point P1 on a feeding element 1 (in case of FIG. 7A, bottom end), and the other end of the parasitic element 5 is capacitively coupled to a position close to a feed point P2 on a feeding element 2 (in case of FIG. 7A, bottom end).

Figure 6:
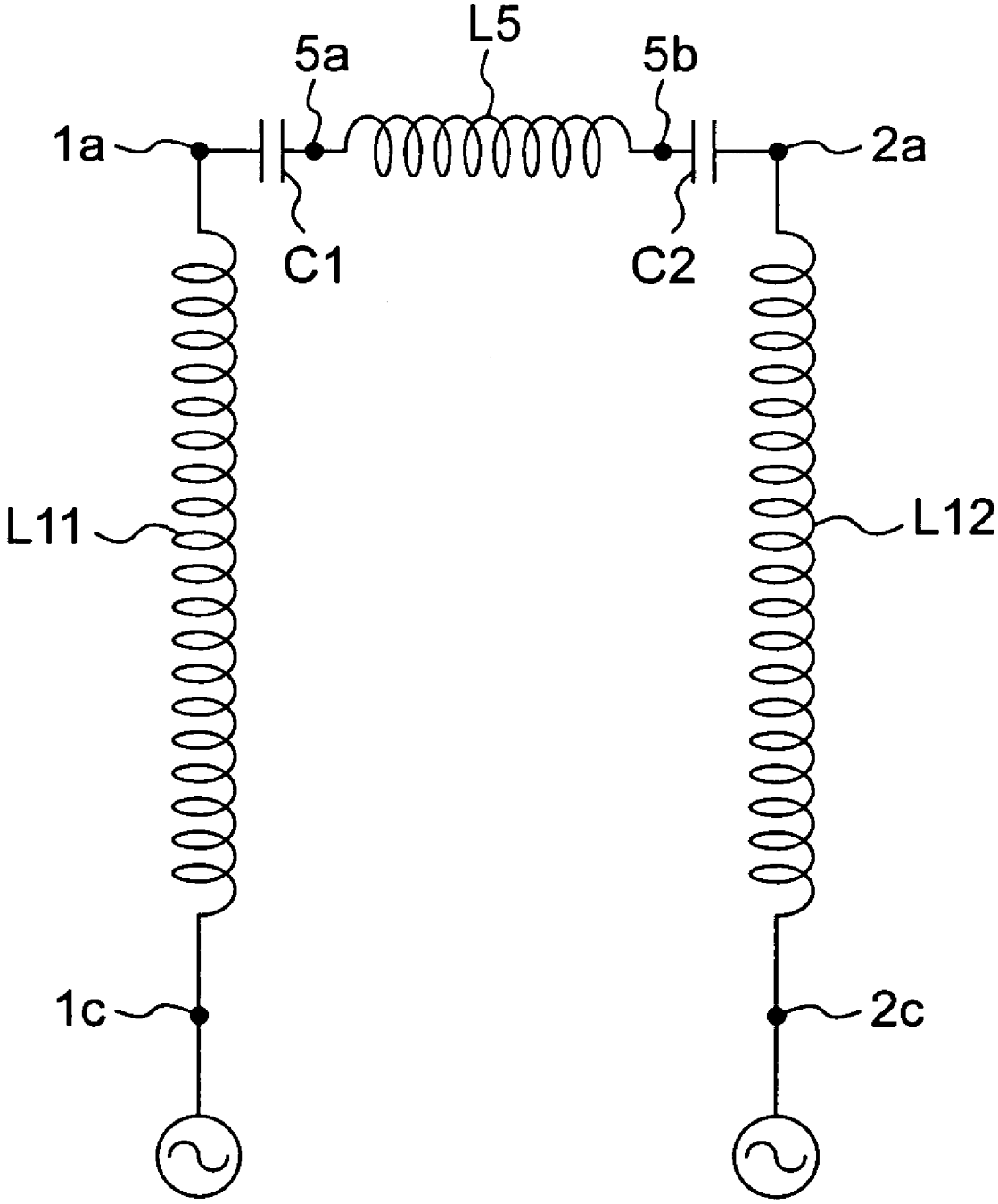
FIG. 6 is a diagram showing an equivalent circuit of feeding elements 1, 2 and a parasitic element 5 in FIGS. 5A and 5B.

FIG. 6 is a diagram showing an equivalent circuit of the feeding elements 1, 2 and the parasitic element 5 in FIGS. 5A and 5B. A capacitive coupling between the feeding element 1 and the parasitic element 5 is represented by a capacitance C1 between points 1*a* and 5*a*, and similarly, a capacitive coupling between the feeding element 2 and the parasitic element 5 is represented by a capacitance C2 between points 2*a* and 5*b*. An inductance of the feeding element 1 is represented by an inductance L21 between the points 1*a* and 1*c*, and an inductance of the feeding element 2 is represented by an inductance L12 between the points 2*a* and 2*c*. The array antenna apparatus of the present modified preferred embodiment is configured such that when the array antenna apparatus operates in a higher frequency band, an input impedance seen from the point 1*a* on the feeding element 1 to the parasitic element 5 and the feeding element 2, and an input impedance seen from the point 2*a* on the feeding element 2 to the parasitic element 5 and the feeding element 1 become certain high values (substantially infinite values). Hence, in the higher frequency band, it is possible to operate the feeding elements 1 and 2 independent of each other by independently exciting the feeding elements 1 and 2 through the respective feed points P1 and P2. On the other hand, the array antenna apparatus of the present modified preferred embodiment is configured such that when the array antenna apparatus operates in a lower frequency band, an input impedance seen from the point 1*a* on the feeding element 1 to the parasitic element 5 and the feeding element 2, and an input impedance seen from the point 2*a* on the feeding element 2 to the parasitic element 5 and the feeding element 1 become smaller values than the aforementioned high values. Hence, in the lower frequency band, the feeding element 1, the parasitic element 5 and the feeding element 2 can operate resonantly as one loop antenna by exciting them through one of the feed points P1 and P2; the loop antenna extends from the point 1*c* of the feeding element 1, through the point 1*a* of the feeding element 1, the capacitance C1, the points 5*a* and 5*b* of the parasitic element 5, the capacitance C2, and the point 2*a* of the feeding element 2, to the point 2*c* of the feeding element 2 (or vice versa).

Figure 8:
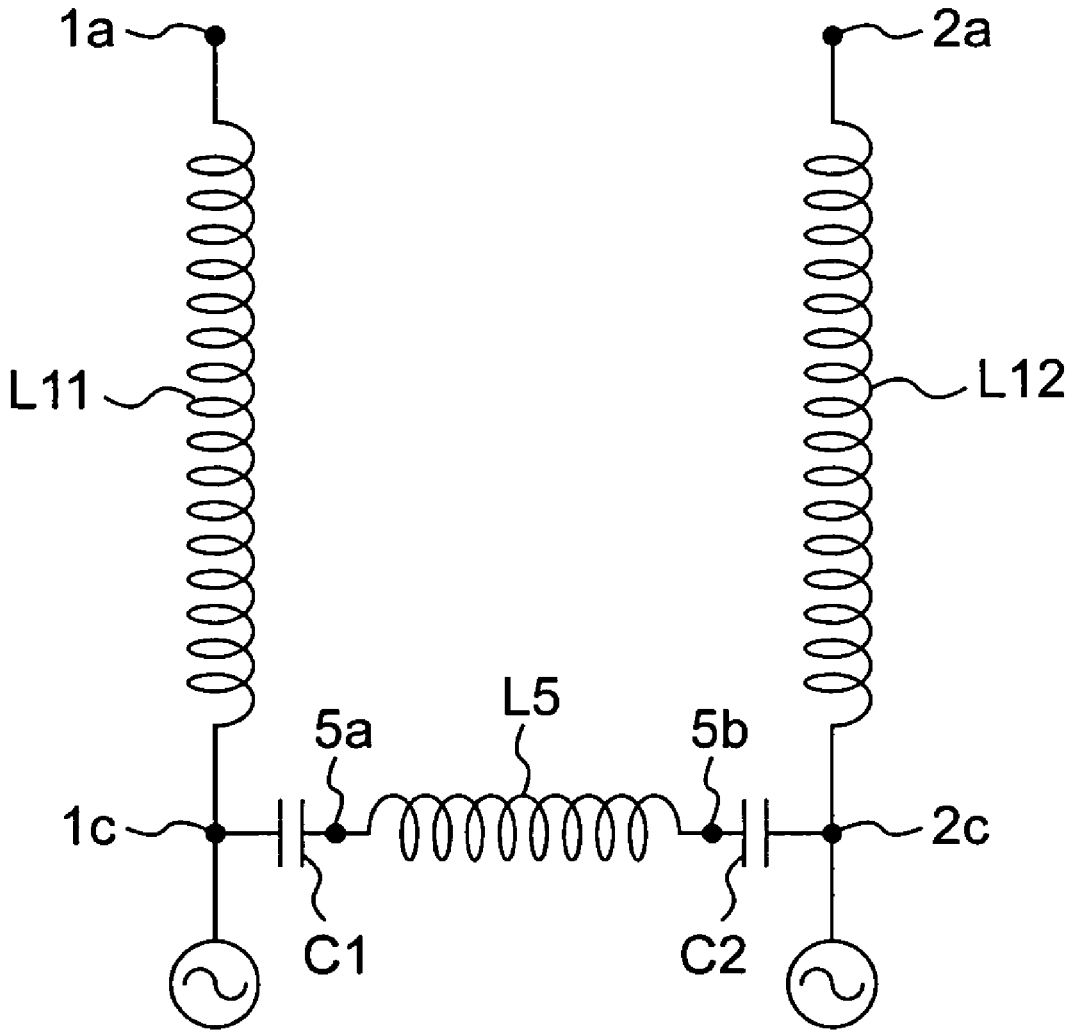
FIG. 8 is a diagram showing an equivalent circuit of feeding elements 1, 2 and a parasitic element 5 in FIGS. 7A and 7B.

FIG. 8 is a diagram showing an equivalent circuit of the feeding elements 1, 2 and the parasitic element 5 in FIGS. 7A and 7B. A capacitive coupling between the feeding element 1 and the parasitic element 5 is represented by a capacitance C1 between points 1*c* and 5*a*, and similarly, a capacitive coupling between the feeding element 2 and the parasitic element 5 is represented by a capacitance C2 between points 2*c* and 5*b*. The array antenna apparatus of the present modified preferred embodiment is configured such that when the array antenna apparatus operates in a higher frequency band, an input impedance seen from the point 1*c* on the feeding element 1 to the parasitic element 5, and an input impedance seen from the point 2*c* on the feeding element 2 to the parasitic element 5 becomes certain high values (substantially infinite values). Hence, in the higher frequency band, it is possible to operate the feeding elements 1 and 2 independent of each other by independently exciting the feeding elements 1 and 2 through the respective feed points P1 and P2. On the other hand, the array antenna apparatus of the present modified preferred embodiment is configured such that when the array antenna apparatus operates in a lower frequency band, an input impedance seen from the point 1*c* on the feeding element 1 to the parasitic element 5, and an input impedance seen from the point 2*c* on the feeding element 2 to the parasitic element 5 become smaller values than the aforementioned high values. Hence, in the lower frequency band, the feeding element 1, the parasitic element 5, and the feeding element 2 can operate resonantly as one loop antenna by exciting them through one of the feed points P1 and P2; the loop antenna extends from the point 1*c* of the feeding element 1, through the capacitance C1, the points 5*a* and 5*b* of the parasitic element 5, and the capacitance C2, to the point 2*c* of the feeding element 2 (or vice versa).

According to the configurations of the first and second modified preferred embodiments of the first preferred embodiment, when the array antenna apparatus operates as a loop antenna in the lower frequency band, it is possible to change an electrical length of the loop as compared with the configuration in FIGS. 1A and 1B. Due to the change in the electrical length, the resonant frequency of the loop antenna varies, and thus, it is possible to adjust an operating frequency of the array antenna apparatus in the lower frequency band. According to the configuration of the first modified preferred embodiment, since the electrical length of the loop is longer than that in the case of FIGS. 1A and 1B, the resonant frequency of the loop antenna and an operating frequency of the array antenna apparatus in the lower frequency band are decreased. According to the configuration of the second modified preferred embodiment, since the electrical length of the loop is shorter than that in the case of FIGS. 1A and 1B, the resonant frequency of the loop antenna and an operating frequency of the array antenna apparatus in the lower frequency band are increased.

Figure 9A:
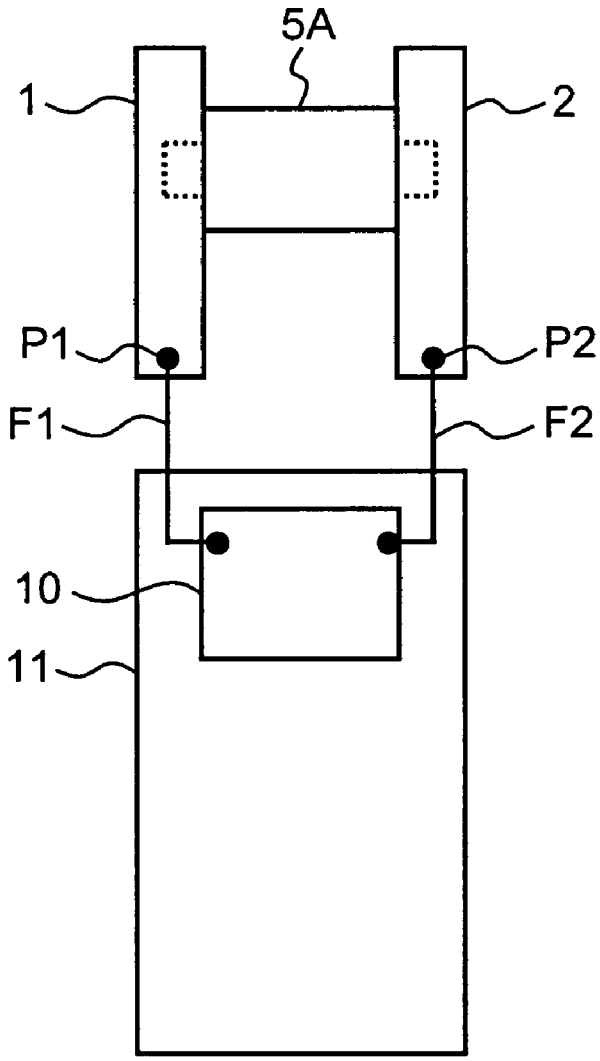
FIG. 9A is a front view showing a schematic configuration of an array antenna apparatus according to a third modified preferred embodiment of the first preferred embodiment of the present invention.
Figure 9B:
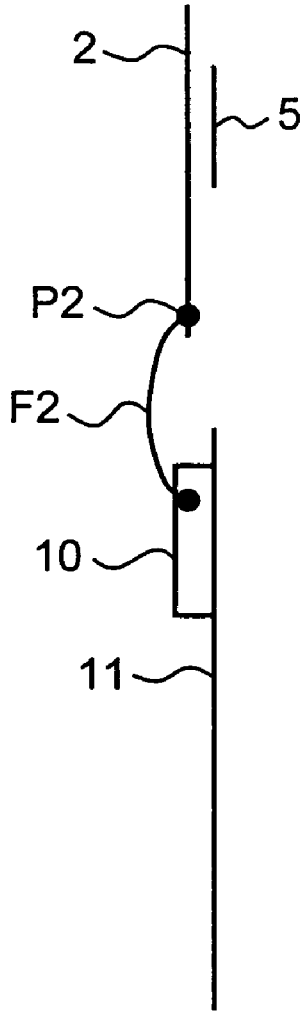
FIG. 9B is a side view of the array antenna apparatus in FIG. 9A.
Figure 10A:
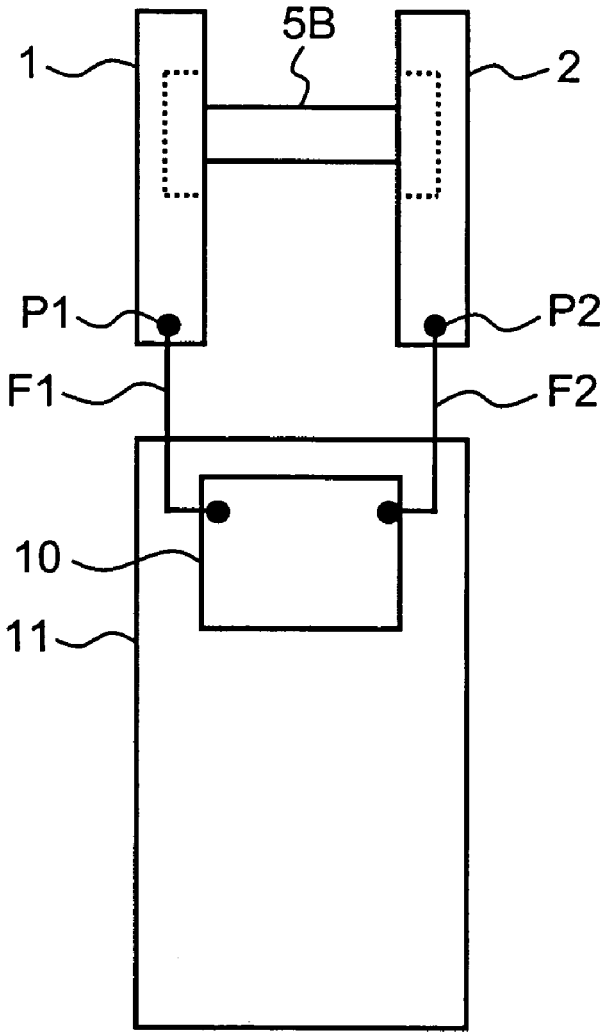
FIG. 10A is a front view showing a schematic configuration of an array antenna apparatus according to a fourth modified preferred embodiment of the first preferred embodiment of the present invention.
Figure 10B:
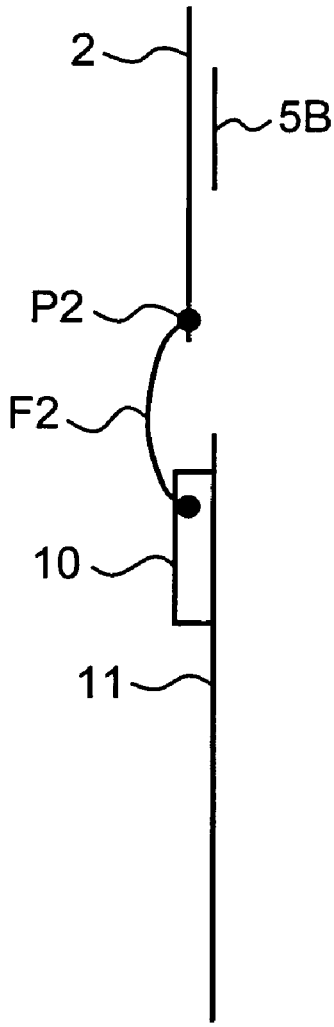
FIG. 10B is a side view of the array antenna apparatus in FIG. 10A.

FIG. 9A is a front view showing a schematic configuration of an array antenna apparatus according to a third modified preferred embodiment of the first preferred embodiment of the present invention, and FIG. 9B is a side view thereof. FIG. 10A is a front view showing a schematic configuration of an array antenna apparatus according to a fourth modified preferred embodiment of the first preferred embodiment of the present invention, and FIG. 10B is a side view thereof. In order to change the capacitances of a capacitive couplings between the feeding elements 1, 2 and the parasitic element 5, and/or in order to change the inductances of the feeding elements 1, 2 and the parasitic element 5, an array antenna apparatus may include feeding elements 1, 2 and a parasitic element 5 whose shapes are different from the conductive strips as shown in FIGS. 1A and 1B. The array antenna apparatus in FIGS. 9A and 9B includes a parasitic element 5A made of a conductive strip having a width wider than that of the parasitic element 5 in FIGS. 1A and 1B, and accordingly, it is possible to employ an inductance of a different value than that in the case of FIGS. 1A and 1B, in order to eliminate mutual coupling between feeding elements 1 and 2. The array antenna apparatus in FIGS. 10A and 10B includes a parasitic element 5B whose capacitive coupling portions to feeding elements 1 and 2 have areas increased as compared with the case of FIGS. 1A and 1B, and accordingly, it is possible to increase the capacitances between the feeding elements 1, 2 and the parasitic element 5B more than the case of FIGS. 1A and 1B. Alternatively, in contrast to the modified preferred embodiment shown in FIGS. 10A and 10B, it is also possible to reduce the areas of capacitive coupling portions to the feeding elements 1 and 2 as compared to the case of FIGS. 1A and 1B, and accordingly, to reduce the capacitances of the capacitive coupling portions between the feeding elements 1, 2 and the parasitic element 5B as compared to the case of FIGS. 1A and 1B. Further, an array antenna apparatus that is a combination of the third and fourth modified preferred embodiments may be configured. According to the configurations in FIGS. 9A, 9B, 10A, and 10B, it is possible to control the isolation between the feeding elements 1 and 2 by changing the capacitances of capacitive coupling portions between the feeding elements 1, 2 and a parasitic element and/or changing the inductance of the parasitic element.

Figure 11A:
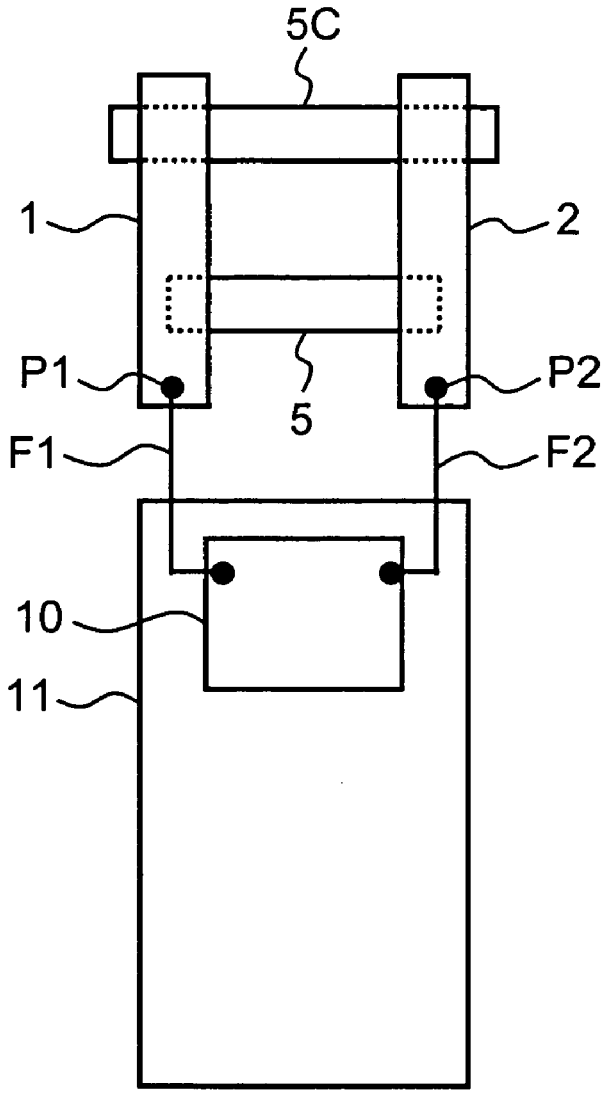
FIG. 11A is a front view showing a schematic configuration of an array antenna apparatus according to a fifth modified preferred embodiment of the first preferred embodiment of the present invention.
Figure 11B:
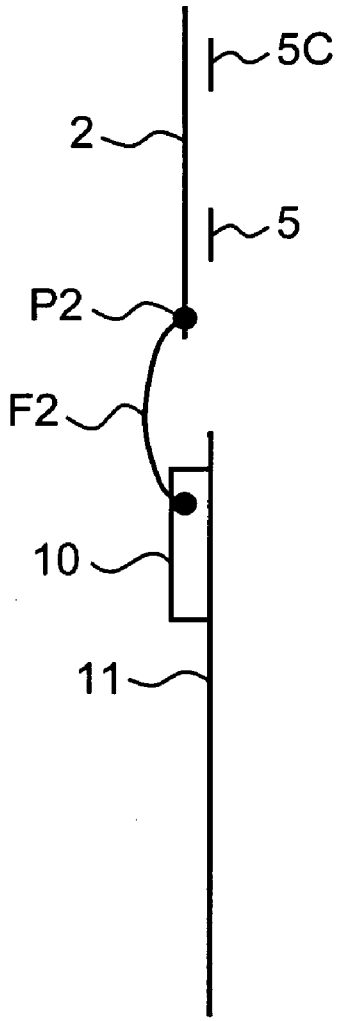
FIG. 11B is a side view of the array antenna apparatus in FIG. 11A.

FIG. 11A is a front view showing a schematic configuration of an array antenna apparatus according to a fifth modified preferred embodiment of the first preferred embodiment of the present invention, and FIG. 11B is a side view thereof. The array antenna apparatus may further include a parasitic element other than the parasitic element 5, in order to eliminate the mutual coupling between the feeding elements 1 and 2. The array antenna apparatus in FIGS. 11A and 11B further includes, in addition to the configuration of FIGS. 1A and 1B, a parasitic element 5C made of a conductive strip, which is provided in a plane spaced apart by a certain distance from the plane where the feeding elements 1 and 2 are provided (e.g., in a plane that includes a parasitic element 5), so as to be close to the feeding elements 1 and 2, respectively, and which is remote from the feed points P1 and P2 farther than the position of the parasitic element 5. In a similar manner to the parasitic element 5, the parasitic element 5C is positioned close to the respective feeding elements 1 and 2 so as to capacitively couple to the feeding elements 1 and 2. The parasitic element 5C has a certain inductance similarly to the parasitic element 5, and if necessary, in order to increase the inductance, the parasitic element 5C may include a portion protruding to the left of the feeding element 1 and a portion protruding to the right of the feeding element 2, as well as a portion extending between the feeding elements 1 and 2.

Figure 12:
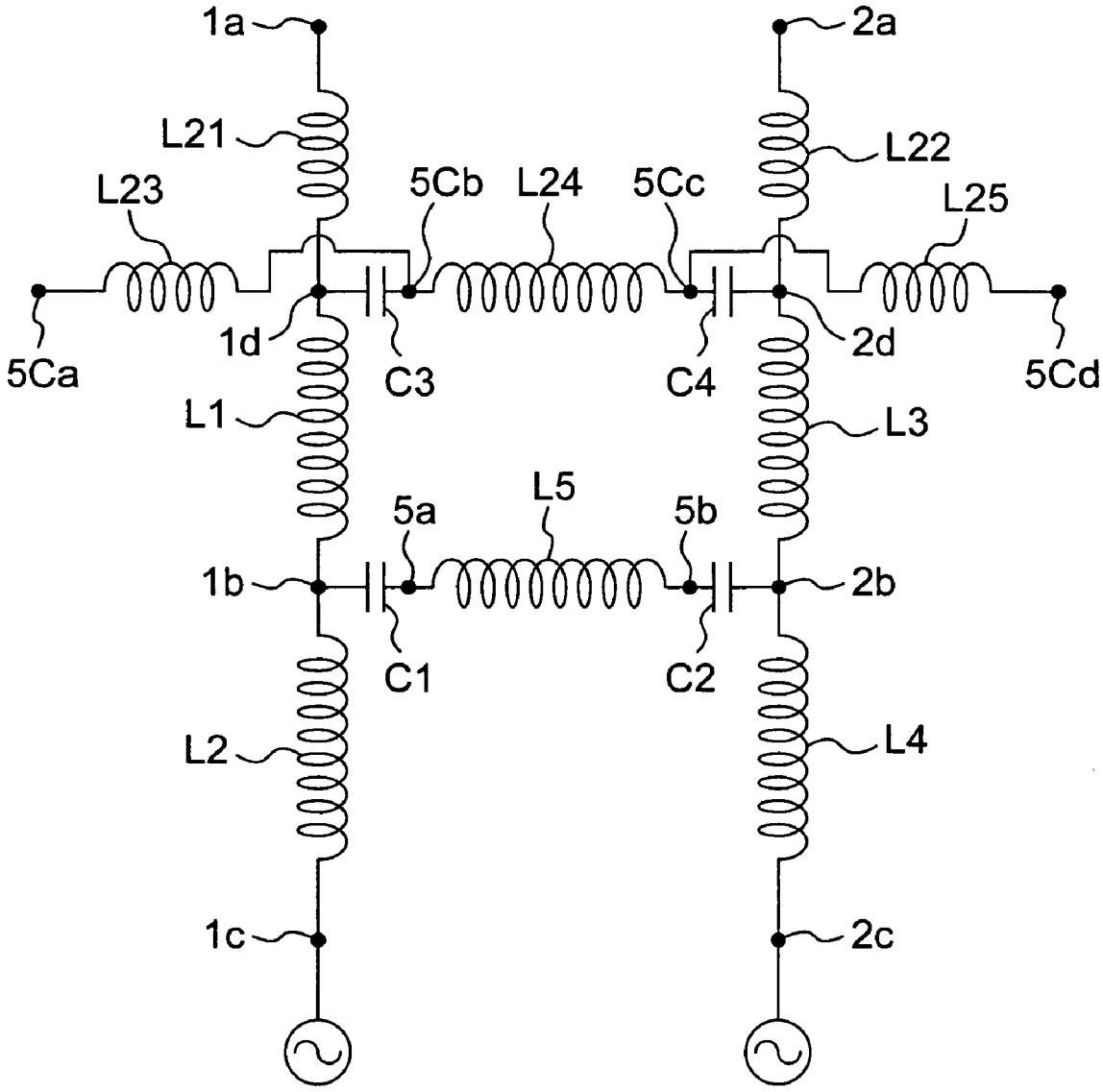
FIG. 12 is a diagram showing an equivalent circuit of feeding elements 1, 2 and parasitic elements 5 and 5C in FIGS. 11A and 11B.

FIG. 12 is a diagram showing an equivalent circuit of the feeding elements 1, 2 and the parasitic elements 5 and 5C in FIGS. 11A and 11B. In the feeding element 1 of FIG. 11A, "1*d*" denotes a point which is positioned upper than the point 1*b* close to the parasitic element 5 and which is close to the parasitic element 5C. Similarly, in the feeding element 2 of FIGS. 11A and 11B, "2*d*" denotes which is positioned upper than the point 2*b* close to the parasitic element 5 and which is close to the parasitic element 5C. In the parasitic element 5C of FIGS. 11A and 11B, "5Ca", "5Cb", "5Cc" and "5Cd" denote a left end point (point protruding to the left of the feeding element 1), a point close to the feeding element 1, a point close to the feeding element 2, and a right end point (point protruding to the right of the feeding element 2), respectively. As described above, the feeding element 1 and the parasitic element 5C are positioned close to each other so as to capacitively couple to each other, which is represented by a capacitance C3 between the points 1*d* and 5Cb. Similarly, the feeding element 2 and the parasitic element 5C are positioned close to each other so as to capacitively couple to each other, which is represented by a capacitance C4 between the points 2*d* and 5Cc. Inductances of the feeding element 1 are represented by an inductance L21 between the points 1*a* and 1*d*, an inductance L1 between the points 1*d* and 1*b*, and an inductance L2 between the points 1*b* and 1*c*. Inductances of the feeding element 2 are represented by an inductance L22 between the points 2*a* and 2*d*, an inductance L3 between the points 2*d* and 2*b*, and an inductance L4 between the point 2*b* and 2*c*. Inductances of the parasitic element 5C are represented by an inductance L23 between the points 5Ca and 5Cb, an inductance L24 between the points 5Cb and 5Cc, and an inductance 25 between the points 5Dd and 5Cd. An inductance of the parasitic element 5 is the same as that for the case of FIG. 2.

In the fifth modified preferred embodiment of the first preferred embodiment, for the purpose of eliminating mutual coupling between the feeding elements 1 and 2, the parasitic element 5 having the inductance L5 is capacitively coupled to the feeding elements 1 and 2 through the capacitances C1 and C2, respectively, and the parasitic element 5C having the inductances L23, L24 and L25 are capacitively coupled to the feeding elements 1 and 2 through the capacitances C3 and C4, respectively. In the case that there is a strong capacitive mutual coupling between the feeding elements 1 and 2, if a parasitic element 5C having a long element length and therefore large inductances L23 and L25 is provided, it is expected to help to eliminate the mutual coupling. As a result, the mutual coupling between the feeding elements 1 and 2 is eliminated, and accordingly, isolation between the feeding elements 1 and 2 is improved to be sufficiently large for the feeding elements 1 and 2 to operate independently. Thus, when the array antenna apparatus is operating in a higher frequency band, an imaginary part of an impedance Zm between the feeding elements 1, 2 and an imaginary part of its conjugate impedance Zm* (the latter is provided by the parasitic elements 5 and 5C) are cancelled by each other, and accordingly, the mutual coupling between the feeding elements 1 and 2 is eliminated. On the other hand, when the array antenna apparatus is operating in a lower frequency band, since the impedance Zm and the conjugate impedance Zm* vary, the imaginary parts thereof are not cancelled and the mutual coupling is maintained, and thus, a resonance occurs in a whole set of elements including the feeding elements 1, 2 and the parasitic element 5 capacitively coupled to each other. In this case, a loop antenna is formed extending from the point 1*c* of the feeding element 1, through the point 1*b* of the feeding element 1, the capacitance C1, the points 5*a* and 5*b* of the parasitic element 5, the capacitance C2, and the point 2*b* of the feeding element 2, to the point 2*c* of the feeding element 2 (or vice versa). Since an electrical length of the loop antenna is longer than electrical lengths of the feeding elements 1 and 2, the feeding elements 1, 2 and the loop antenna can operate resonantly in the lower frequency band. Note that the configuration is not limited to the one including two parasitic elements 5 and 5C, and a configuration including three or more parasitic elements may be adopted.

Figure 13A:
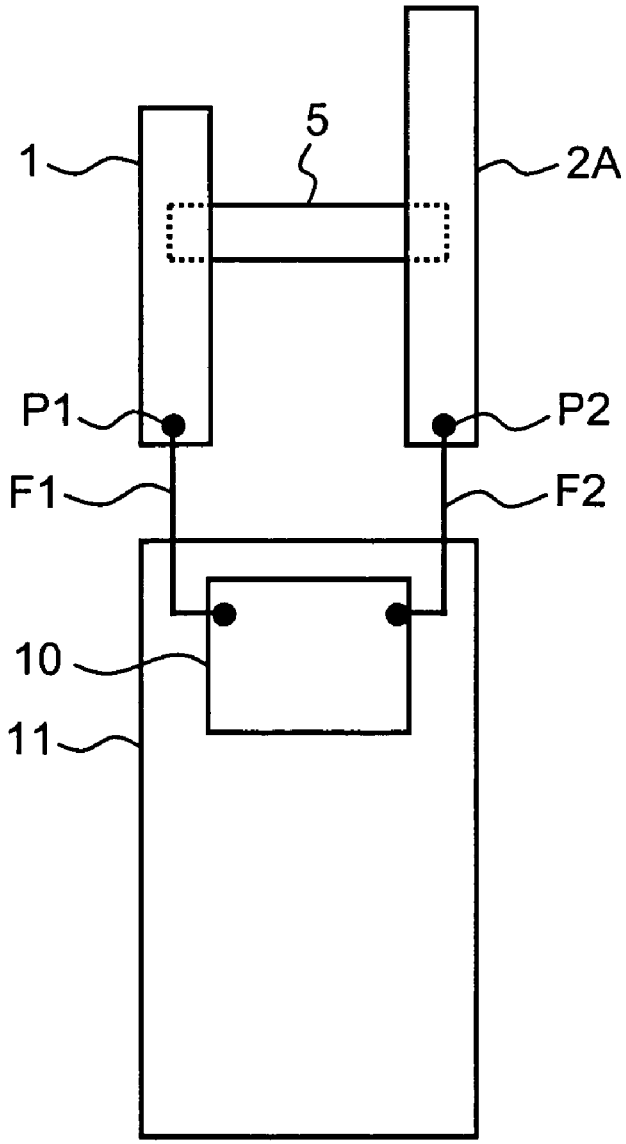
FIG. 13A is a front view showing a schematic configuration of an array antenna apparatus according to a sixth modified preferred embodiment of the first preferred embodiment of the present invention.
Figure 13B:
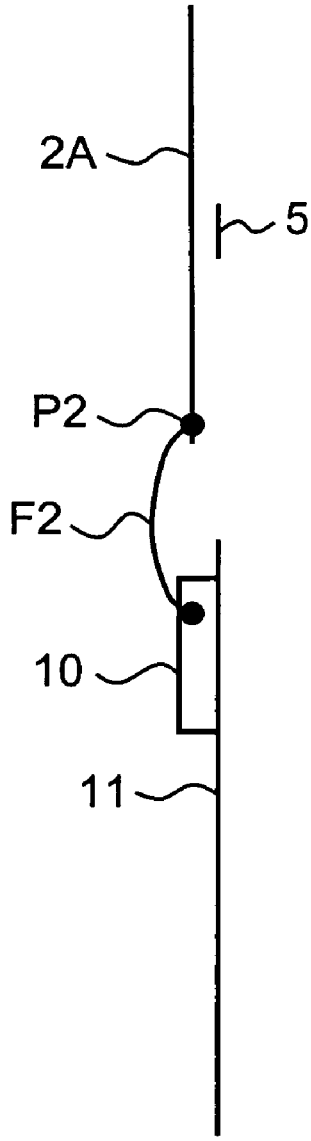
FIG. 13B is a side view of the array antenna apparatus in FIG. 13A.

FIG. 13A is a front view showing a schematic configuration of an array antenna apparatus according to a sixth modified preferred embodiment of the first preferred embodiment of the present invention, and FIG. 13B is a side view thereof. The feeding elements 1 and 2 may be of different sizes and/or forms. The array antenna apparatus of the present modified preferred embodiment is characterized in that the array antenna apparatus includes a feeding element 2A having a longer element length, instead of the feeding element 2 in FIGS. 1A and 1B. As an alternative of the configuration in FIGS. 1A and 1B, the array antenna apparatus may include a feeding element having a shorter element length. For example, in an antenna element positioned so as to be touchable by a hand of a mobile phone user, its resonant frequency often decreases due to the influence of a human body part such as the hand. Therefore, by reducing the element length of the feeding element 1 or 2, a resonance occurs in the feeding element 1 or 2 at an optimum frequency upon actual use. Furthermore, due to the different lengths of the feeding elements, it is expected that a mutual coupling between the feeding elements 1 and 2 (i.e., a mutual coupling before providing the parasitic element 5) is reduced as small as possible.

Figure 14A:
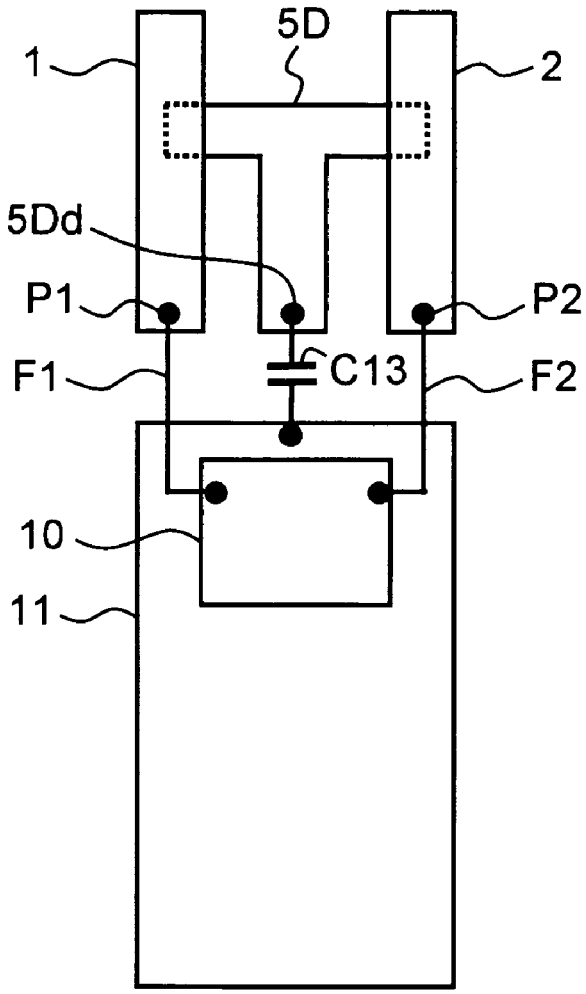
FIG. 14A is a front view showing a schematic configuration of an array antenna apparatus according to a seventh modified preferred embodiment of the first preferred embodiment of the present invention.
Figure 14B:
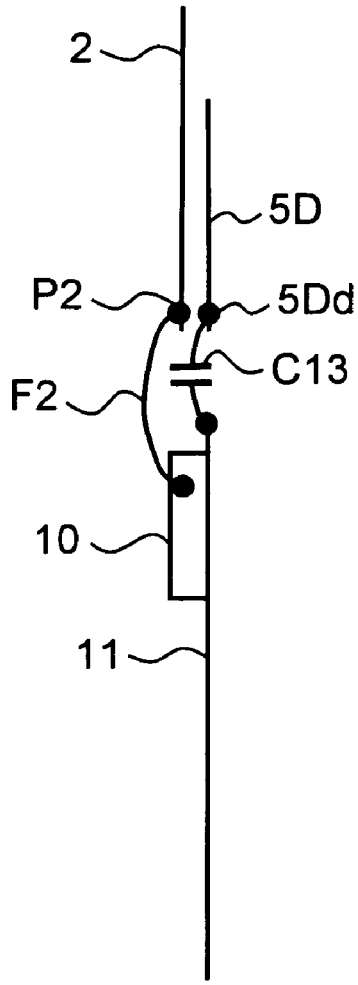
FIG. 14B is a side view of the array antenna apparatus in FIG. 14A.

FIG. 14A is a front view showing a schematic configuration of an array antenna apparatus according to a seventh modified preferred embodiment of the first preferred embodiment of the present invention, and FIG. 14B is a side view thereof. The array antenna apparatus may include a parasitic element of other shape for eliminating mutual coupling between the feeding elements 1 and 2, whose shape is not limited to that of the strip shaped parasitic element 5 as shown in FIGS. 1A and 1B; for example, the array antenna apparatus includes a parasitic element 5D such as in the present modified preferred embodiment, which is made of a T-shaped conductive plate that is grounded. The parasitic element 5D includes a first portion and second portion; the first portion extends substantially in a horizontal direction and is capacitively coupled to feeding elements 1 and 2 at its both ends, in a similar manner to the parasitic element 5 in FIGS. 1A and 1B, and the second portion branches off downward from a substantially central portion in a longitudinal direction of the first portion and extends in parallel to the feeding elements 1 and 2. The parasitic element 5D is connected at a bottom end of the second portion to a ground conductor 11 through a capacitance C13.

Figure 15:
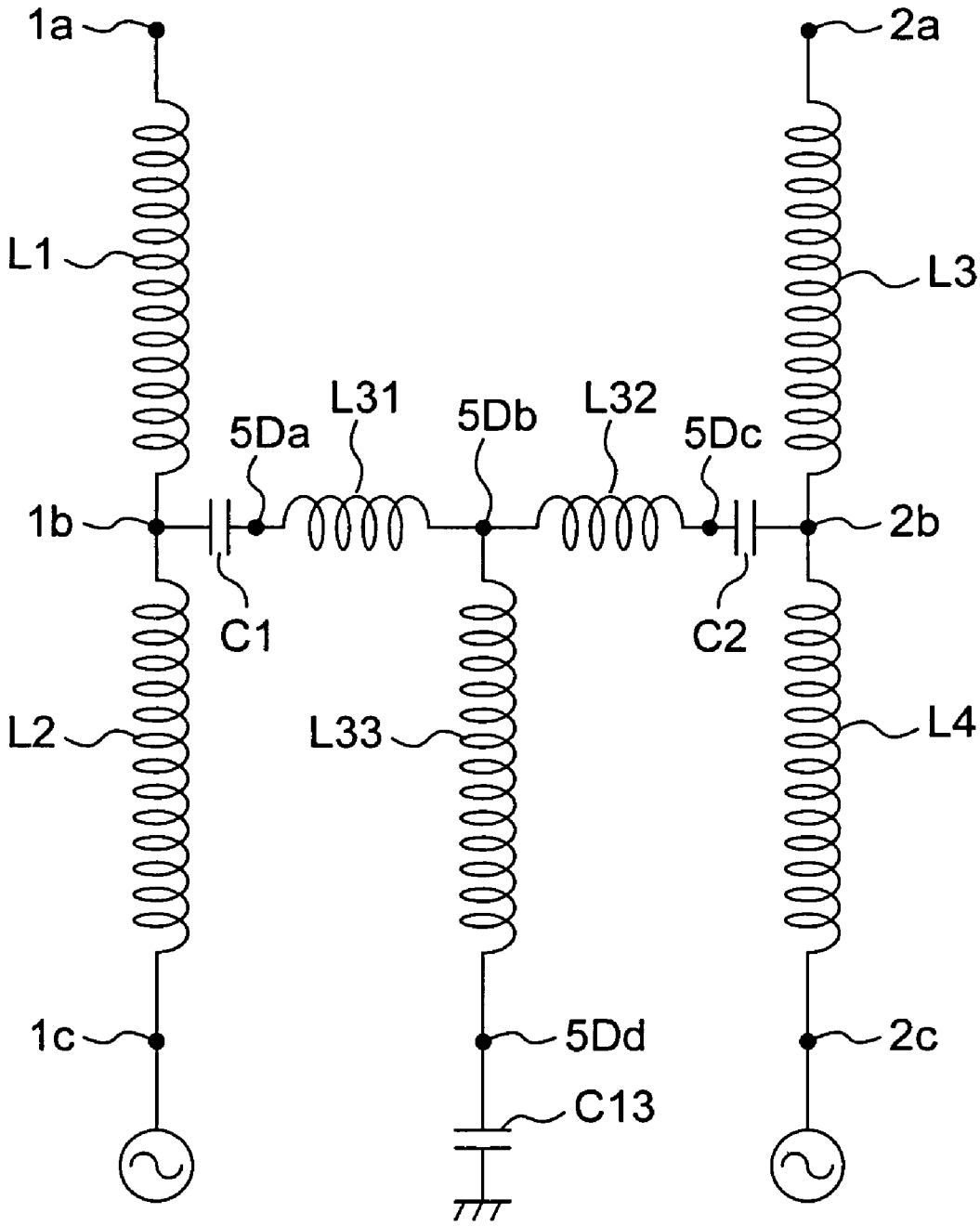
FIG. 15 is a diagram showing an equivalent circuit of feeding elements 1, 2 and a parasitic element 5D in FIGS. 14A and 14B.

FIG. 15 is a diagram showing an equivalent circuit of the feeding elements 1, 2 and the parasitic element 5D in FIGS. 14A and 14B. "5Da" and "5Dc" denotes a left end point (a point close to the feeding element 1) and a right end point (a point close to the feeding element 2) of the first portion (the portion extending in the horizontal direction) of the parasitic element 5D in FIGS. 14A and 14B, respectively; "5Db" denotes a point at the substantially central portion of the first portion; and "5Dd" denotes the bottom end point of the second portion (the portion branching off downward from the point 5Db and extending in parallel to the feeding elements 1 and 2). A capacitive coupling between the feeding element 1 and the parasitic element 5D is represented by a capacitance C1 between the points 1*b* and 5Da, and similarly, a capacitive coupling between the feeding element 2 and the parasitic element 5D is represented by a capacitance C2 between the points 2*b* and 5Dc. Inductances of parasitic element 5D are represented by an inductance L31 between the points 5Da and 5Db, an inductance L32 between the points 5Db and 5Dc, and an inductance L33 between the points 5Db and 5Dd.

In the seventh modified preferred embodiment of the first preferred embodiment, since the T-shaped and grounded parasitic element 5D is provided instead of the parasitic element 5 in FIGS. 1A and 1B, the mutual coupling between the feeding elements 1 and 2 can be eliminated in an improved manner. Specifically, when the array antenna apparatus is operating in a higher frequency band, an imaginary part of impedance Zm between the feeding elements 1, 2 and an imaginary part of its conjugate impedance Zm* are cancelled by each other, and accordingly, the mutual coupling between the feeding elements 1 and 2 is eliminated (isolation is large). On the other hand, when the array antenna apparatus is operating in a lower frequency band, since the impedance Zm and the conjugate impedance Zm* vary, the imaginary parts thereof are not cancelled and the mutual coupling is maintained, and thus, a resonance occurs in a whole set of elements including the feeding elements 1, 2 and the parasitic element 5D capacitively coupled to each other. In this case, a loop antenna is formed extending from the point 1*c* of the feeding element 1, through the point 1*b* of the feeding element 1, the capacitance C1, the points 5Da, 5Db and 5Dc of the parasitic element 5D, the capacitance C2, and the point 2*b* of the feeding element 2, to the point 2*c* of the feeding element 2 (or vice versa). Since an electrical length of the loop antenna is longer than electrical lengths of the feeding elements 1 and 2, the feeding elements 1, 2 and this loop antenna can operate resonantly in the lower frequency band. When the array antenna apparatus is operating in the higher frequency band, the second portion of the parasitic element 5D contributes to the elimination of the mutual coupling between the feeding elements 1 and 2, and on the other hand, when the array antenna apparatus is operating in the lower frequency band, the presence of the second portion can be ignored.

It is also possible to adopt a configuration which is a combination of the configuration of the seventh modified preferred embodiment of the first preferred embodiment and a configuration of other modified preferred embodiments. For example, in an array antenna apparatus including a plurality of parasitic elements as shown in the fifth modified preferred embodiment, at least one of the parasitic elements may be grounded.

Figure 32A:
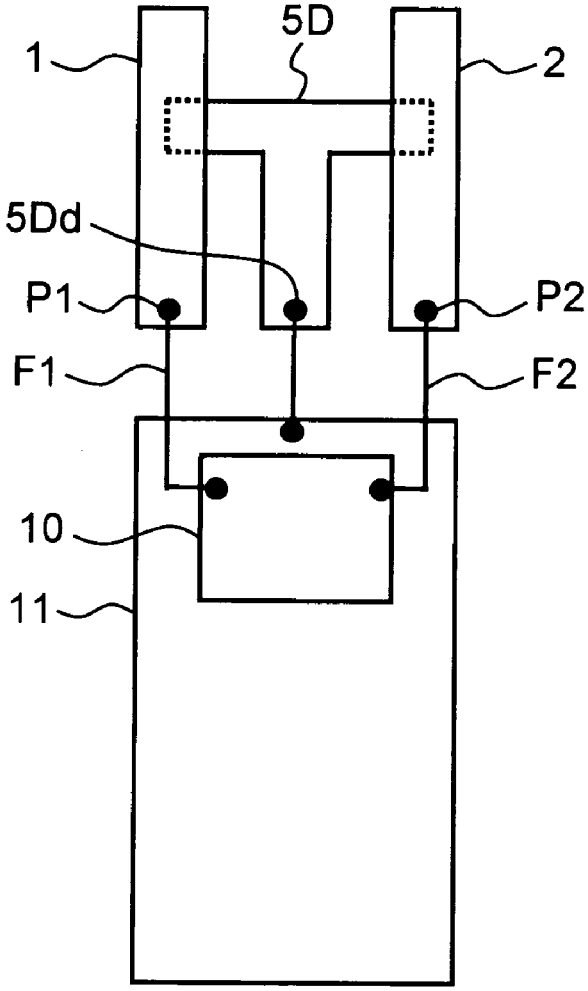
FIG. 32A is a front view showing a schematic configuration of an array antenna apparatus according to an eighth modified preferred embodiment of the first preferred embodiment of the present invention.
Figure 32B:
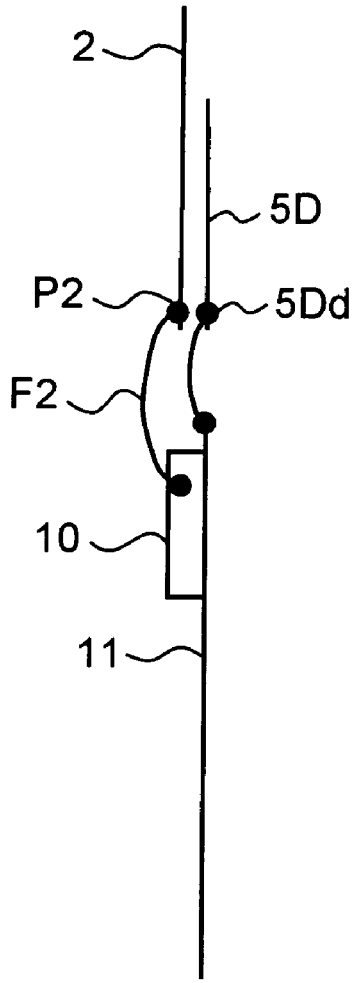
FIG. 32B is a side view of the array antenna apparatus in FIG. 32A.

FIG. 32A is a front view showing a schematic configuration of an array antenna apparatus according to an eighth modified preferred embodiment of the first preferred embodiment of the present invention, and FIG. 32B is a side view thereof. As shown in FIGS. 32A and 32B, the capacitance C13 in FIGS. 14A and 14B may be omitted, and the parasitic element 5D may be directly connected to the ground conductor 11.

Figure 33:
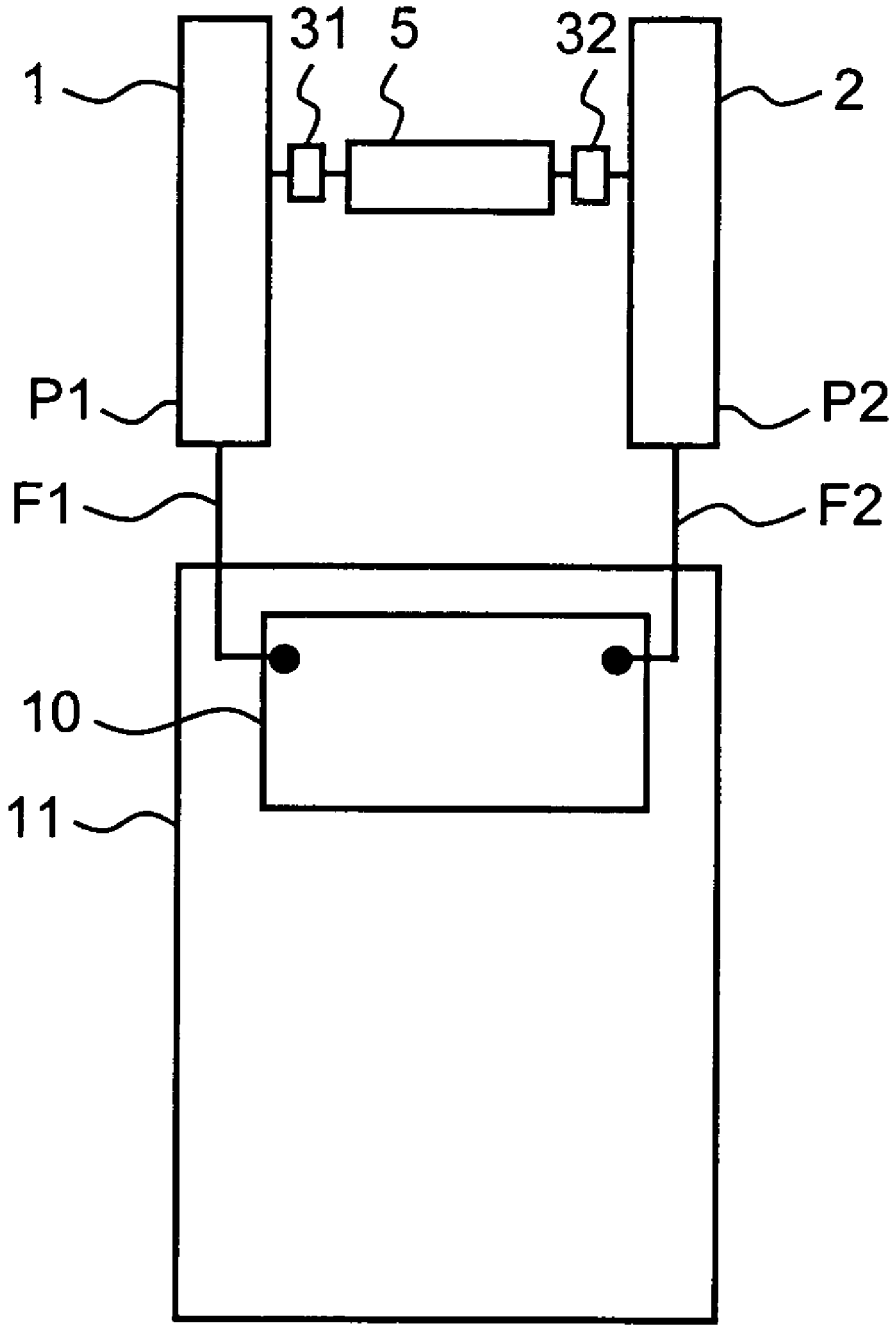
FIG. 33 is a front view showing a schematic configuration of an array antenna apparatus according to a ninth modified preferred embodiment of the first preferred embodiment of the present invention.

FIG. 33 is a front view showing a schematic configuration of an array antenna apparatus according to a ninth modified preferred embodiment of the first preferred embodiment of the present invention. In the present modified preferred embodiment, one end of a parasitic element 5 is connected to a feeding element 1 through an LC resonant circuit 31, and the other end of the parasitic element 5 is connected to a feeding element 2 through an LC resonant circuit 32, instead that the feeding element 1 is capacitively coupled to the parasitic element 5 and the feeding element 2 is capacitively coupled to the parasitic element 5, as in the array antenna apparatus of FIGS. 1A and 1B. The LC resonant circuits 31 and 32 are configured, e.g., as an LC parallel resonant circuits, and becomes a state of anti-resonance in a higher frequency band, and becomes a state of low impedance in a lower frequency band. Thus, in the higher frequency band, the feeding elements 1, 2 and the parasitic element 5 are decoupled from each other by the LC resonant circuits 31 and 32, and it is possible to operate the feeding elements 1 and 2 independent of each other by independently exciting the feeding elements 1 and 2 through the respective feed points P1 and P2. In the lower frequency band, each of the LC resonant circuits 31 and 32 becomes a low impedance and establishes a conduction, and accordingly, a loop antenna is configured by the feeding elements 1, 2 and the parasitic element 5. As described above, the array antenna apparatus of the present preferred embodiment is not limited to the one having the configuration in which the feeding elements 1, 2 and the parasitic element 5 are capacitively coupled to each other, and can also adopt a configuration including other electrical connections such as the connections through the LC resonant circuits 31 and 32.

Second Preferred Embodiment

Figure 16A:
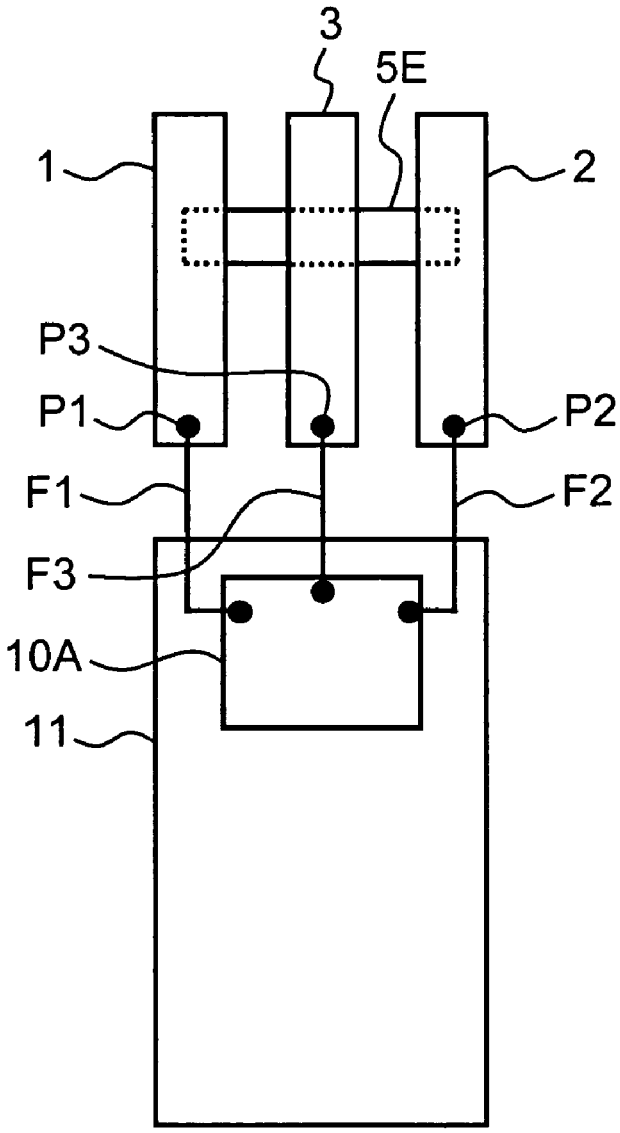
FIG. 16A is a front view showing a schematic configuration of an array antenna apparatus according to a second preferred embodiment of the present invention.
Figure 16B:
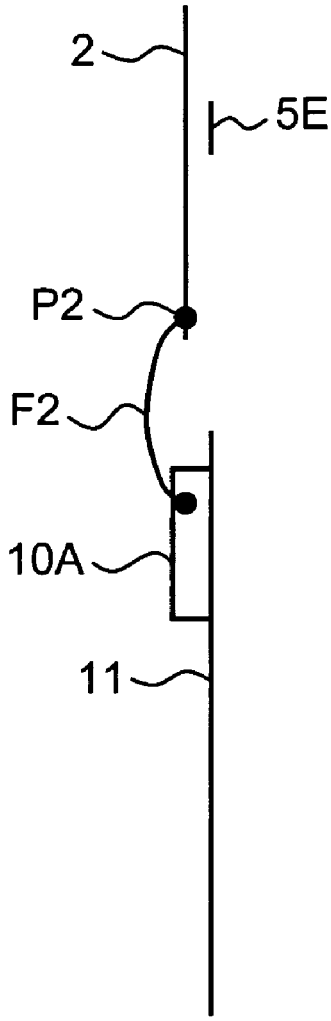
FIG. 16B is a side view of the array antenna apparatus in FIG. 16A.

FIG. 16A is a front view showing a schematic configuration of an array antenna apparatus according to a second preferred embodiment of the present invention, and FIG. 16B is a side view thereof. An array antenna apparatus according to preferred embodiments of the present invention is not limited to the one having the configuration including two feeding elements 1 and 2 as shown in FIGS. 1A and 1B, and the array antenna apparatus may include three or more feeding elements.

In FIGS. 16A and 16B, the array antenna apparatus includes feeding elements 1, 2 and 3 each made of a rectangular conductive plate, and the feeding elements 1, 2 and 3 are provided so as to be in the same plane and spaced apart by a certain distance from each other. Furthermore, a parasitic element 5E made of a rectangular conductive plate is provided in a plane spaced apart by a certain distance from the plane where the feeding elements 1, 2 and 3 are provided, so as to be close to the feeding elements 1, 2 and 3. The parasitic element 5 is positioned close to the respective feeding elements 1, 2 and 3 so as to capacitively couple to each of the feeding elements 1, 2 and 3. Furthermore, a rectangular ground conductor 11 is provided so as to be spaced apart by a certain distance from the feeding elements 1, 2 and 3. Feed points P1, P2 and P3 are provided at ends of the feeding elements 1, 2 and 3, and the feed points P1, P2 and P3 are connected to a radio signal processor circuit 10A through feed lines F1, F2, and F3, respectively. Each of the feed lines F1, F2, and F3 can be made of, e.g., a coaxial cable with an impedance of 50Ω; in this case, inner conductors of the coaxial cables connect the feed points P1, P2 and P3 to the radio signal processor circuit 10A, respectively, and on the other hand, outer conductors of the coaxial cables are respectively connected to the ground conductor 11.

In the present preferred embodiment, the feeding elements 1 and 2 are configured in the same manner as in the case of FIGS. 1A and 1B. The feeding element 3 and the parasitic element 5E are also configured as conductive strips with certain longitudinal element lengths, in a manner similar to that of the feeding elements 1 and 2. The feeding elements 1, 2 and 3 may be configured to have, e.g., an element length of λ/4 with reference to a wavelength λ of a higher frequency band. The feeding element 3 is arranged between the feeding elements 1 and 2 such that the longitudinal direction thereof is parallel to that of the feeding elements 1 and 2. The feed points P3 is provided on the feeding element 3, at an end close to the ground conductor 11 in the longitudinal direction (in case of FIGS. 16A and 16B, bottom end). One end in the longitudinal direction of the parasitic element 5 is capacitively coupled to a substantially central portion in the longitudinal direction of the feeding element 1, the other end in the longitudinal direction of the parasitic element 5 is capacitively coupled to a substantially central portion in the longitudinal direction of the feeding element 2, and a central portion in the longitudinal direction of the parasitic element 5 is capacitively coupled to a substantially central portion in the longitudinal direction of the feeding element 3.

Figure 17:
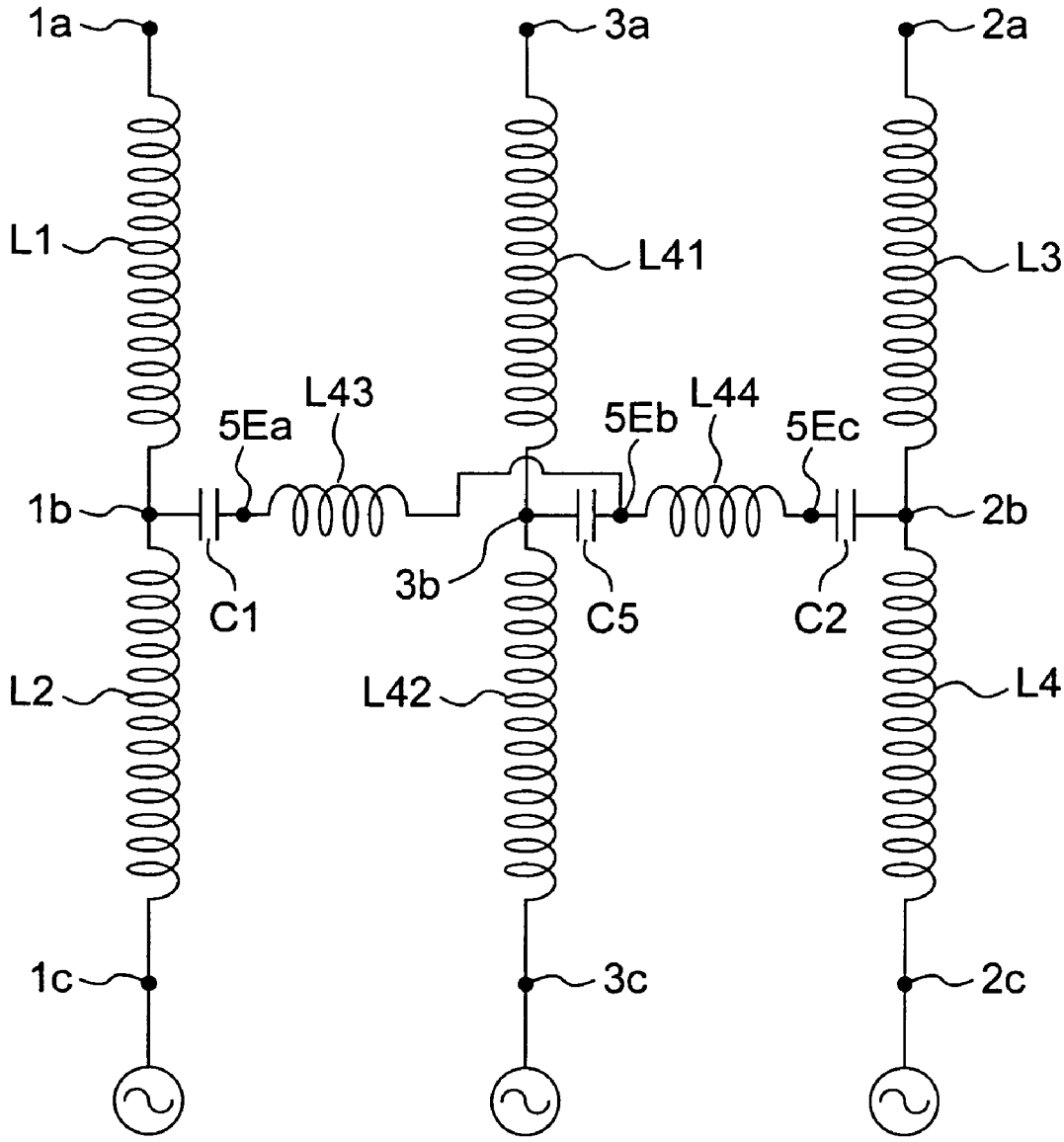
FIG. 17 is a diagram showing an equivalent circuit of feeding elements 1, 2, 3 and a parasitic element 5E in FIGS. 16A and 16B.

FIG. 17 is a diagram showing an equivalent circuit of the feeding elements 1, 2, 3 and the parasitic element 5E in FIGS. 16A and 16B. "3*a*", "3*b*" and "3*c*" denote an top end point, a point close to the parasitic element 5E, and a bottom end point of the feeding element 3 in FIG. 16A, respectively. "5Ea", "5Eb" and "5Ec" denote a left end point (a point close to the feeding element 1), a point close to the feeding element 3, and a right end point (a point close to the feeding element 2) of the parasitic element 5E in FIGS. 16A and 16B, respectively. The point 3*c* corresponds to the feed point P3. A capacitive coupling between the feeding element 1 and the parasitic element 5E is represented by a capacitance C1 between the points 1*b* and 5Ea, a capacitive coupling between the feeding element 2 and the parasitic element 5E is represented by a capacitance C2 between the points 2*b* and 5Ec, and a capacitive coupling between the feeding element 3 and the parasitic element 5E is represented by a capacitance C5 between the points 3*b* and 5Eb. The conductive plates, of which the feeding element 3 and the parasitic element 5E are made, also have certain inductances. Inductances of the feeding element 3 are represented by an inductance L41 between the points 3*a* and 3*b*, and an inductance L42 between the points 3*b* and 3*c*. Inductances of the parasitic element 5E are represented by an inductance L43 between the points 5Ea and 5Eb, and an inductance L44 between the points 5Eb and 5Ec.

The array antenna apparatus of the present preferred embodiment is configured such that when the array antenna apparatus operates in a higher frequency band (e.g., a frequency band near 2 GHz), an input impedance seen from the point 1*b* on the feeding element 1 to the parasitic element 5E and the feeding elements 2 and 3, an input impedance seen from the point 2*b* on the feeding element 2 to the parasitic element 5E and the feeding elements 1 and 3, and an input impedance seen from the point 3*b* on the feeding element 3 to the parasitic element 5E and the feeding elements 1 and 2 become certain high values (substantially infinite values). That is, in the higher frequency band, isolation between the feeding elements 1, 2 and 3 is increased. Hence, in the higher frequency band, it is possible to operate the feeding elements 1, 2 and 3 independent of each other by independently exciting the feeding elements 1, 2 and 3 through the respective feed points P1, P2 and P3 (in the present preferred embodiment, two of the feeding elements 1, 2 and 3 are excited as described below), and thus, the feeding elements 1, 2 and 3 can be used for MIMO communication, etc. On the other hand, the array antenna apparatus of the present preferred embodiment is configured such that when the array antenna apparatus operates in a lower frequency band (e.g., a frequency band near 1 GHz), an input impedance seen from the point 1*b* on the feeding element 1 to the parasitic element 5E and the feeding elements 2 and 3, an input impedance seen from the point 2*b* on the feeding element 2 to the parasitic element 5E and the feeding elements 1 and 3, and an input impedance seen from the point 3*b* on the feeding element 3 to the parasitic element 5E and the feeding elements 1 and 2 become smaller values than the aforementioned high values. Hence, in the lower frequency band, the feeding elements 1, 2, 3 and the parasitic element 5E can operate resonantly as loop antennas by exciting the elements through the feed point P1; the loop antennas include a loop antenna extending from the point 1*c* of the feeding element 1, through the point 1*b* of the feeding element 1, the capacitance C1, the points 5Ea and 5Eb of the parasitic element 5E, the capacitance C5, and the point 3*b* of the feeding element 3, to the point 3*c* of the feeding element 3, and include a loop antenna extending from the point 1*c* of the feeding element 1, through the point 1*b* of the feeding element 1, the capacitance C1, the points 5Ea, 5Eb and 5Ec of the parasitic element 5E, the capacitance C2, and the point 2*b* of the feeding element 2, to the point 2*c* of the feeding element 2. Moreover, in the lower frequency band, the feeding elements 1, 2, 3 and the parasitic element 5E can operate resonantly as loop antennas by exciting the elements through the feed point P2; the loop antennas include a loop antenna extending from the point 2*c* of the feeding element 2, through the point 2*b* of the feeding element 2, the capacitance C2, the points 5Ec and 5Eb of the parasitic element 5E, the capacitance C5, and the point 3*b* of the feeding element 3, to the point 3*c* of the feeding element 3, and include a loop antenna extending from the point 2*c* of the feeding element 2, through the point 2*b* of the feeding element 2, the capacitance C2, the points 5Ec, 5Eb and 5Ea of the parasitic element 5E, the capacitance C1, and the point 1*b* of the feeding element 1, to the point 1*c* of the feeding element 1. Further, in the lower frequency band, the feeding elements 1, 2, 3 and the parasitic element 5E can operate resonantly as loop antennas by exciting the elements through the feed point P3; the loop antennas include a loop antenna extending from the point 3*c* of the feeding element 3, through the point 3*b* of the feeding element 3, the capacitance C5, the points 5Eb and 5Ea of the parasitic element 5E, the capacitance C1, and the point 1*b* of the feeding element 1, to the point 1*c* of the feeding element 1, and include a loop antenna extending from the point 3*c* of the feeding element 3, through the point 3*b* of the feeding element 3, the capacitance C5, the points 5Eb and 5Ec of the parasitic element 5E, the capacitance C2, and the point 2*b* of the feeding element 2, to the point 2*c* of the feeding element 2.

Figure 18A:
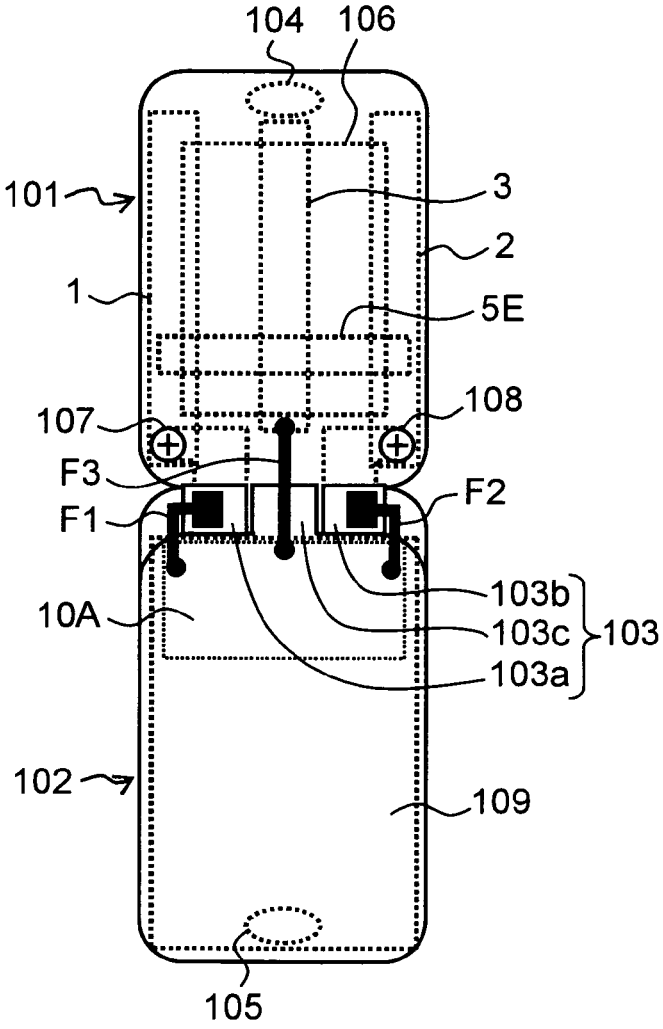
FIG. 18A is a front view of a mobile phone showing an exemplary implementation of the array antenna apparatus in FIGS. 16A and 16B.
Figure 18B:
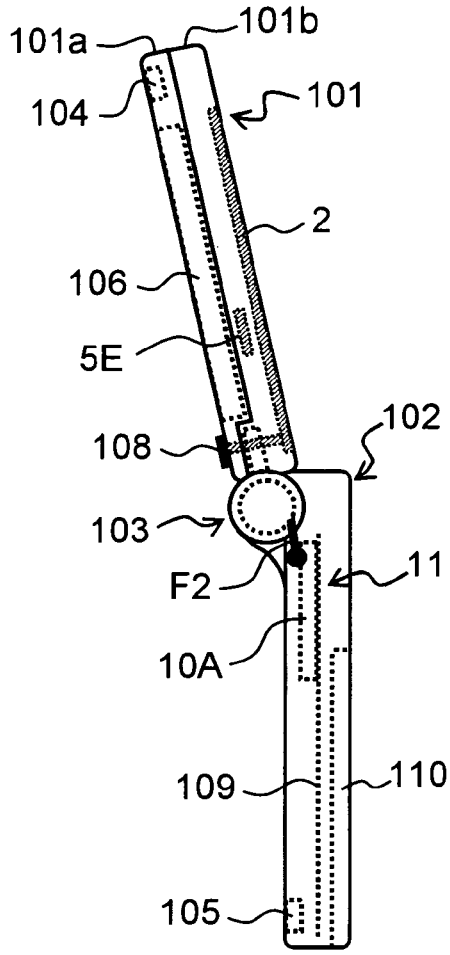
FIG. 18B is a side view of the array antenna apparatus in FIG. 18A.

FIG. 18A is a front view of a mobile phone showing an exemplary implementation of the array antenna apparatus in FIGS. 16A and 16B, and FIG. 18B is a side view thereof. Housings of the mobile phone in FIGS. 18A and 18B are configured in the same manner as in the case of FIGS. 3A and 3B. A radio signal processor circuit 10A is provided on an inner side surface of a printed wiring board 109. Feeding elements 1, 2, 3 and a parasitic element 5E are provided inside an upper housing 101. The feeding elements 1, 2 and 3 are provided so as to extend along a longitudinal direction (up-down direction) of the upper housing 101 and at a left end, a right end and a center of the upper housing 101, and in contact with a surface facing the outer side of the upper housing 101. The parasitic element 5E is positioned towards the inner side of the mobile phone with respect to the feeding elements 1, 2 and 3, so as to be spaced apart by a certain distance from each feeding element 1, 2, 3. As in the case of FIGS. 3A, 3B, 3C and 3D, the feeding elements 1 and 2 are connected to the radio signal processor circuit 10A through a left hinge portion 103*a* and a right hinge portion 103*b*, respectively, which are made of conductor, and in this case, the feeding elements 1 and 2 are capacitively fed by means of capacitances formed within the left hinge portion 103*a* and the right hinge portion 103*b*. In the exemplary implementation of FIGS. 18A and 18B, the feeding element 3 is connected to the radio signal processor circuit 10A through a feed line F3 made of a coaxial cable, and may be capacitively fed in a manner similar to that of the feed points P1 and P2.

Figure 19:
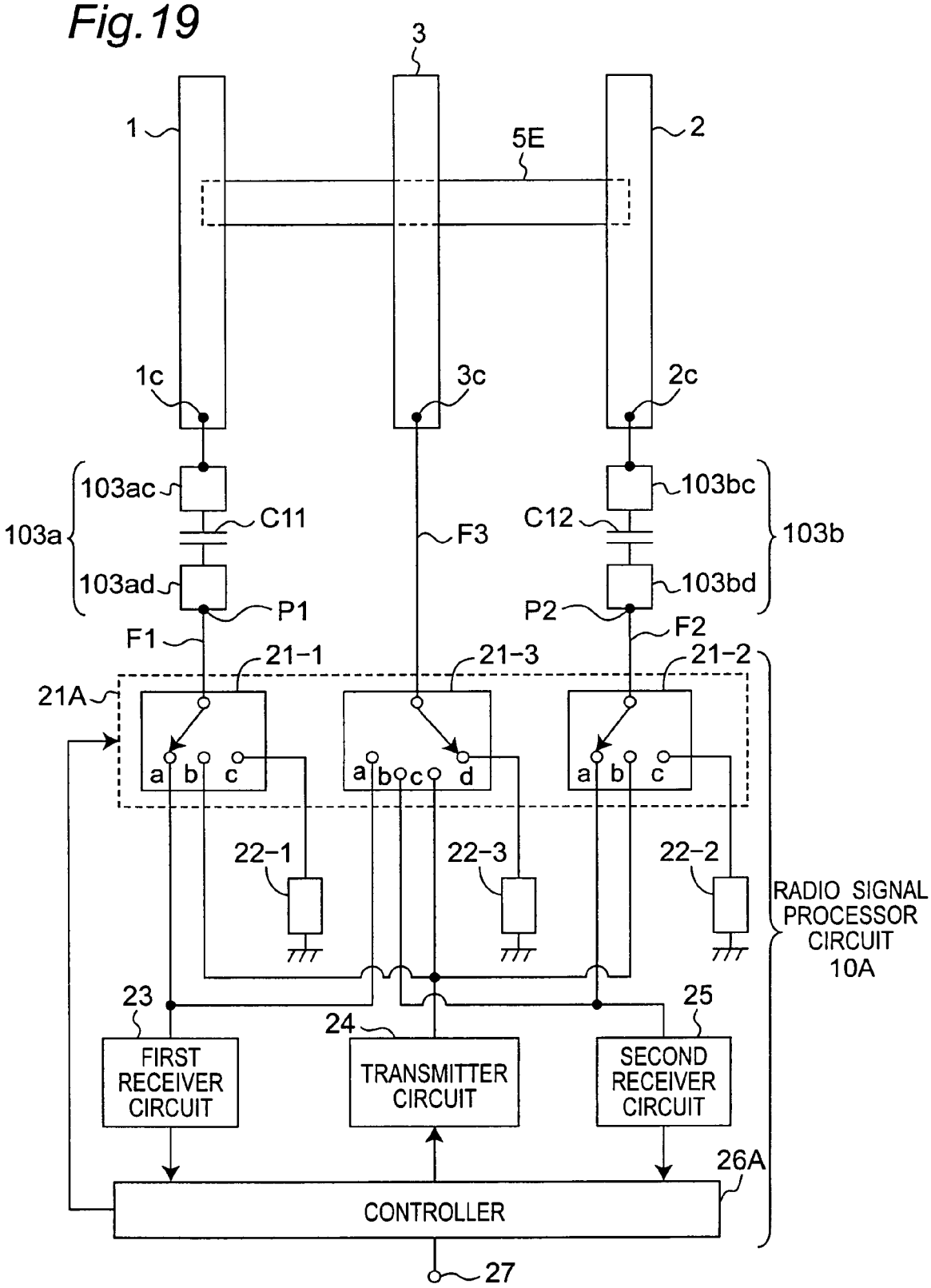
FIG. 19 is a block diagram showing a detailed configuration of a circuit of the array antenna apparatus in the exemplary implementation of FIGS. 18A and 18B.

FIG. 19 is a block diagram showing a detailed configuration of a circuit of the array antenna apparatus in the exemplary implementation of FIGS. 18A and 18B. The point 1*c* at the bottom end of the feeding element 1 is connected to a switch 21-1 of a switch circuit 21A in the radio signal processor circuit 10A through the left hinge portion 103*a* and the feed line F1, in a manner similar to the case of FIG. 4, and the point 2*c* at the bottom end of the feeding element 2 is connected to a switch 21-2 of the switch circuit 11 through the right hinge portion 103*b* and the feed line F2, in a manner similar to the case of FIG. 4. The point 3*c* at the bottom end of the feeding element 3 is the feed point P3, and connected to a switch 21-3 of the switch circuit 21A through the feed line F3. As will be described in detail later, the switch circuit 21A connects the feeding element 1 to one of a first receiver circuit 23, a transmitter circuit 24 and a load 22-1, connects the feeding element 2 to one of a second receiver circuit 25, the transmitter circuit 24 and a load 22-2, and connects the feeding element 3 to one of the first receiver circuit 23, a second receiver circuit 25, the transmitter circuit 24 and a load 22-3, according to control of a controller 26A. The load 22-3 is grounded by being connected to the ground conductor 11 or the like. In this case, the load 22-3 is configured as any of an open, a short-circuit, a capacitance and an inductance, for impedance matching of the feeding element 3 in a desired frequency band. Each of the first receiver circuit 23, the transmitter circuit 24, and the second receiver circuit 25 is configured in the same manner as in the case of FIG. 4. The controller 26A is connected, through an input/output terminal 27 of the radio signal processor circuit 10A, to the other circuits (not shown) in a wireless communication apparatus, such as a mobile phone, to which an array antenna apparatus of the present preferred embodiment is provided.

The control of the switch circuit 21A by the controller 26A and the operation of the array antenna apparatus are as follows.

When the array antenna apparatus is operating for reception in the higher frequency band, two of the switches 21-1, 21-2 and 21-3 are respectively turned to the first receiver circuit 23 and the second receiver circuit 25, and the remaining one switch is turned to a corresponding load. Hence, the switch circuit 21A switches to any of a state in which the feeding elements 1 and 2 are respectively connected to the first receiver circuit 23 and the second receiver circuit 25, and the feeding element 3 is connected to the load 22-3; a state in which the feeding elements 1 and 3 are respectively connected to the first receiver circuit 23 and the second receiver circuit 25, and the feeding element 2 is connected to the load 22-2; and a state in which the feeding elements 3 and 2 are respectively connected to the first receiver circuit 23 and the second receiver circuit 25, and the feeding element 1 is connected to the load 22-1. When the array antenna apparatus is operating in the higher frequency band, isolation between the feeding elements 1, 2 and 3 is sufficiently large, and thus the array antenna apparatus can simultaneously receive radio signals of a plurality of channels (in the present preferred embodiment, two channels) according to a MIMO communication scheme, through two of the feeding elements 1, 2 and 3. When the array antenna apparatus is operating for transmission in the higher frequency band, one of the switches 21-1, 21-2, and 21-3 is turned to the transmitter circuit 24, and the other two switches are turned to corresponding loads. In this case, a signal modulated by the transmitter circuit 24 is transmitted through one of the feeding elements 1, 2 and 3.

When the array antenna apparatus is operating for reception in the lower frequency band, one of the switches 21-1 and 21-3 is turned to the first receiver circuit 23, and the other one of the switches 21-1 and 21-3 and the switch 22-2 are turned to corresponding loads. Hence, the switch circuit 21A switches to either a state in which the feeding element 1 is connected to the first receiver circuit 23, and the feeding elements 2 and 3 are respectively connected to the loads 22-2 and 22-3; or a state in which the feeding element 3 is connected to the first receiver circuit 23, and the feeding elements 1 and 2 are respectively connected to the loads 22-1 and 22-2. When the array antenna apparatus is operating in the lower frequency band, resonances as loop antennas occur in the feeding elements 1, 2, 3 and the parasitic element 5E. When the feeding element 1 is connected to the first receiver circuit 23 and the feeding elements 2 and 3 are respectively connected to the loads 22-2 and 22-3, loop antennas are formed; including a loop antenna extending from the feed point P1 through the left hinge portion 103*a*, the feeding element 1, and the parasitic element 5E, to the point 3*c* on the feeding element 3 (i.e., the feed point P3: the feed point P3 is connected to the load 22-3), and a loop antenna extending from the feed point P1, through the left hinge portion 103*a*, the feeding element 1, the parasitic element 5E, the feeding element 2, and the right hinge portion 103*b*, to the feed point P2 (the feed point P2 is connected to the load 22-2); and the first receiver circuit 23 performs a demodulation process on a signal received through these loop antennas. When the feeding element 3 is connected to the first receiver circuit 23 and the feeding elements 1 and 2 are respectively connected to the loads 22-1 and 22-2, loop antennas are formed; including a loop antenna extending from the point 3*c* on the feeding element 3, through the parasitic element 5E, the feeding element 1, and the left hinge portion 103*a* to the feed point P1 (the feed point P1 is connected to the load 22-1), and a loop antenna extending from the point 3*c* on the feeding element 3, through the parasitic element 5E, the feeding element 2, and the right hinge portion 103*b*, to the feed point P2 (the feed point P2 is connected to the load 22-2); and the first receiver circuit 23 performs a demodulation process on a signal received through these loop antennas. If the second receiver circuit 25 has a demodulation processing function for a received signal in the lower frequency band, one of the switches 21-2 and 21-3 may be turned to the second receiver circuit 25, and the other one of the switches 21-2 and 21-3 and the switch 22-1 may be turned to corresponding loads. In this case, the second receiver circuit performs a demodulation process on a signal received through loop antennas formed by the feeding elements 1, 2, 3 and the parasitic element 5E, in a similar manner as in the case that the feeding element 1 or 3 is connected to the first receiver circuit 23. When the array antenna apparatus is operating for transmission in the lower frequency band, one of the switches 21-1, 21-2, and 21-3 is turned to the transmitter circuit 24, and the other two switches are turned to corresponding loads. In this case, a signal modulated by the transmitter circuit 24 is transmitted through the same loop antenna as that used upon reception operation.

As described above, according to the array antenna apparatus of the present preferred embodiment, the apparatus can ensure sufficient isolation between feeding elements, and can operate in multiple frequency bands, while having a simple configuration. Moreover, the mobile phone of the present preferred embodiment may be configured to perform not limited to the MIMO communication using only two of the feeding elements 1, 2 and 3, but perform MIMO communication using all of the feeding elements 1, 2 and 3, when the array antenna apparatus is operating in the higher frequency band. The feeding elements 1, 2 and 3 may include at least one feeding element having a different element length than others, as described with reference to FIGS. 13A and 13B. Further, an array antenna apparatus including four or more feeding elements may be configured in a manner similar to that of the present preferred embodiment.

Figure 20A:
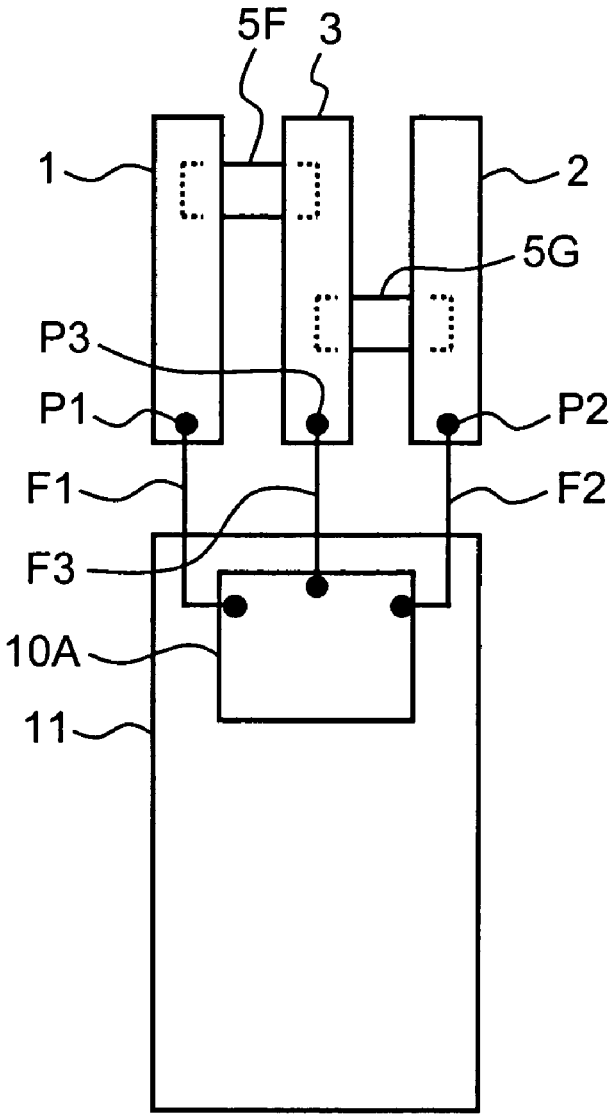
FIG. 20A is a front view showing a schematic configuration of an array antenna apparatus according to a first modified preferred embodiment of the second preferred embodiment of the present invention.
Figure 20B:
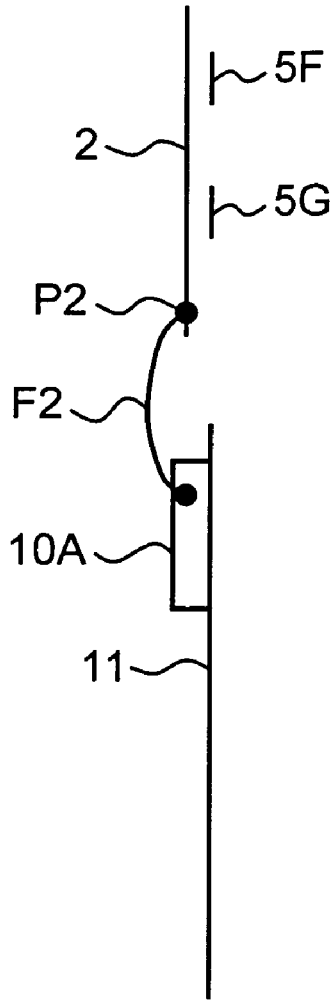
FIG. 20B is a side view of the array antenna apparatus in FIG. 20A.

FIG. 20A is a front view showing a schematic configuration of an array antenna apparatus according to a first modified preferred embodiment of the second preferred embodiment of the present invention, and FIG. 20B is a side view thereof. An array antenna apparatus including three or more feeding elements is not limited to the one having the configuration including a single parasitic element 5E as shown in FIGS. 16A and 16B, and may include a plurality of parasitic elements. The array antenna apparatus in FIGS. 20A and 20B is characterized in that the array antenna apparatus includes a parasitic element 5F made of a conductive plate (conductive strip) between feeding elements 1 and 3, and a parasitic element 5G made of a conductive plate (conductive strip) between feeding elements 2 and 3; and that a distance from feed points P1 and P3 to the parasitic element 5F is different from a distance from feed points P2 and P3 to the parasitic element 5G.

Figure 21:
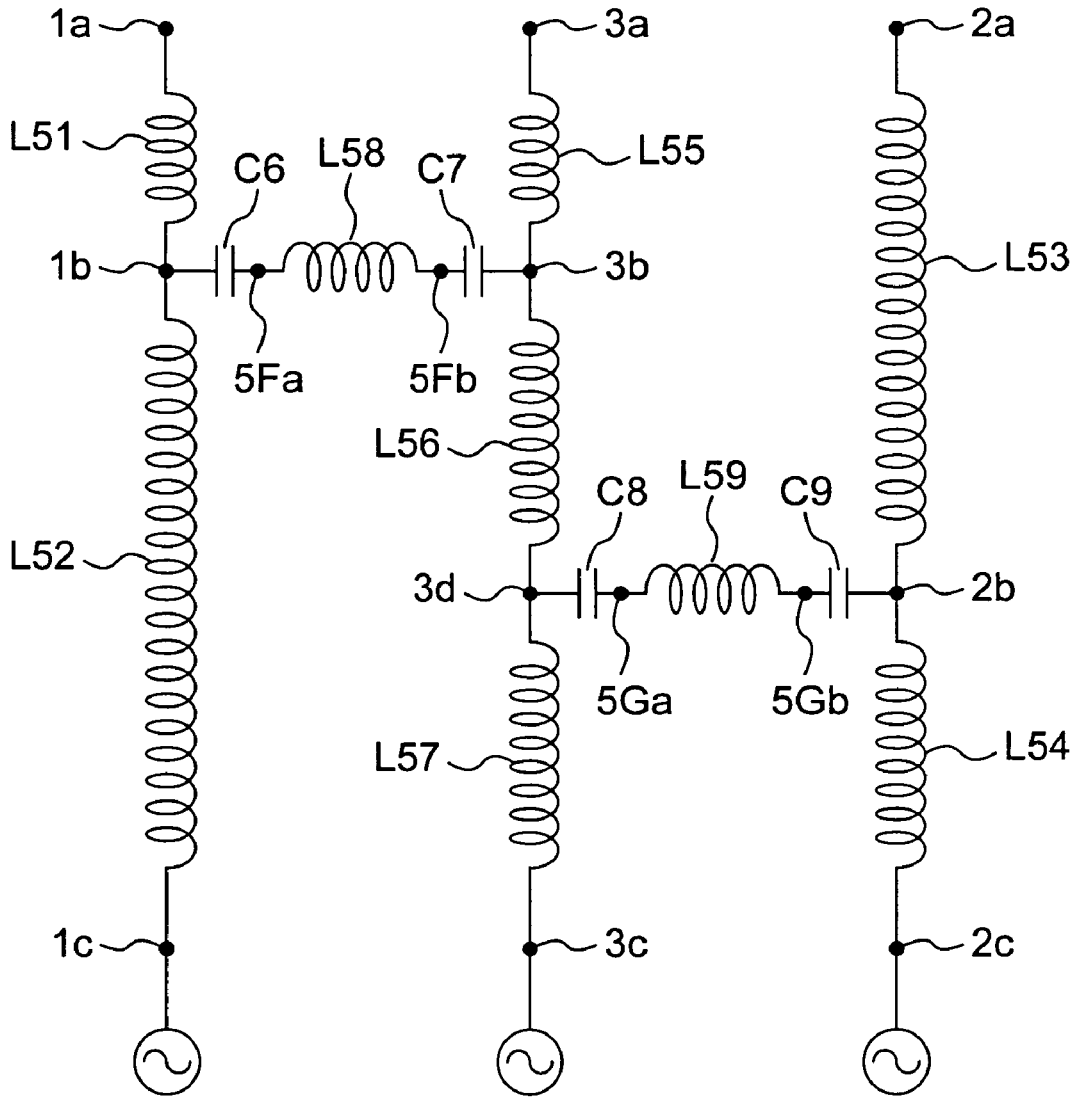
FIG. 21 is a diagram showing an equivalent circuit of feeding elements 1, 2, 3 and parasitic elements 5F and 5G in FIGS. 20A and 20B.

FIG. 21 is a diagram showing an equivalent circuit of the feeding elements 1, 2, 3 and the parasitic elements 5F and 5G in FIGS. 20A and 20B. "1*b*" denotes a point of the feeding element 1 in FIG. 20A close to the parasitic element 5F, "2*b*" denotes a point of the feeding element 2 in FIGS. 20A and 20B close to the parasitic element 5G, "3*b*" and "3*d*" denote points of the feeding element 3 in FIG. 20A close to the parasitic element 5F and close to the parasitic element 5G, respectively. "5Fa" and "5Fb" respectively denote a left end point (a point close to the feeding element 1) and a right end point (a point close to the feeding element 3) of the parasitic element 5F in FIGS. 20A and 20B, "5Ga" and "5Gb" respectively denote a left end point (a point close to the feeding element 3) and a right end point (a point close to the feeding element 2) of the parasitic element 5G in FIGS. 20A and 20B. A capacitive coupling between the feeding element 1 and the parasitic element 5F is represented by a capacitance C6 between the points 1*b* and 5Fa, a capacitive coupling between the feeding element 3 and the parasitic element 5F is represented by a capacitance C7 between the points 3*b* and 5Fb, a capacitive coupling between the feeding element 3 and the parasitic element 5G is represented by a capacitance C8 between the points 3*d* and 5Ga, and a capacitive coupling between the feeding element 2 and the parasitic element 5G is represented by a capacitance C9 between the points 2*b* and 5Gb. Inductances of the feeding element 1 are represented by an inductance L51 between the points 1*a* and 1*b*, and an inductance L52 between the points 1*b* and 1*c*. Inductances of the feeding element 2 are represented by an inductance L53 between the points 2*a* and 2*b*, and an inductance L54 between the points 2*b* and 2*c*. Inductances of the feeding element 3 are represented by an inductance L55 between the points 3*a* and 3*b*, an inductance L56 between the points 3*b* and 3*d*, and an inductance L57 between the points 3*d* and 3*c*. Further, the conductive plates, of which the parasitic elements 5F and 5G are made, have certain inductances. An inductance of the parasitic element 5F is represented by an inductance L58 between the points 5Fa and 5Fb, and an inductance of the parasitic element 5G is represented by an inductance L59 between the points 5Ga and 5Gb.

When the array antenna apparatus of the first modified preferred embodiment of the second preferred embodiment operates in a higher frequency band, it is possible to operate the feeding elements 1, 2 and 3 independent of each other by independently exciting the feeding elements 1, 2 and 3 through the respective feed points P1, P2 and P3 in a similar manner to that of FIGS. 16A and 16B, and thus, the feeding elements 1, 2 and 3 can be used for MIMO communication, etc. On the other hand, the feeding elements 1, 2, 3 and the parasitic element 5E of the array antenna apparatus of the present modified preferred embodiment operate in a lower frequency band as follows. The feeding elements 1, 2, 3 and the parasitic element 5E operates resonantly as a loop antenna by exciting them through the feed point P1 at a certain frequency in the lower frequency band; the loop antenna extends from the point 1*c* of the feeding element 1, through the point 1*b* of the feeding element 1, the capacitance C6, the points 5Fa and 5Fb of the parasitic element 5F, the capacitance C7, and the points 3*b* and 3*d* of the feeding element 3, to the point 3*c* of the feeding element 3. Moreover, the feeding elements and the parasitic elements operates resonantly as a loop antenna by exciting them through the feed point P1 at another frequency in the lower frequency band; the loop antenna extends from the point 1*c* of the feeding element 1, through the point 1*b* of the feeding element 1, the capacitance C6, the points 5Fa and 5Fb of the parasitic element 5F, the capacitance C7, the points 3*b* and 3*d* of the feeding element 3, the capacitance C8, the points 5Ga and 5Gb of the parasitic element 5G, the capacitance C9, and the point 2*b* of the feeding element 2, to the point 2*c* of the feeding element 2. The two loop antennas have certain electrical lengths different from each other, so as to be resonant according to a frequency at which the elements are excited. Similarly, the feeding elements 1, 2, 3 and the parasitic element 5E operates resonantly as a loop antenna by exciting them through the feed point P2 at a certain frequency in the lower frequency band; the loop antenna extends from the point 2*c* of the feeding element 2, through the point 2*b* of the feeding element 2, the capacitance C9, the points 5Gb and 5Ga of the parasitic element 5G, the capacitance C8, and the point 3*d* of the feeding element 3, to the point 3*c* of the feeding element 3. Moreover, the feeding elements 1, 2, 3 and the parasitic element 5E operates resonantly as a loop antenna by exciting them through the feed point P2 at another frequency in the lower frequency band; the loop antenna extends from the point 2*c* of the feeding element 2, through the point 2*b* of the feeding element 2, the capacitance C9, the points 5Gb and 5Ga of the parasitic element 5G, the capacitance C8, the points 3*d* and 3*b* of the feeding element 3, the capacitance C7, the points 5Fb and 5Fa of the parasitic element 5F, the capacitance C6, and the point 1*b* of the feeding element 1, to the point 1*c* of the feeding element 1. Furthermore, the feeding elements 1, 2, 3 and the parasitic element 5E operates resonantly as a loop antenna by exciting them through the feed point P3 at a certain frequency in the lower frequency band; the loop antenna extends from the point 3*c* of the feeding element 3, through the points 3*d* and 3*b* of the feeding element 3, the capacitance C7, the points 5Fb and 5Fa of the parasitic element 5F, the capacitance C6, and the point 1*b* of the feeding element 1, to the point 1*c* of the feeding element 1. Moreover, the feeding elements 1, 2, 3 and the parasitic element 5E operates resonantly as a loop antenna by exciting them through the feed point P3 at another frequency in the lower frequency band; the loop antenna extends from the point 3*c* of the feeding element 3, through the point 3*b* of the feeding element 3, the capacitance C8, the points 5Ga and 5Gb of the parasitic element 5G, the capacitance C9, and the point 2*b* of the feeding element 2, to the point 2*c* of the feeding element 2.

According to the first modified preferred embodiment of the second preferred embodiment, a plurality of different resonant frequencies can be employed when the array antenna apparatus operates in the lower frequency band. since a plurality of loops each having a different electrical length can be formed by providing multiple parasitic elements 5F and 5G. Thus, when it is necessary to perform communications for a plurality of applications in the lower frequency band, the communications can be achieved using different frequencies for different applications.

First Implemental Example

In a first implemental example of the present invention, it is demonstrated that the operating frequency range of an array antenna apparatus extends to the low-frequency side by providing a parasitic element 5.

Figure 22A:
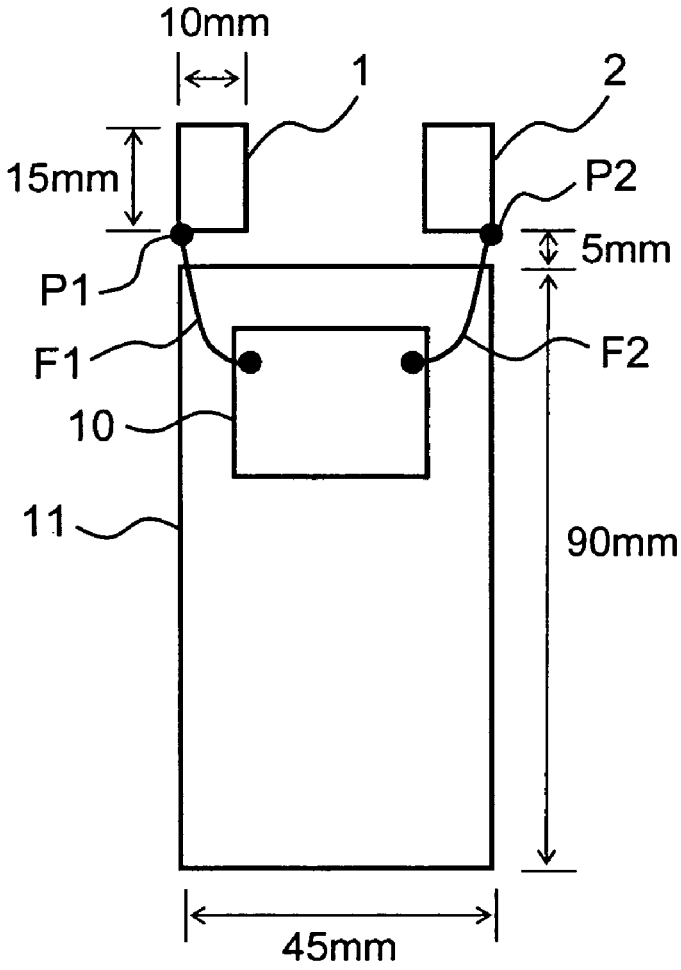
FIG. 22A is a front view showing a schematic configuration of an array antenna apparatus of an example for comparison, without a parasitic element, which is used in a first simulation for the first preferred embodiment of the present invention.
Figure 22B:
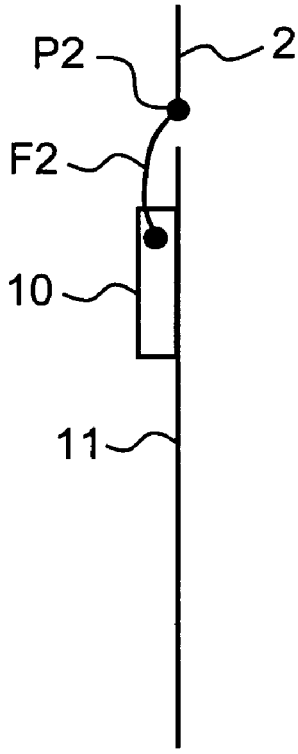
FIG. 22B is a side view of the array antenna apparatus in FIG. 22A.
Figure 23:
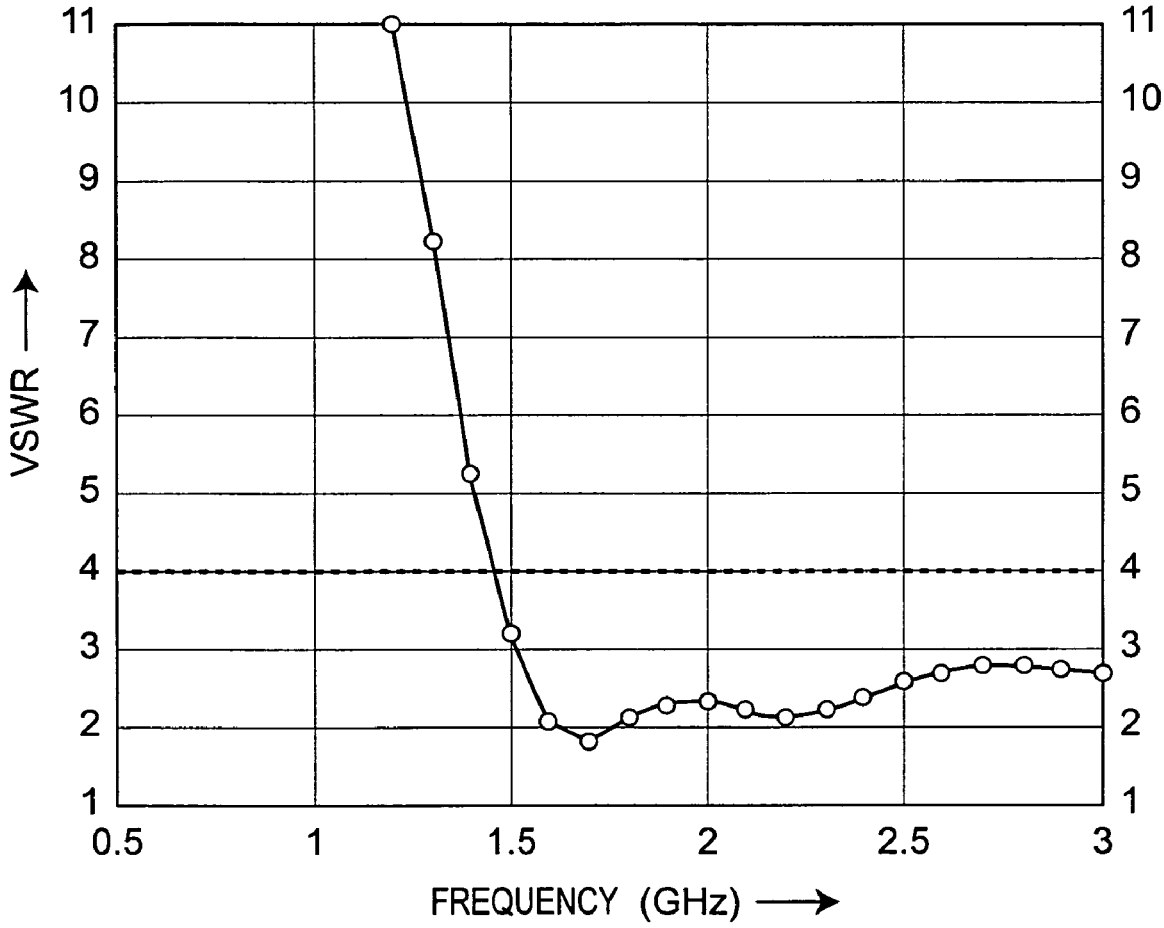
FIG. 23 is a graph showing VSWR versus frequency in connection with a feed point P1 of the array antenna apparatus in FIGS. 22A and 22B.

FIGS. 22A and 22B show the configuration of an array antenna apparatus used in a first simulation for the first preferred embodiment of the present invention. FIG. 22A is a front view showing a schematic configuration of an array antenna apparatus of an example for comparison, without a parasitic element, and FIG. 22B is a side view thereof. Feeding elements 1, 2 and a ground conductor 11 are made of conductive plates having dimensions shown in FIG. 22A, and are in the same plane. FIG. 23 is a graph showing VSWR versus frequency (reflection characteristics) in connection with the feed point P1 of the array antenna apparatus in FIGS. 22A and 22B. In this case, the VSWR represents a value at a port of a radio signal processor circuit 10 connected to the feed point P1 through a feed line F1 of 50Ω. Referring to FIG. 23, it can be seen that the array antenna apparatus in FIGS. 22A and 22B maintains a good VSWR at frequencies higher than about 1.5 GHz, but the VSWR is degraded at frequencies less than or equal to 1.5 GHz.

Figure 24A:
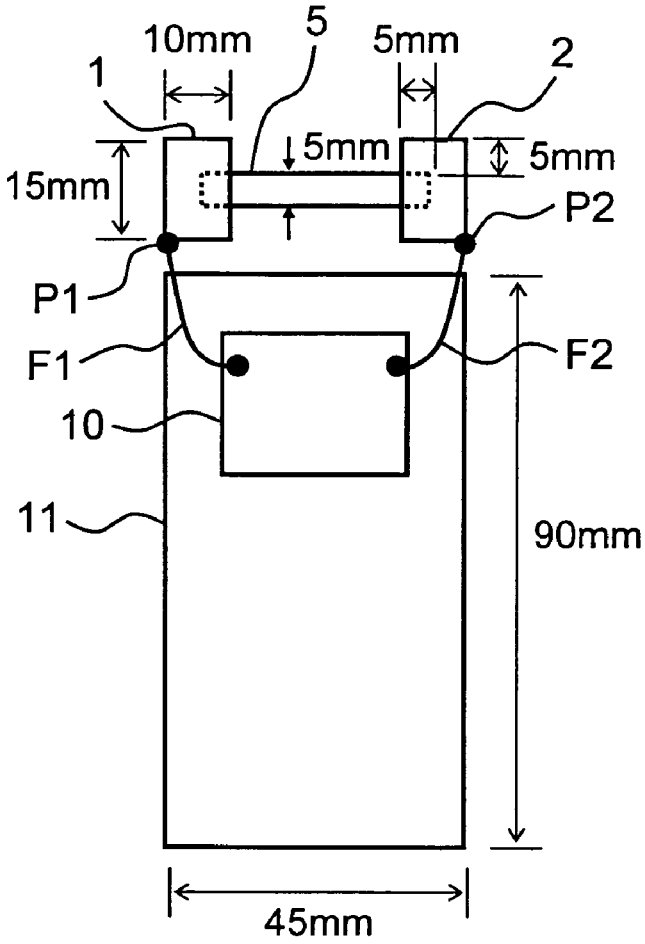
FIG. 24A is a front view showing the configuration of a first implemental example of the array antenna apparatus in FIGS. 1A and 1B, which is used in the first simulation for the first preferred embodiment of the present invention.
Figure 24B:
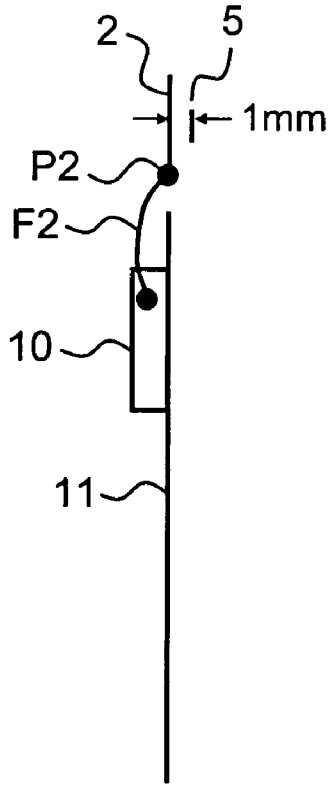
FIG. 24B is a side view of the array antenna apparatus in FIG. 24A.
Figure 25:
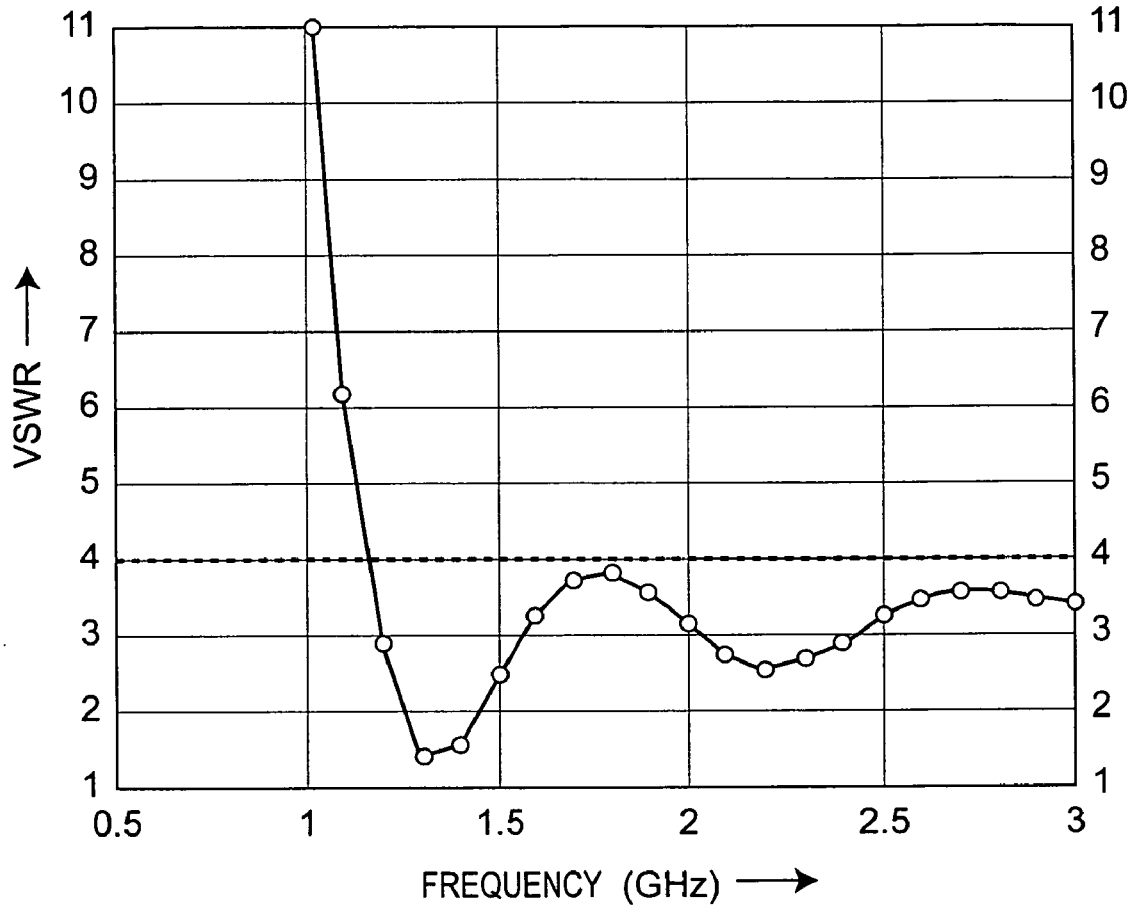
FIG. 25 is a graph showing VSWR versus frequency in connection with a feed point P1 of the array antenna apparatus in FIGS. 24A and 24B.

FIGS. 24A and 24B show the configuration of an array antenna apparatus used in the first simulation for the first preferred embodiment of the present invention. FIG. 24A is a front view showing the configuration of the first implemental example of the array antenna apparatus in FIGS. 1A and 1B, and FIG. 24B is a side view thereof. The array antenna apparatus in FIGS. 24A and 24B further includes a parasitic element 5 in addition to the configuration in FIGS. 22A and 22B. FIG. 25 is a graph showing VSWR versus frequency in connection with the feed point P1 of the array antenna apparatus in FIGS. 24A and 24B. Referring to FIG. 25, it can be seen that the array antenna apparatus in FIGS. 24A and 24B can also operate a frequency band lower than that of the array antenna apparatus in FIGS. 22A and 22B. Preferably, for example, it is possible to perform a MIMO communication using feeding elements 1 and 2 independently at a frequency of 2.2 GHz, and perform a communication using a loop antenna formed by the feeding elements 1, 2 and the parasitic element 5 at a frequency of 1.3 GHz.

Second Implemental Example

In a second implemental example of the present invention, it is demonstrated that mutual coupling between feeding elements 1 and 2 is eliminated by providing a parasitic element 5.

Figure 26A:
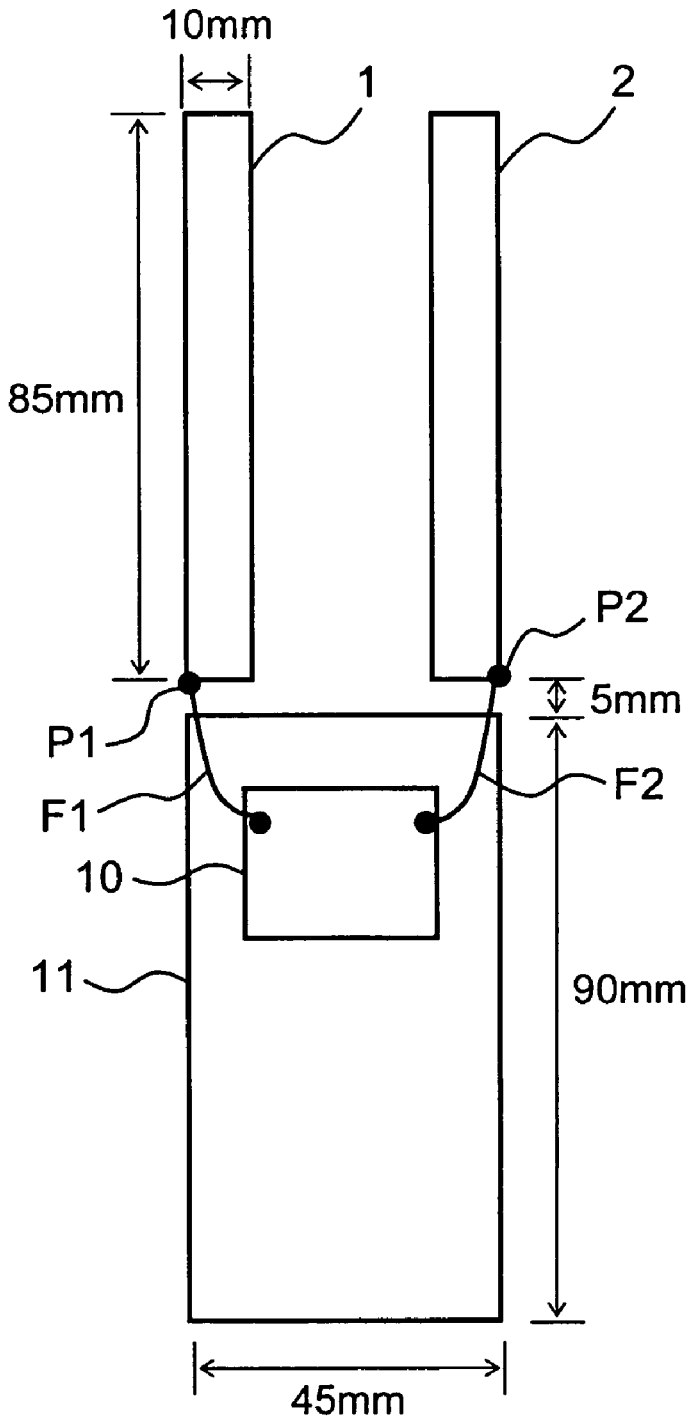
FIG. 26A is a front view showing a schematic configuration of an array antenna apparatus of an example for comparison, without a parasitic element, which is used in a second simulation for the first preferred embodiment of the present invention.
Figure 26B:
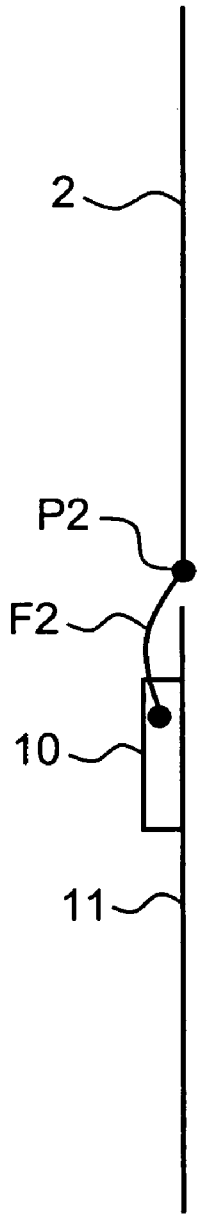
FIG. 26B is a side view of the array antenna apparatus in FIG. 26A.
Figure 27:
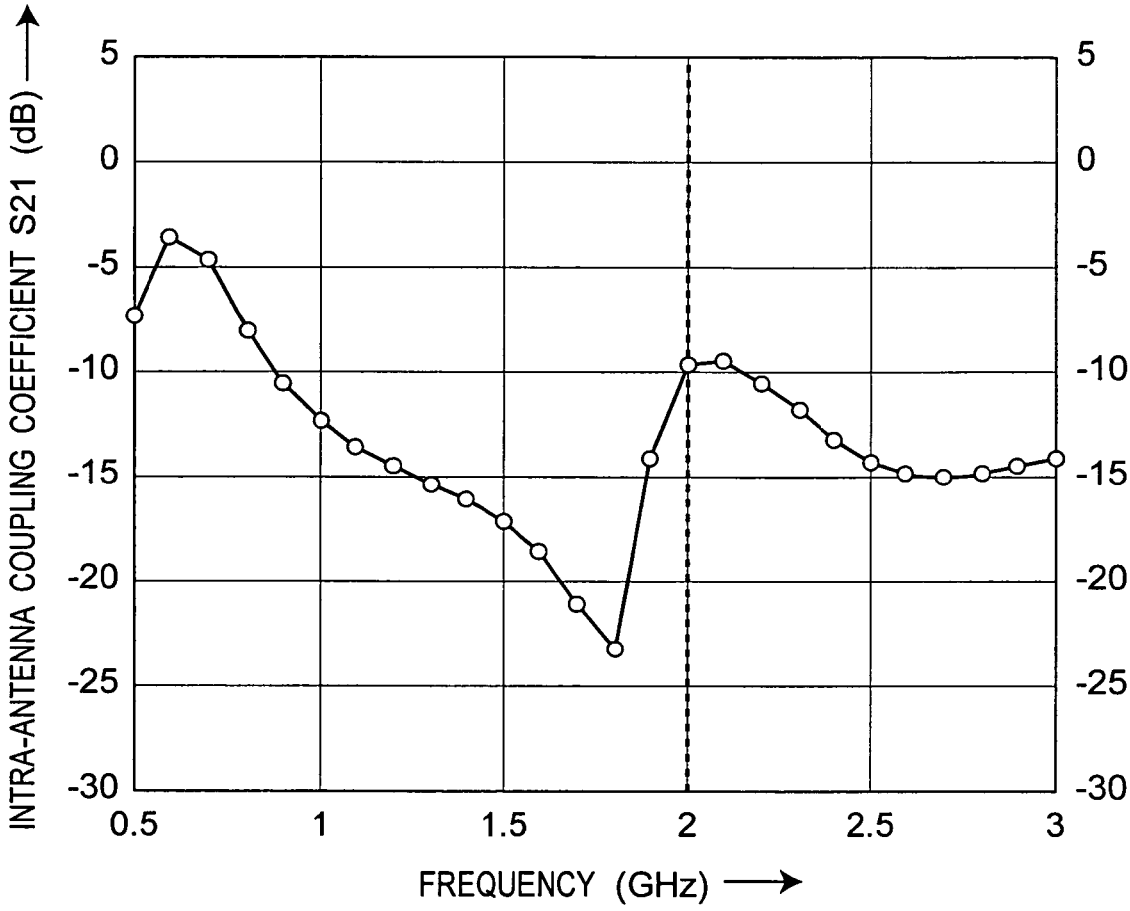
FIG. 27 is a graph showing intra-antenna coupling coefficient S21 versus frequency in the array antenna apparatus of FIGS. 26A and 26B.

FIGS. 26A and 26B show the configuration of an array antenna apparatus used in a second simulation for the first preferred embodiment of the present invention. FIG. 26A is a front view showing a schematic configuration of an array antenna apparatus of an example for comparison, without a parasitic element, and FIG. 26B is a side view thereof. Feeding elements 1, 2 and a ground conductor 11 are made of conductive plates having dimensions shown in FIG. 26A, and are in the same plane. It is assumed that the array antenna apparatus operates in a frequency band near 2 GHz as a higher frequency band. In this case, although the length of a ¼ wavelength λ associated with the frequency band is about 35 mm, the element length (physical length) of the feeding elements 1 and 2 is set to 85 mm in order to optimize VSWR without providing a matching circuit. In this configuration, when the frequency is 2 GHz, the VSWR is about 2. FIG. 27 is a graph showing isolation versus frequency in the array antenna apparatus in FIGS. 26A and 26B. In this case, for representing isolation between the feeding elements 1 and 2, a parameter S21 of a transmission coefficient is used, which is defined from a first port of a radio signal processor circuit 10 connected to feed point P1 through a feed line F1 of 50Ω, to a second port of the radio signal processor circuit 10 connected to feed point P2 through a feed line F2 of 50Ω (hereinafter, referred to as the "intra-antenna coupling coefficient S21"). Referring to FIG. 27, it can be seen that when the frequency is 2 GHz, the intra-antenna coupling coefficient S21 is −9.5 dB. In this case, since the element length of the feeding elements 1 and 2 is increased to optimize the VSWR, it degrades the intra-antenna coupling coefficient S21. However, it is desirable to further improve the intra-antenna coupling coefficient S21, for achieving that the array antenna apparatus operates to perform MIMO communication in a frequency band near 2 GHz.

Figure 28A:
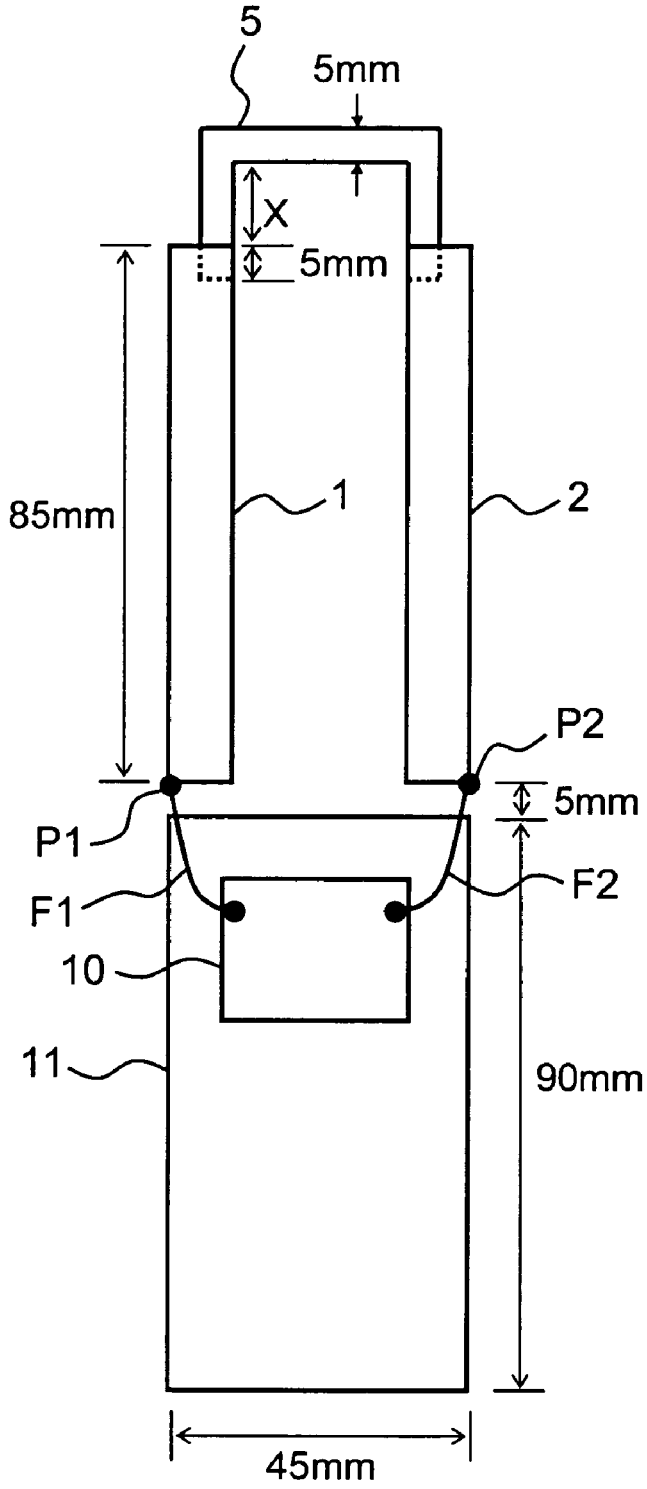
FIG. 28A is a front view showing the configuration of a second implemental example of the array antenna apparatus in FIGS. 1A and 1B, which is used in the second simulation for the first preferred embodiment of the present invention.
Figure 28B:
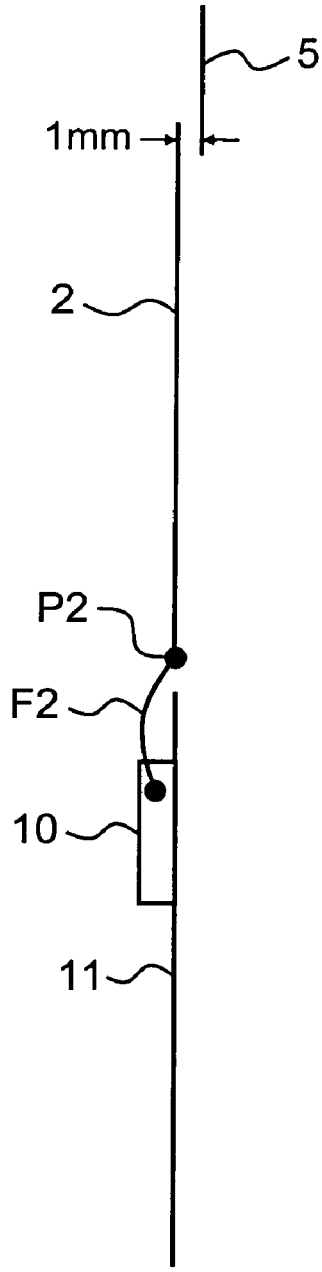
FIG. 28B is a side view of the array antenna apparatus in FIG. 28A.

FIGS. 28A and 28B show the configuration of an array antenna apparatus used in the second simulation for the first preferred embodiment of the present invention. FIG. 28A is a front view showing the configuration of the second implemental example of the array antenna apparatus in FIG. 1, and FIG. 28B is a side view thereof. The array antenna apparatus in FIGS. 28A and 28B further includes a parasitic element 5 in addition to the configuration in FIGS. 26A and 26B. The parasitic element 5 includes a first portion extending over length X upward from a top end of a feeding element 1, a second portion extending rightward from the first portion, and a third portion extending over the length X downward from a right end of the second portion and reaching a top end of a feeding element 2. The parasitic element 5 is provided so as to bridge the top end portions of the feeding elements 1 and 2 to each other. The physical length between feed points P1 and P2 is: 85+10+X+25+X+10+85=215+2×X mm. This physical length may differ from the actual electrical length between the feed points P1 and P2 due to a capacitive coupling between the feeding elements 1, 2 and the parasitic element 5, a current path on the elements, or the like. However, for simplicity, the physical length between the feed points P1 and P2 is referred in the following description.

Figure 29:
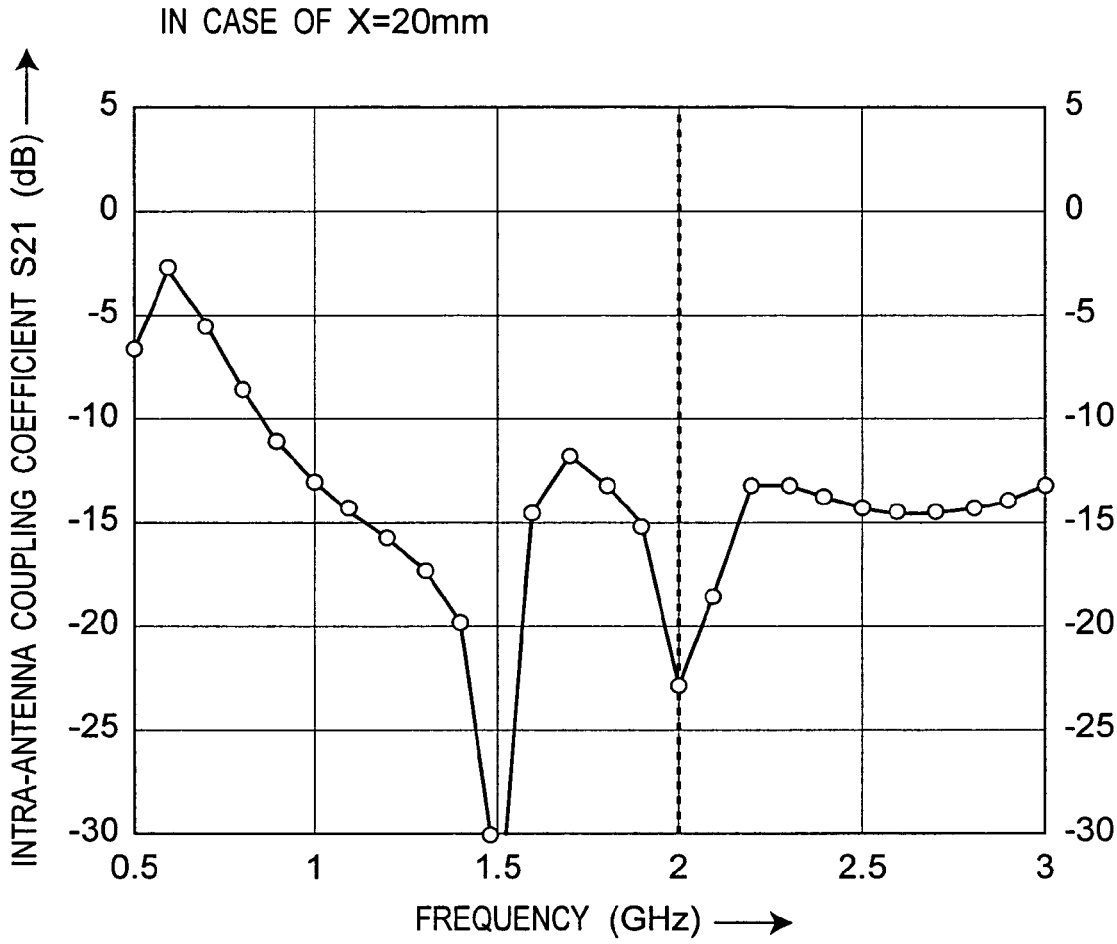
FIG. 29 is a graph showing intra-antenna coupling coefficient S21 versus frequency in case of length X=20 mm in the array antenna apparatus of FIGS. 28A and 28B.
Figure 30:
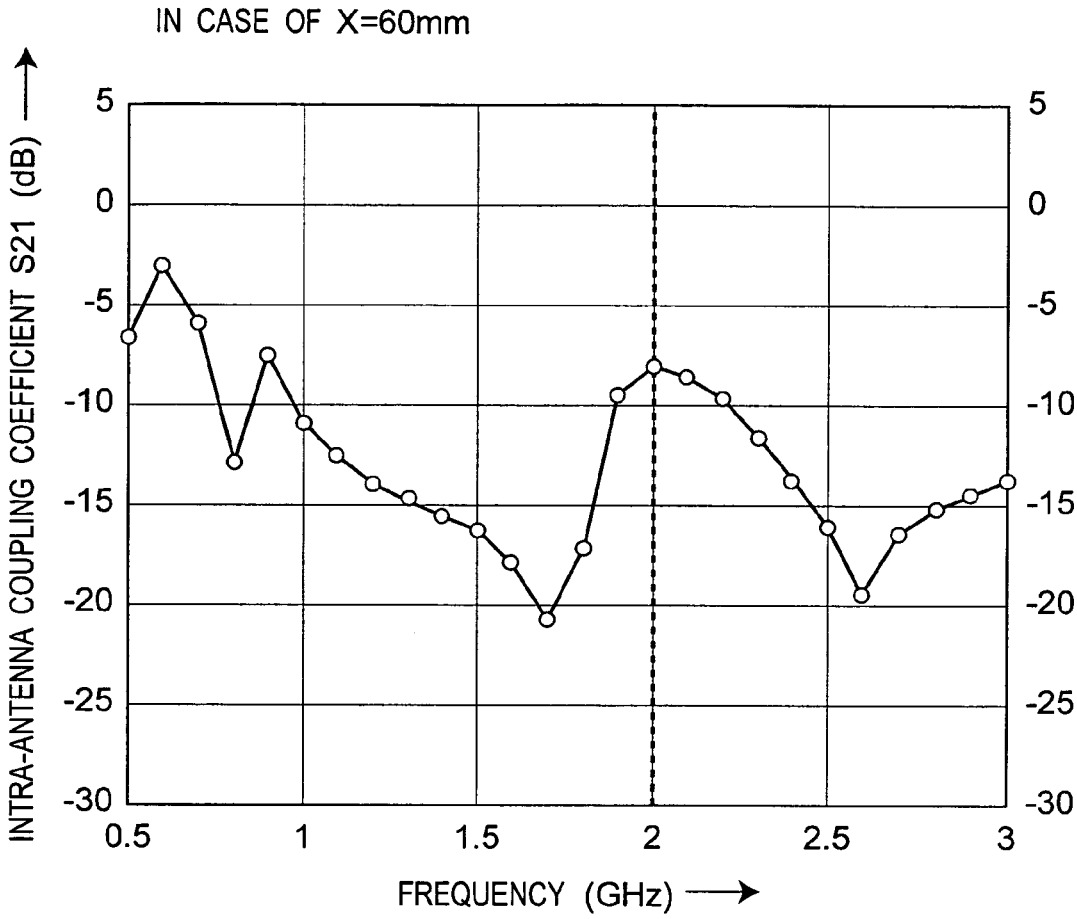
FIG. 30 is a graph showing intra-antenna coupling coefficient S21 versus frequency in case of the length X=60 mm in the array antenna apparatus of FIGS. 28A and 28B.
Figure 31:
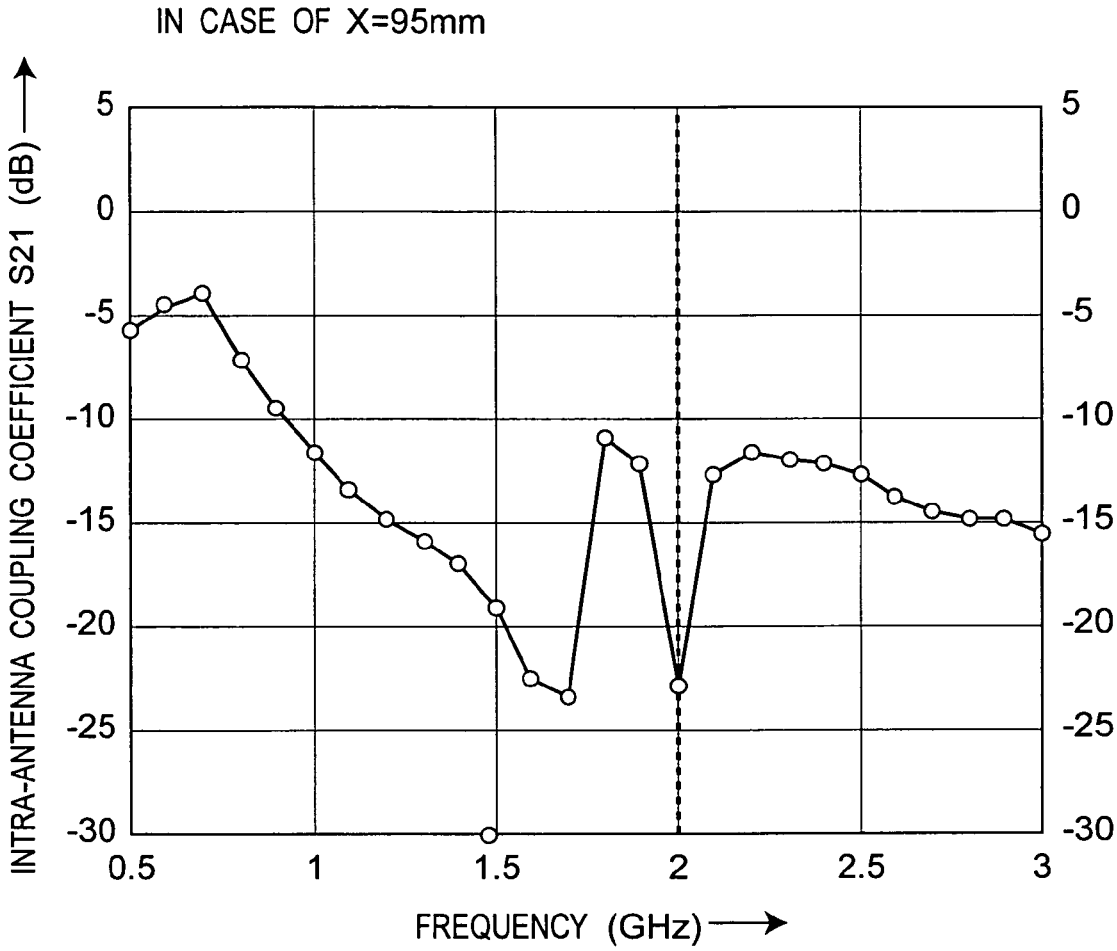
FIG. 31 is a graph showing intra-antenna coupling coefficient S21 versus frequency in case of the length X=95 mm in the array antenna apparatus of FIGS. 28A and 28B.

FIGS. 29 to 31 show simulation results for cases that only the length X is changed in the configuration of the parasitic element 5 of FIGS. 28A and 28B.

FIG. 29 is a graph showing intra-antenna coupling coefficient S21 versus frequency in case of the length X=20 mm in the array antenna apparatus of FIGS. 28A and 28B. It can be seen that by adding the parasitic element 5 with the length X=20 mm to the configuration in FIGS. 26A and 26B, the mutual coupling between the feeding elements 1 and 2 is eliminated, and accordingly, the intra-antenna coupling coefficient S21 is dramatically improved at a frequency of 2 GHz. In this case, the intra-antenna coupling coefficient S21 is optimized for the frequency of 2 GHz, and an intra-antenna coupling coefficient S21 of −23 dB sufficient for performing MIMO communication is achieved at a frequency of 2 GHz. The physical length between the feed points P1 and P2 is: 215+2×20=255 mm, and a wavelength λ associated with a frequency of 2 GHz is 150 mm, thus the physical length between the feed points P1 and P2 corresponds to 1.7 λ.

FIG. 30 is a graph showing intra-antenna coupling coefficient S21 versus frequency in case of the length X=60 mm in the array antenna apparatus of FIGS. 28A and 28B. In this case, it can be seen that the intra-antenna coupling coefficient S21 is −8 dB at a frequency of 2 GHz, and thus the intra-antenna coupling coefficient S21 is not improved as compared with the case of FIG. 27. The physical length between the feed points P1 and P2 is: 215+2×60=335 mm, and thus corresponds to (physical length for the case of the length X=20 mm)+about λ/2. Accordingly, FIG. 30 shows the case in which the physical length of the parasitic element 5 is increased by about λ/2 compared to the case of FIG. 29. Thus, when the length of the parasitic element 5 is not appropriate, the mutual coupling between the feeding elements 1 and 2 is not eliminated.

FIG. 31 is a graph showing intra-antenna coupling coefficient S21 versus frequency in case of the length X=95 mm in the array antenna apparatus of FIGS. 28A and 28B. It can be seen that by setting the length X of the parasitic element 5 to 95 mm, the mutual coupling between the feeding elements 1 and 2 is eliminated, and thus the intra-antenna coupling coefficient S21 is dramatically improved at a frequency of 2 GHz. In this case, an intra-antenna coupling coefficient S21 of −23 dB sufficient to perform MIMO communication is achieved at a frequency of 2 GHz. The physical length between the feed points P1 and P2 is: 215+2×95=405 mm, and thus corresponds to (physical length for the case of the length X=20 mm)+about 1λ. Accordingly, FIG. 31 shows the case in which the physical length of the parasitic element 5 is increased by about 1λ compared to the case of FIG. 29. As such, the mutual coupling between the feeding elements 1 and 2 is eliminated periodically (every one wavelength).

As described above with reference to FIGS. 26A to 31, by providing the parasitic element 5, mutual coupling between the feeding elements 1 and 2 is eliminated, and thus the intra-antenna coupling coefficient S21 is improved. It can be seen from FIGS. 29 to 31 that the intra-antenna coupling coefficient S21 is improved periodically (every one wavelength).

Modified Preferred Embodiments

The shapes of the feeding elements 1 and 2, the parasitic element 5, etc., according to the first preferred embodiment are not limited to rectangular, and these elements can be formed in any shape as long as the shape includes portions at which the feeding element 1 and the parasitic element 5 can be capacitively coupled to each other, and the feeding element 2 and the parasitic element 5 can be capacitively coupled to each other. Moreover, the feeding elements 1 and 2 are not limited to being arranged in the same plane, but can be arranged at any positions as long as the feeding elements 1 and 2 can be capacitively coupled to the parasitic element 5. For example, the feeding elements 1, 2 and the parasitic element 5 may be linear conductive elements, or may be conductive elements shaped in curved lines. The same also applies to the feeding elements 1, 2 and 3, the parasitic element 5E, etc., according to the second preferred embodiment. Moreover, for example, the feeding elements 1, 2 and 3 of the second preferred embodiment may be arranged so as to be parallel to one another and spatially spaced apart by an equal distance from one another. The shape of the ground conductor 11 is also not limited to rectangular, and can be formed in any shape. Although FIGS. 1A, 1B, 3A, 3B, etc. show that the radio signal processor circuit 10 is integrated with the ground conductor 11, the radio signal processor circuit 10 and the ground conductor 11 may be separately provided.

Each of the capacitive couplings between the feeding elements 1, 2 and the parasitic element 5 may be formed by loading a chip capacitor between elements, instead of being formed by conductive plates close to each other. Note that the capacitive coupling portions may not be balanced, and these portions can be formed in any shape as long as desired capacitance values are obtained.

Although in the above descriptions the higher frequency band is a frequency band of 2 GHz and the lower frequency band is a frequency band of 1 GHz, any other frequency band different from these frequency bands can be employed.

In FIGS. 4 and 19, a configuration is described in which when the array antenna apparatus is operating for transmission in a higher frequency band, the array antenna apparatus performs transmission through a single feeding element, and alternatively, the array antenna apparatus may be configured to perform MIMO communication also upon transmission. Moreover, when the array antenna apparatus operates in a higher frequency band, the array antenna apparatus can perform any communication, not limited to the MIMO communication, that requires large isolation between the feeding elements 1 and 2 (or the feeding elements 1, 2 and 3). For example, when the array antenna apparatus operates in a higher frequency band, the array antenna apparatus may modulate and/or demodulate a plurality of independent radio signals; in this case, the array antenna apparatus can simultaneously perform wireless communications for a plurality of applications or simultaneously perform wireless communications in multiple frequency bands. Alternatively, the array antenna apparatus may be configured to operate as a phased array antenna when operating in a higher frequency band.

In FIGS. 4 and 19, a configuration is described in which when the array antenna apparatus is operating in a lower frequency band, the array antenna apparatus is fed in an unbalanced manner (i.e., only one feeding element is fed and the other feeding element(s) is (are) connected to a load(s)), and alternatively, the array antenna apparatus may be configured to be fed in a balanced manner. In this case, e.g., referring the configuration in FIG. 4, the first receiver circuit 23 is connected to both of the feeding elements 1 and 2 upon reception, and the transmitter circuit 24 is connected to both of the feeding elements 1 and 2 upon transmission.

The exemplary implementations of the array antenna apparatuses according to the preferred embodiments of the present invention are not limited to a mobile phone, and it is possible to configure any other apparatus having a wireless communication function. For example, it is possible to configure a laptop personal computer, a handheld personal computer, a mobile phone which is not foldable, or any other portable terminal apparatus, that includes an antenna apparatus according to any of the preferred embodiments.

Alternatively, it is possible to implement a combination of any of the above-described preferred embodiments and modified preferred embodiments.

As described above, the array antenna apparatuses of the preferred embodiments according to the present invention can ensure sufficient isolation between feeding elements, and can operate in multiple frequency bands, while having a simple configuration.

According to the antenna apparatus and the wireless communication apparatus of the present invention, they can be implemented, for example, as a mobile phone, or can also be implemented as a wireless LAN apparatus. The antenna apparatus can be incorporated into a wireless communication apparatus for performing, e.g., MIMO communication, and can also be incorporated into a wireless communication apparatus for performing any communication, not limited to the MIMO, that requires large isolation between feeding elements.

As described above, although the present invention is described in detail using the preferred embodiments, the present invention is not limited thereto. It will be obvious to those skilled in the art that numerous modified preferred embodiments and altered preferred embodiments are possible within the technical scope of the present invention as defined in the following appended claims.

What is claimed is:

1. An array antenna apparatus comprising:

a first feeding element having a first feed point;

a second feeding element having a second feed point; and a first parasitic element electrically connected to the respective first and second feeding elements, wherein in a first frequency band, respective resonances in the first and second feeding elements substantially occur independent of each other, by eliminating electromagnetic mutual coupling between the first and second feeding elements, and exciting the first feeding element through the first feed point as well as exciting the second feeding element through the second feed point, and in a second frequency band lower than the first frequency band, a loop antenna having a certain electrical length is formed by the first and second feeding elements and the first parasitic element, and a resonance of the loop antenna substantially occurs by exciting the first feeding element through the first feed point.

2. The array antenna apparatus as claimed in claim 1, wherein the array antenna apparatus is configured such that:

in the first frequency band, an imaginary part of a mutual impedance between the first and second feeding elements upon assuming that the first parasitic element is not present, and an imaginary part of an impedance appearing by capacitively coupling the first parasitic element to the respective first and second feeding elements are cancelled by each other, whereby the electromagnetic mutual coupling between the first and second feeding elements is eliminated, and in the second frequency band, an imaginary part of a mutual impedance between the first and second feeding elements upon assuming that the first parasitic element is not present, and an imaginary part of an impedance appearing by capacitively coupling the parasitic element to the respective first and second feeding elements are not cancelled, whereby the loop antenna is formed by the first and second feeding elements and the first parasitic element.

3. The array antenna apparatus as claimed in claim 1, wherein each of the first and second feeding elements is electrically connected to the first parasitic element through a capacitive coupling.

4. The array antenna apparatus as claimed in claim 1, wherein each of the first and second feeding elements is electrically connected to the first parasitic element through an LC resonant circuit.

5. The array antenna apparatus as claimed in claim 1, wherein the first parasitic element is grounded.

6. The array antenna apparatus as claimed in claim 5, wherein the first parasitic element is grounded through a capacitance.

7. The array antenna apparatus as claimed in claim 1, wherein the first and second feeding elements are of equal element length to each other.

8. The array antenna apparatus as claimed in claim 1, wherein the first and second feeding elements are of different element lengths from each other.

9. The array antenna apparatus as claimed in claim 1, further comprising a second parasitic element capacitively coupled to the respective first and second feeding elements, wherein the array antenna apparatus is configured such that:

in the first frequency band, an imaginary part of a mutual impedance between the first and second feeding elements upon assuming that the first and second parasitic elements are not present, and an imaginary part of an impedance appearing by capacitively coupling the first and second parasitic elements to the respective first and second feeding elements are cancelled by each other, whereby the electromagnetic mutual coupling between the first and second feeding elements is eliminated, and in the second frequency band, an imaginary part of a mutual impedance between the first and second feeding elements upon assuming that the first and second parasitic elements are not present, and an imaginary part of an impedance appearing by capacitively coupling the first and second parasitic elements to the respective first and second feeding elements are not cancelled, whereby the loop antenna is formed by the first and second feeding elements and the first parasitic element.

10. The array antenna apparatus as claimed in claim 1, wherein in the first frequency band, the feeding elements in which the respective resonances substantially occur independent of each other receive a plurality of channel signals according to a MIMO communication scheme, respectively.

11. An array antenna apparatus comprising:

a first feeding element having a first feed point;

a second feeding element having a second feed point;

a third feeding element having a third feed point; and a parasitic element electrically connected to the respective first, second and third feeding elements, wherein in a first frequency band, respective resonances in at least two feeding elements of the first, second and third feeding elements substantially occur independent of each other, by eliminating electromagnetic mutual coupling between the at least two feeding elements, and exciting one of the at least two feeding elements through the feed point thereof as well as exciting another of the at least two feeding elements through the feed point thereof, and in a second frequency band lower than the first frequency band, a loop antenna having a certain electrical length is formed by the first feeding element, the parasitic element, and one of the second and third feeding elements, and a resonance of the loop antenna substantially occurs by exciting the first feeding element through the first feed point.

12. An array antenna apparatus comprising:

a first feeding element having a first feed point;

a second feeding element having a second feed point;

a third feeding element having a third feed point;

a first parasitic element electrically connected to the respective first and second feeding elements; and a second parasitic element electrically connected to the respective second and third feeding elements, wherein in a first frequency band, respective resonances in at least two feeding elements of the first, second and third feeding elements substantially occur independent of each other, by eliminating electromagnetic mutual coupling between the at least two feeding elements, and exciting one of the at least two feeding elements through the feed point thereof as well as exciting another of the at least two feeding elements through the feed point thereof, at a first frequency in a second frequency band lower than the first frequency band, a first loop antenna having a first electrical length is formed by the first and second feeding elements and the first parasitic element, and a resonance of the first loop antenna substantially occurs by exciting the first feeding element through the first feed point, and at a second frequency different from the first frequency in the second frequency band, a second loop antenna having a second electrical length different from the first electrical length is formed by the second and third feeding elements and the second parasitic element, and a resonance of the second loop antenna substantially occurs by exciting the third feeding element through the third feed point.

13. A wireless communication apparatus comprising an array antenna apparatus, the array antenna apparatus including:

a first feeding element having a first feed point;

a second feeding element having a second feed point; and a first parasitic element electrically connected to the respective first and second feeding elements, wherein in a first frequency band, respective resonances in the first and second feeding elements substantially occur independent of each other, by eliminating electromagnetic mutual coupling between the first and second feeding elements, and exciting the first feeding element through the first feed point as well as exciting the second feeding element through the second feed point, and in a second frequency band lower than the first frequency band, a loop antenna having a certain electrical length is formed by the first and second feeding elements and the first parasitic element, and a resonance of the loop antenna substantially occurs by exciting the first feeding element through the first feed point.

* * * * *